US011273649B2

(12) United States Patent
Netsu et al.

(10) Patent No.: US 11,273,649 B2
(45) Date of Patent: Mar. 15, 2022

(54) PRINTER

(71) Applicant: SEIKO EPSON CORPORATION, Tokyo (JP)

(72) Inventors: Takahiro Netsu, Nagano (JP); Takuma Usuda, Nagano (JP); Kei Nagaoka, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/995,888

(22) Filed: Aug. 18, 2020

(65) Prior Publication Data

US 2021/0053357 A1 Feb. 25, 2021

(30) Foreign Application Priority Data

Aug. 20, 2019 (JP) ..... JP2019-150126

(51) Int. Cl.
*B41J 2/175* (2006.01)

(52) U.S. Cl.
CPC ..... *B41J 2/17566* (2013.01); *B41J 2/17503* (2013.01); *B41J 2/17509* (2013.01); *B41J 2/17513* (2013.01); *B41J 2/17553* (2013.01); *B41J 2002/17573* (2013.01)

(58) Field of Classification Search
CPC .... B41J 2/175; B41J 2/17503; B41J 2/17506; B41J 2/17509; B41J 2/17513; B41J 2/17553; B41J 2/17566; B41J 2002/17573
See application file for complete search history.

(56) References Cited

U.S. PATENT DOCUMENTS

| | | | | |
|---|---|---|---|---|
| 5,132,711 | A | 7/1992 | Shinada et al. | |
| 5,652,610 | A | 7/1997 | Kawai et al. | |
| 5,655,032 | A * | 8/1997 | Ohsawa | G06T 9/004 382/238 |
| 5,689,290 | A | 11/1997 | Saito et al. | |
| 5,691,760 | A | 11/1997 | Hosier et al. | |
| 5,757,390 | A | 5/1998 | Gragg et al. | |
| 6,086,178 | A | 7/2000 | Kawashima et al. | |
| 6,098,029 | A | 8/2000 | Takagi et al. | |
| 6,249,655 | B1 | 6/2001 | Baek et al. | |
| 6,337,959 | B1 | 1/2002 | Kwak et al. | |
| 6,390,590 | B1 | 5/2002 | Hansburg | |
| 6,513,892 | B2 | 2/2003 | Inoue et al. | |
| 6,520,612 | B1 | 2/2003 | Merz et al. | |

(Continued)

FOREIGN PATENT DOCUMENTS

| | | | |
|---|---|---|---|
| CN | 201597251 | U | 10/2010 |
| EP | 2815884 | A1 | 12/2014 |

(Continued)

*Primary Examiner* — Anh T Vo
(74) *Attorney, Agent, or Firm* — Global IP Counselors, LLP

(57) ABSTRACT

A printer includes an ink tank, a print head that performs printing by using ink in the ink tank, a light source that emits light into the ink tank, a sensor that outputs pixel data by detecting light incident from an ink tank side in a period during which the light source emits light, and a processing section that determines an ink amount by an output of the sensor. The processing section determines an ink amount based on low resolution pixel data output from the sensor in a first reading area and high resolution pixel data output from the sensor in a second reading area other than the first reading area.

10 Claims, 40 Drawing Sheets

(56) References Cited

U.S. PATENT DOCUMENTS

| | | | | |
|---|---|---|---|---|
| 6,729,711 | B1 | 5/2004 | Hashimoto et al. | |
| 7,049,622 | B1 | 5/2006 | Weiss | |
| 7,234,787 | B2 | 6/2007 | Grady et al. | |
| 7,522,308 | B2 | 4/2009 | Ueda | |
| 7,753,500 | B2 | 7/2010 | Nishida | |
| 7,872,746 | B2 | 1/2011 | Gao et al. | |
| 7,984,980 | B2 | 7/2011 | Kachi | |
| 8,123,317 | B2 | 2/2012 | Ikeda | |
| 8,348,363 | B2 | 1/2013 | Yamamoto | |
| 8,937,743 | B1 * | 1/2015 | Kasuya | G07D 7/12 358/1.2 |
| 9,279,711 | B1 | 3/2016 | Guldalian | |
| 9,415,601 | B1 | 8/2016 | Tsukida | |
| 10,065,426 | B2 | 9/2018 | Hayashi et al. | |
| 2001/0035887 | A1 | 11/2001 | Altfather et al. | |
| 2002/0003579 | A1 | 1/2002 | Inagaki | |
| 2002/0008722 | A1 | 1/2002 | Imanaka et al. | |
| 2002/0140750 | A1 | 10/2002 | Yoshiyama et al. | |
| 2002/0175979 | A1 | 11/2002 | Morita et al. | |
| 2003/0007024 | A1 * | 1/2003 | Fujimori | H04N 1/40087 347/15 |
| 2004/0017445 | A1 | 1/2004 | Kojima et al. | |
| 2004/0057097 | A1 | 3/2004 | Huang et al. | |
| 2004/0109039 | A1 | 6/2004 | Kojima et al. | |
| 2005/0156984 | A1 | 7/2005 | Uejima et al. | |
| 2006/0152539 | A1 | 7/2006 | Zhang et al. | |
| 2007/0040858 | A1 | 2/2007 | Campbell et al. | |
| 2007/0115314 | A1 | 5/2007 | Kondo et al. | |
| 2007/0229626 | A1 | 10/2007 | Yano | |
| 2008/0198188 | A1 | 8/2008 | Umeda | |
| 2009/0040251 | A1 | 2/2009 | Motominami et al. | |
| 2009/0115804 | A1 | 5/2009 | Cai et al. | |
| 2009/0128839 | A1 | 5/2009 | Mori | |
| 2009/0153846 | A1 | 6/2009 | Gan et al. | |
| 2010/0182637 | A1 * | 7/2010 | Tamura | H04N 1/40068 358/1.15 |
| 2011/0112472 | A1 | 5/2011 | Jacobson et al. | |
| 2012/0097567 | A1 | 4/2012 | Zhao et al. | |
| 2013/0293624 | A1 | 11/2013 | Lester et al. | |
| 2013/0300786 | A1 | 11/2013 | Muyskens et al. | |
| 2014/0022292 | A1 | 1/2014 | Jones et al. | |
| 2014/0043384 | A1 | 2/2014 | Nakano et al. | |
| 2014/0125007 | A1 | 5/2014 | Sakano et al. | |
| 2014/0368564 | A1 | 12/2014 | Aznoe et al. | |
| 2015/0256701 | A1 | 9/2015 | Kimura et al. | |
| 2015/0365555 | A1 | 12/2015 | Kinoshita et al. | |
| 2016/0279962 | A1 | 9/2016 | Ishida et al. | |
| 2016/0298997 | A1 | 10/2016 | Tence et al. | |
| 2017/0057240 | A1 | 3/2017 | Munakata | |
| 2017/0234717 | A1 | 8/2017 | Tsuboi et al. | |
| 2018/0126744 | A1 | 5/2018 | Moriyama et al. | |
| 2018/0201492 | A1 | 7/2018 | Jung et al. | |
| 2019/0009532 | A1 | 1/2019 | Koyano et al. | |
| 2019/0391018 | A1 | 12/2019 | Dann | |
| 2020/0034672 | A1 | 1/2020 | Konishi et al. | |
| 2020/0122995 | A1 | 4/2020 | Chernov et al. | |
| 2020/0171836 | A1 | 6/2020 | Gardner et al. | |
| 2020/0240826 | A1 | 7/2020 | Vaughan et al. | |
| 2020/0254754 | A1 | 8/2020 | Netsu | |
| 2020/0254768 | A1 | 8/2020 | Netsu | |
| 2020/0254770 | A1 | 8/2020 | Netsu | |
| 2020/0254771 | A1 | 8/2020 | Netsu et al. | |
| 2020/0254772 | A1 | 8/2020 | Netsu | |
| 2020/0254773 | A1 | 8/2020 | Netsu | |
| 2020/0254774 | A1 | 8/2020 | Netsu | |
| 2020/0254775 | A1 | 8/2020 | Netsu | |
| 2021/0053355 | A1 | 2/2021 | Usuda et al. | |
| 2021/0053356 | A1 | 2/2021 | Netsu et al. | |
| 2021/0053358 | A1 | 2/2021 | Netsu et al. | |

FOREIGN PATENT DOCUMENTS

| | | | |
|---|---|---|---|
| JP | 2001-105627 | A | 4/2001 |
| JP | 2005-186388 | A | 7/2005 |
| WO | 2009/016614 | A2 | 2/2009 |

* cited by examiner

FIG. 36

| | R LIGHT SOURCE | G LIGHT SOURCE | B LIGHT SOURCE |
|---|---|---|---|
| PIGMENT Bk | ○ | ○ | ○ |
| PIGMENT C | ○ | ○ | △ |
| PIGMENT M | × | ○ | ○ |
| PIGMENT Y | * | × | ○ |
| PIGMENT W | * | * | * |
| PIGMENT CL | △ | △ | △ |

PRINTER

The present application is based on, and claims priority from JP Application Serial Number 2019-150126, filed Aug. 20, 2019, the disclosure of which is hereby incorporated by reference here in its entirety.

BACKGROUND

1. Technical Field

The present disclosure relates to a printer and the like.

2. Related Art

In the related art, there is known a method for determining the presence or absence of ink in an ink container in a printer performing printing by using ink. For example, in JP-A-2001-105627, an ink supply device that detects a liquid level of ink by receiving light emitted from a light emitter and passing through an ink bottle by using a light receiver is disclosed. Further improvements of the printer have been required.

There has been a demand for further improvements in printers.

SUMMARY

According to an aspect of the present disclosure, there is provided a printer including: an ink tank; a print head that performs printing by using ink in the ink tank; a light source that emits light into the ink tank; a sensor that outputs pixel data by detecting light from an ink tank side in a period during which the light source emits light; and a processing section that determines an ink amount by an output of the sensor, in which the processing section determines the ink amount based on low resolution pixel data output from the sensor in a first reading area and high resolution pixel data output from the sensor in a second reading area other than the first reading area.

BRIEF DESCRIPTION OF THE DRAWINGS

FIG. 36 is a diagram illustrating an example of combination patterns of light amount characteristics.

DESCRIPTION OF EXEMPLARY EMBODIMENTS

Hereinafter, the present embodiment will be described. The present embodiment described below does not unduly limit the content described in claims. Also, not all configurations described in the present embodiment are essential configuration requirements. The plurality of embodiments described below may be combined with each other or may be replaced with each other.

Figure 1:
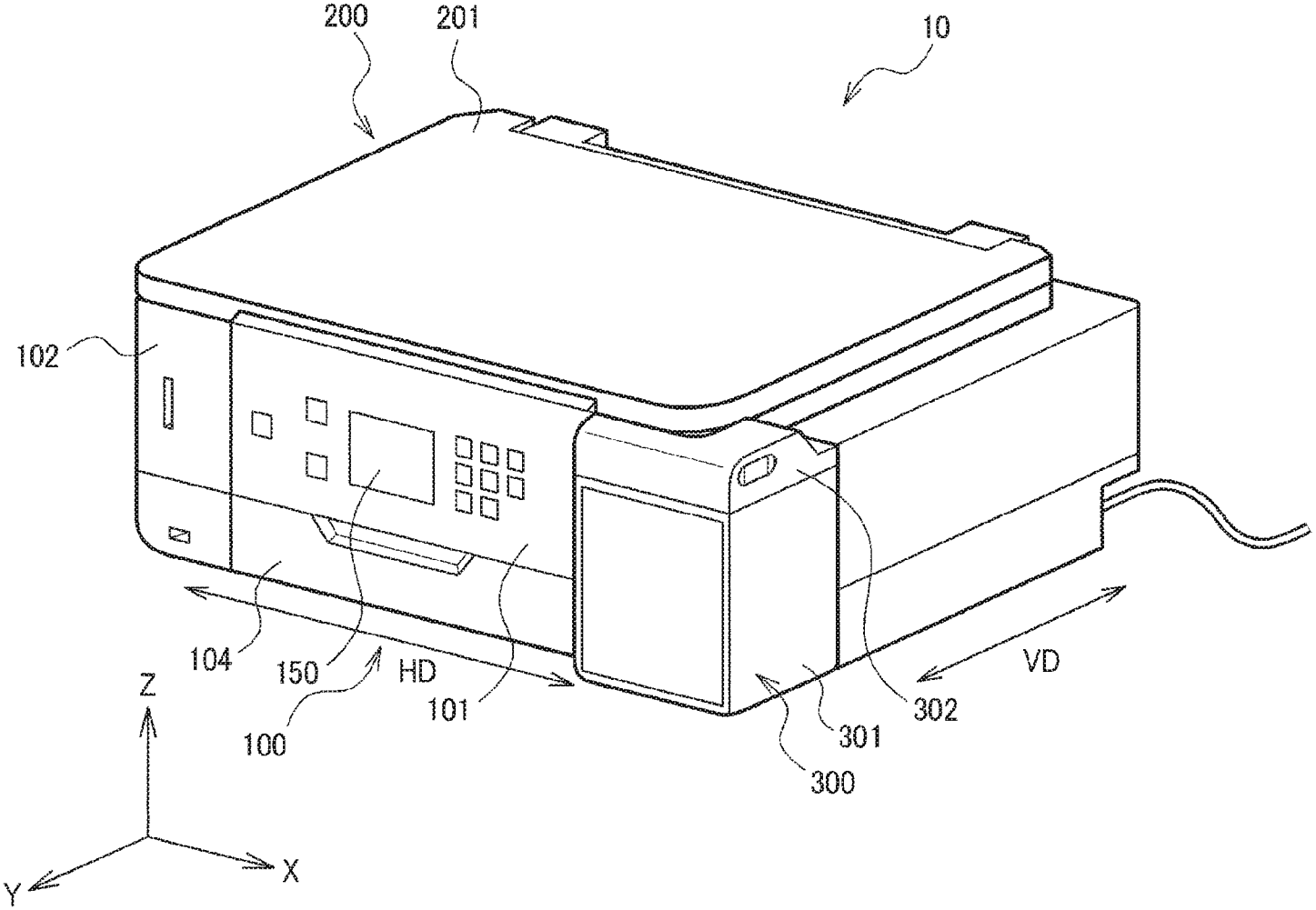
FIG. 1 is a perspective diagram illustrating a configuration of an electronic apparatus.

1. Configuration Example of Electronic Apparatus 1.1 Basic Configuration of Electronic Apparatus FIG. 1 is a perspective diagram of an electronic apparatus 10 according to the present embodiment. The electronic apparatus 10 is a multifunction peripheral (MFP) including a printer unit 100 and a scanner unit 200. The electronic apparatus 10 may have other functions such as a facsimile function in addition to a printing function and a scanning function. Alternatively, only the printing function may be provided. The electronic apparatus 10 includes an ink tank unit 300 that accommodates ink tanks 310. The printer unit 100 is an ink jet printer which executes printing by using ink supplied from the ink tanks 310. Hereinafter, the description of the electronic apparatus 10 can be appropriately replaced with a printer.

FIG. 1 illustrates a Y-axis, an X-axis orthogonal to the Y-axis, and a Z-axis orthogonal to the X-axis and the Y-axis. In each of the XYZ axes, a direction of an arrow indicates a positive direction, and a direction opposite to the direction of the arrow indicates a negative direction. Hereinafter, the positive direction of the X-axis is described as +X direction and the negative direction is described as −X direction. The same applies to the Y-axis and the Z-axis. The electronic apparatus 10 is disposed on a horizontal plane defined by the X-axis and the Y-axis in a use state, and the +Y direction is the front of the electronic apparatus 10. The Z-axis is an axis orthogonal to the horizontal plane, and the −Z direction is vertically downward direction.

The electronic apparatus 10 has an operation panel 101 as a user interface section. The operation panel 101 is provided with buttons for performing, for example, an ON/OFF operation of a power supply of the electronic apparatus 10, an operation related to printing using the printing function, and an operation related to reading of a document using the scanning function. The operation panel 101 is also provided with a display section 150 for displaying an operating state of the electronic apparatus 10 and a message or the like. Further, the display section 150 displays an ink amount detected by the method described later. Further, the operation panel 101 may be provided with a reset button for the user to replenish ink in the ink tank 310 to execute reset processing.

1.2 Printer Unit and Scanner Unit

A printer unit 100 performs printing on a printing medium P such as printing paper by ejecting ink. The printer unit 100 has a case 102 which is an outer shell of the printer unit 100. On a front side of the case 102, a front cover 104 is provided. Here, the "front" represents a face on which the operation panel 101 is provided and represents a face in the +Y direction of the electronic apparatus 10. The operation panel 101 and the front cover 104 are rotatable around the X-axis with respect to the case 102. The electronic apparatus 10 includes a paper cassette (not illustrated), and the paper cassette is provided in the −Y direction with respect to the front cover 104. The paper cassette is connected to the front cover 104 and detachably attached to the case 102. A paper discharge tray (not illustrated) is provided in the +Z direction of the paper cassette, and the paper discharge tray can be expanded and contracted in the +Y direction and the −Y direction. The paper discharge tray is provided in the −Y direction with respect to the operation panel 101 in the state illustrated in FIG. 1, and exposed to the outside by the rotation of the operation panel 101.

The X-axis is a main scanning axis HD of a print head 107, and the Y-axis is a sub-scanning axis VD of the printer unit 100. A plurality of printing media P are placed in a stacked state on the paper cassette. The printing media P placed on the paper cassette are supplied one by one into the case 102 along the sub-scanning axis VD, printed by the printer unit 100, discharged along the sub-scanning axis VD, and placed on the paper discharge tray.

The scanner unit 200 is mounted on the printer unit 100. The scanner unit 200 has a case 201. The case 201 constitutes the outer shell of the scanner unit 200. The scanner unit 200 is of a flat bed type and has a document table formed of a transparent plate-like member such as glass and an image sensor. The scanner unit 200 reads an image or the like recorded on a medium such as paper as image data via an image sensor. The electronic apparatus 10 may be provided with an automatic document feeder (not illustrated). The scanner unit 200 sequentially feeds a plurality of stacked documents while reversing them one by one by the automatic document feeder, and reads them by using the image sensor.

1.3 Ink Tank Unit and Ink Tank

The ink tank unit 300 has a function of supplying ink IK to the print head 107 included in the printer unit 100. The ink tank unit 300 includes a case 301, and the case 301 has a lid 302. A plurality of ink tanks 310 are accommodated in the case 301.

Figure 2:
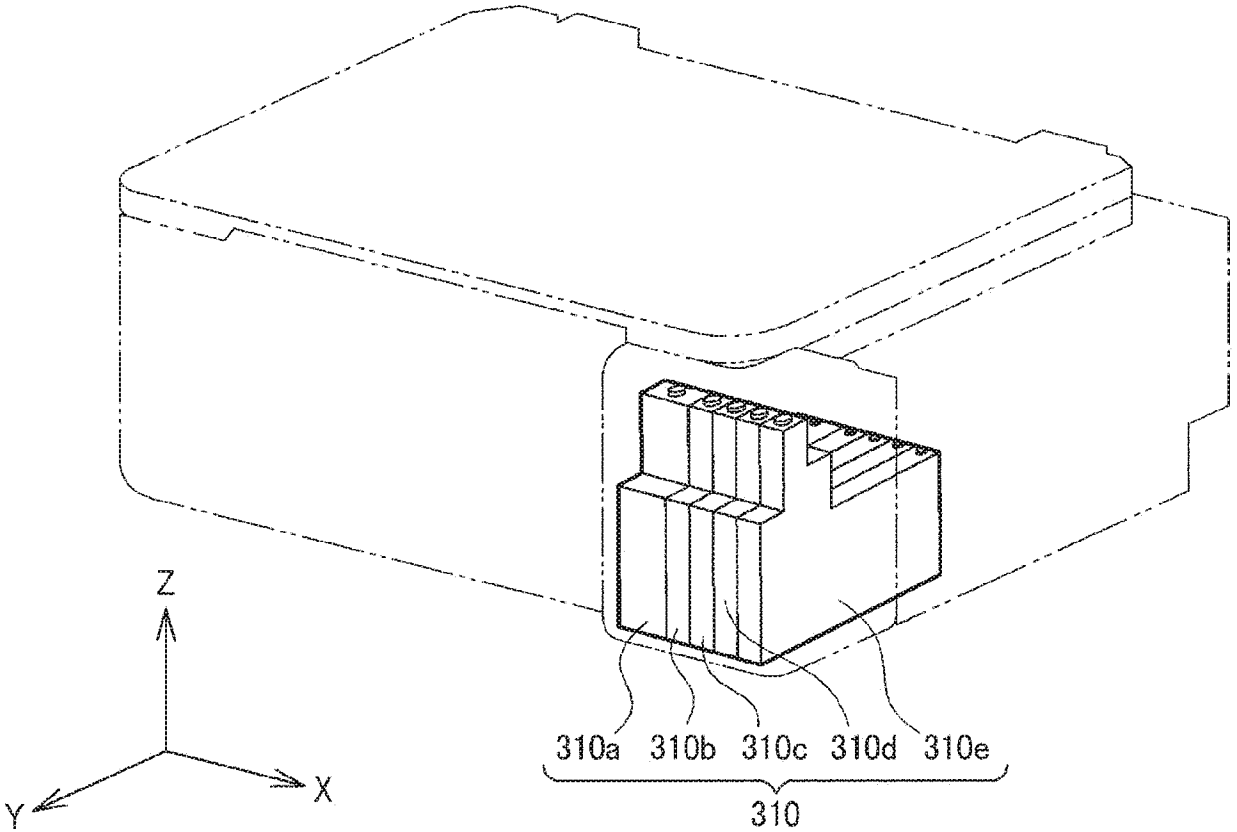
FIG. 2 is a diagram for explaining a disposition of ink tanks in an electronic apparatus.

FIG. 2 is a diagram illustrating a state of the ink tanks 310 being accommodated. A portion indicated bi a solid line in FIG. 2 represents the ink tanks 310. A plurality of inks IK of different kinds are individually accommodated in the plurality of ink tanks 310. That is, different kinds of inks IK are accommodated in the plurality of ink tanks 310 for each ink tank 310.

In the example illustrated in FIG. 2, the ink tank unit 300 accommodates five ink tanks 310*a*, 310*b*, 310*c*, 310*d*, and 310*e*. In the present embodiment, five kinds of inks are adopted, as the kinds of inks: two kinds of black inks and color inks of yellow, magenta, and cyan. Two kinds of black inks are pigment ink and dye ink. Ink IKa which is black pigment ink is accommodated in the ink tank 310*a*. The respective color inks IKb, IKc, and IKd of yellow, magenta, and cyan are accommodated in the ink tanks 310*b*, 310*c*, and 310*d*. Ink IKe which is a black dye ink is accommodated in the ink tank 310*e*.

The ink tanks 310*a*, 310*b*, 310*c*, 310*d*, and 310*e* are disposed side by side in this order along the +X direction, and fixed in the case 301. Hereinafter, when the five ink tanks 310*a*, 310*b*, 310*c*, 310*d*, and 310*e* and the five kinds of inks IKa, IKb, IKc, IKd, and IKe are not distinguished, they are simply expressed as the ink tank 310 and the ink IK.

In the present embodiment, ink IK is configured to be able to be filled into the ink tank 310 from the outside of the electronic apparatus 10 for each of the five ink tanks 310. Specifically, the user of the electronic apparatus 10 fills to replenish ink IK accommodated in another container into the ink tank 310.

In the present embodiment, the capacity of the ink tank 310*a* is greater than the capacities of the ink tanks 310*b*, 310*c*, 310*d*, and 310*e*. The capacities of the ink tanks 310*b*, 310*c*, 310*d*, and 310*e* are the same as each other. In the printer unit 100, it is assumed that the black pigment ink IKa is consumed more compared to the color inks IKb, IKc, and IKd and the black dye ink IKe. The ink tank 310*a* accommodating the black pigment ink IKa is disposed at a position close to the center of the electronic apparatus 10 on the X-axis. In this way, for example, when the case 301 has a window portion for causing the user to visually recognize the side surface of the ink tank 310, it becomes easier to check the remaining amount of ink frequently used. However, the disposition order of the five ink tanks 310*a*, 310*b*, 310*c*, 310*d*, and 310*e* is not particularly limited. When any of the other inks IKb, IKc, IKd, and IKe is consumed more than the black pigment ink IKa, the ink IK may be accommodated in the ink tank 310*a* having a large capacity.

Figure 3:
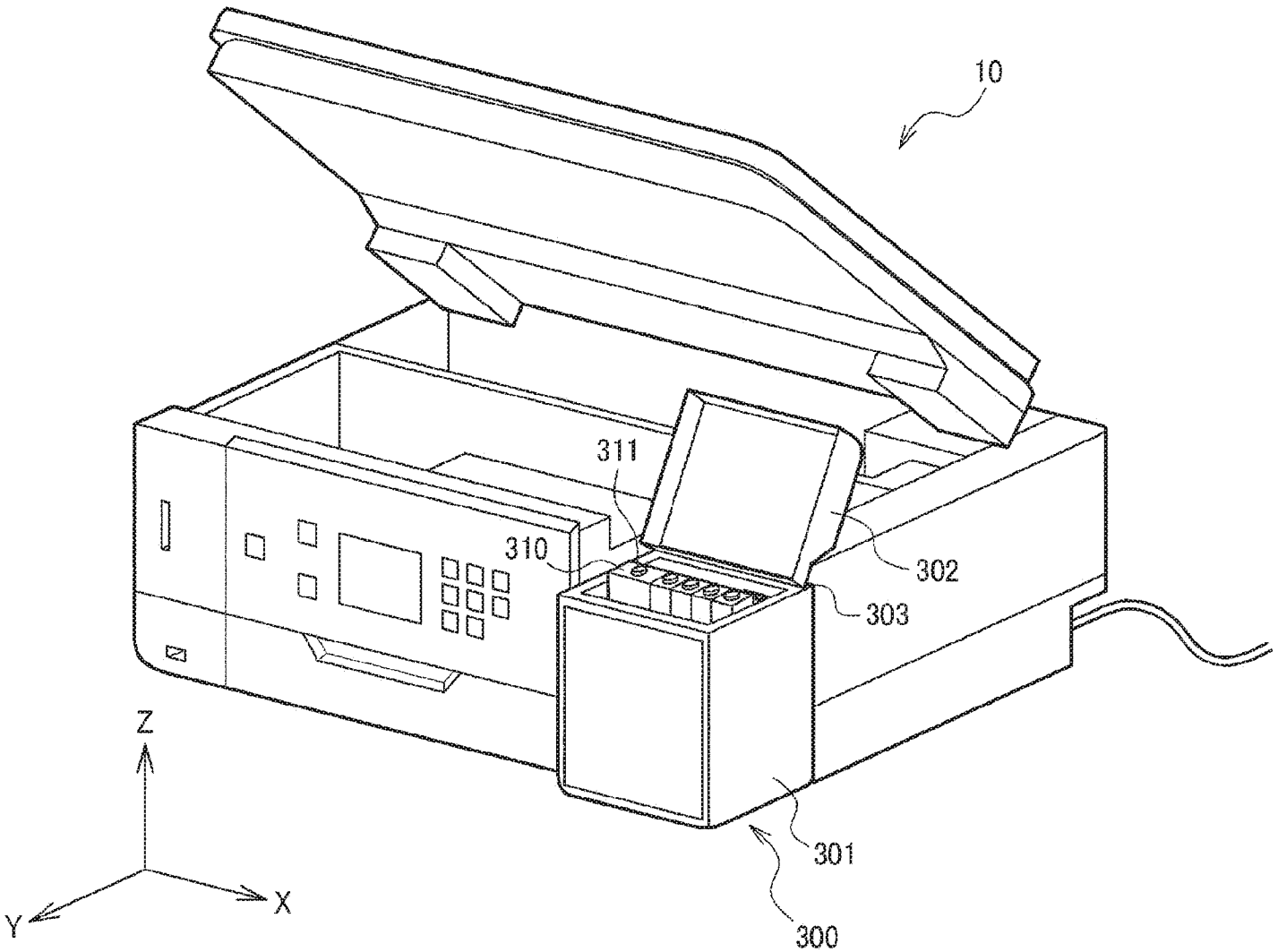
FIG. 3 is a perspective diagram of an electronic apparatus in a state where a lid of an ink tank unit is opened.

FIG. 3 is a perspective diagram of the electronic apparatus 10 in a state where the lid 302 of the ink tank unit 300 is opened. The lid 302 is rotatable with respect to the case 301 via a hinge portion 303. When the lid 302 is opened, five ink tanks 310 are exposed. More specifically, five caps corresponding to each ink tank 310 are exposed by opening the lid 302, and a portion of the ink tank 310 in the +Z direction is exposed by opening the caps. A portion of the ink tank 310 in the +Z direction is an area including an ink filling port 311 of the ink tank 310. When the ink IK is filled into the ink tank 310, the user accesses the ink tank 310 by rotating the lid 302 and opening it upward.

Figure 4:
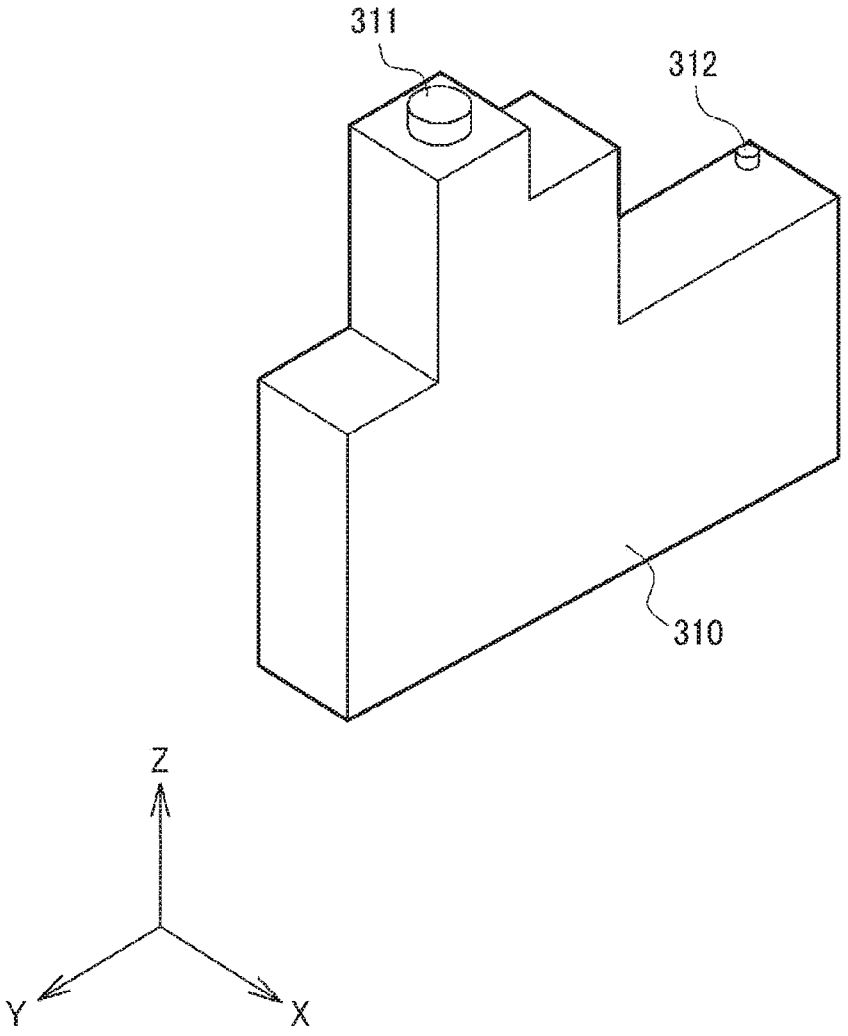
FIG. 4 is a perspective diagram illustrating a configuration of an ink tank.

FIG. 4 is a diagram illustrating the configuration of the ink tank 310. Each axis of X, Y, and Z in FIG. 4 illustrates an axis in a state where the electronic apparatus 10 is used in a normal posture and the ink tank 310 is appropriately fixed to the case 301. Specifically, the X-axis and the Y-axis are axes along the horizontal direction, and the Z-axis is an axis along a vertical direction. For each axis of X, Y, and Z, unless otherwise specified, the same shall apply in the following drawings. The ink tank 310 is a three-dimensional body in which the ±X direction is a short side direction and the ±Y direction is a longitudinal direction. Hereinafter, of the surfaces of the ink tank 310, a surface in the +Z direction is referred to as an upper surface, a surface in the −Z direction is referred to as a bottom surface, and surfaces in the ±X direction and ±Y direction are referred to as side surfaces. The ink tank 310 is formed of a synthetic resin such as nylon or polypropylene, for example.

When the ink tank unit 300 includes a plurality of ink tanks 310 as described above, each of the plurality of ink tanks 310 may be configured separately or may be configured integrally. When the ink tank 310 is integrally configured, the ink tank 310 may be integrally formed, or a plurality of ink tanks 310 formed separately may be integrally bundled or connected together.

The ink tank 310 includes a filling port 311 into which ink IK is filled by the user, and a discharging port 312 for discharging the ink IK toward the print head 107. In the present embodiment, the upper surface of the portion on the +Y direction side that is a front side of the ink tank 310 is higher than the upper surface of the portion on the −Y direction side that is a rear side. The filling port 311 for filling ink IK from the outside is provided on the upper surface of the portion on the front side of the ink tank 310. The filling port 311 is exposed by opening the lid 302 and the cap as described above with reference to FIG. 3. The ink IK of each color can be replenished to the ink tank 310 by filling the ink IK from the filling port 311 by the user. The ink IK for the user to replenish the ink tank 310 is accommodated and provided in a separate replenishing container. The discharging port 312 for supplying ink to the print head 107 is provided on the upper surface of the portion on the rear side of the ink tank 310. Since the filling port 311 is provided on the side close to the front of the electronic apparatus 10, filling of the ink IK can be facilitated.

1.4 Other Configurations of Electronic Apparatus

Figure 5:
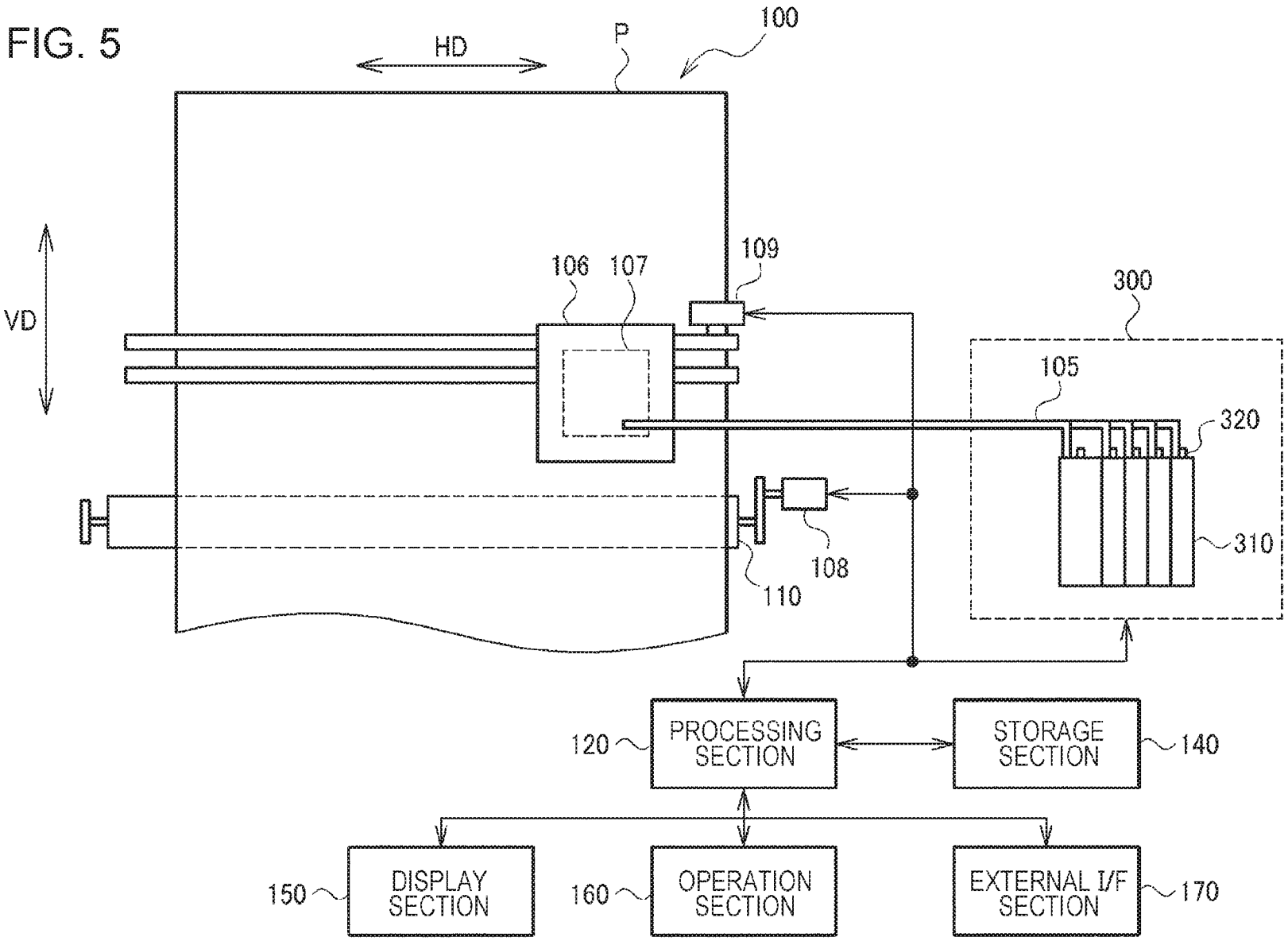
FIG. 5 is a diagram illustrating a configuration example of a printer unit and an ink tank unit.

FIG. 5 is a schematic configuration diagram of the electronic apparatus 10 according to the present embodiment. As illustrated in FIG. 5, the printer unit 100 according to the present embodiment includes a carriage 106, a paper feed motor 108, a carriage motor 109, a paper feed roller 110, a processing section 120, a storage section 140, a display section 150, an operation section 160, and an external I/F section 170. In FIG. 5, the specific configuration of the scanner unit 200 is omitted. FIG. 5 is a diagram exemplifying a coupling relationship between each part of the printer unit 100 and the ink tank unit 300, and does not limit the physical structure or the positional relationship of each part. For example, in the disposition of members such as the ink tank 310, the carriage 106, and a tube 105 in the electronic apparatus 10, various embodiments can be considered.

A print head 107 is mounted on the carriage 106. The print head 107 has a plurality of nozzles for ejecting ink IK in the −Z direction on the bottom surface side of the carriage 106. The tube 105 is provided between the print head 107 and each ink tank 310. Each ink IK in the ink tank 310 is sent to the print head 107 via the tube 105. The print head 107 ejects each ink IK sent from the ink tanks 310 to the printing medium P from the plurality of nozzles as ink droplets.

The carriage 106 is driven by the carriage motor 109 to reciprocate along the main scanning axis HD on the printing medium P. The paper feed motor 108 rotationally drives the paper feed roller 110 to transport the printing medium P along the sub-scanning axis VD. The ejection control of the print head 107 is performed by the processing section 120 via a cable.

In the printer unit 100, printing is performed on the printing medium P by the carriage 106 ejecting the ink IK from the plurality of nozzles of the print head 107 to the printing medium P transported to the sub-scanning axis VD while moving along the main scanning axis HD, based on the control of the processing section 120.

One end of the carriage 106 on the main scanning axis HD in a moving area is a home position area where the carriage 106 stands by. In the home position area, for example, a cap or the like (not illustrated) for performing maintenance such as cleaning the nozzle of the print head 107 is disposed. Also, a waste ink box for receiving waste ink when flushing or cleaning of the print head 107 is performed is disposed in the moving area of the carriage 106. The flushing means that ink IK is ejected from each nozzle of the print head 107 regardless of printing during printing of the printing medium P. The cleaning means cleaning the inside of the print head by sucking the print head by a pump or the like provided in the waste ink box, without driving the print head 107.

Here, an off-carriage type printer in which the ink tank 310 is provided at a location different from the carriage 106 is assumed. However, the printer unit 100 may be an on-carriage type printer in which the ink tank 310 is mounted on the carriage 106 and moved along the main scanning axis HD together with the print head 107. The on-carriage type printer will be described later with reference to FIG. 40.

The operation section 160 and the display section 150 as a user interface section are coupled to the processing section 120. The display section 150 is for displaying various display screens and can be realized by, for example, a liquid crystal display or an organic EL display. The operation section 160 is for the user to perform various operations and can be realized by various buttons, GUI, or the like. For example, as illustrated in FIG. 1, the electronic apparatus 10 includes the operation panel 101, and the operation panel 101 includes a display section 150 and a button or the like as the operation section 160. The display section 150 and the operation section 160 may be integrally configured by a touch panel. When the user operates the operation panel 101, the processing section 120 operates the printer unit 100 and the scanner unit 200.

For example, in FIG. 1, the user operates the operation panel 101 to start operation of the electronic apparatus 10 after setting a document on a document table of the scanner unit 200. Then, the document is read by the scanner unit 200. Subsequently, based on the image data of the read document, the printing medium P is fed from the paper cassette into the printer unit 100, and printing is performed on the printing medium P by the printer unit 100.

An external device can be coupled to the processing section 120 via the external I/F section 170. The external device here is, for example, a personal computer (PC). The processing section 120 receives the image data from the external device via the external I/F section 170, and performs control for printing the image on the printing medium P by the printer unit 100. In addition, the processing section 120 controls the scanner unit 200 to read the document and transmit the image data as a reading result to the external device via the external I/F section 170, or to print the image data as the reading result.

The processing section 120 performs, for example, a drive control, consumption calculation processing, ink amount detection processing, and ink type determination processing. The processing section 120 of the present embodiment is configured by the following hardware. The hardware can include at least one of a circuit for processing a digital signal and a circuit for processing an analog signal. For example, the hardware can be configured by one or more circuit devices mounted on the circuit substrate or one or more circuit elements. The one or more circuit devices are, for example, ICs or the like. The one or more circuit elements are, for example, resistances, capacitors, or the like.

The processing section 120 may be realized by the following processor. The electronic apparatus 10 of the present embodiment includes a memory that stores information, and a processor that operates based on information stored in the memory. The information is, for example, a program and various kinds of data. The processor includes hardware. As the processor, various processors such as a central processing unit (CPU), graphics processing unit (GPU), digital signal processor (DSP), or the like can be used. The memory may be a semiconductor memory such as a static random access memory (SRAM), a dynamic random access memory (DRAM), or the like, and may be a register, or a magnetic storage device such as a hard disk device, or may be an optical storage device such as an optical disk device or the like. For example, the memory stores an instruction that can be read by a computer, and the function of each section of the electronic apparatus 10 is realized as processing by executing the instruction by the processor. The instruction here may be an instruction of an instruction set constituting the program or an instruction for instructing the operation to the hardware circuit of the processor.

The processing section 120 controls the carriage motor 109 to perform drive control for moving the carriage 106. Based on the drive control, the carriage motor 109 drives to move the print head 107 provided on the carriage 106.

The processing section 120 performs the consumption calculation processing of calculating a consumption of ink consumed by ejecting the ink IK from each nozzle of the print head 107. The processing section 120 starts the consumption calculation processing with the state where each ink tank 310 is filled with the ink IK as an initial value. More specifically, when the user replenishes the ink IK to the ink tank 310 and presses a reset button, the processing section 120 initializes a count value of the ink consumption with respect to the ink tank 310. Specifically, the count value of the ink consumption is set to 0 g. The processing section 120 starts the consumption calculation processing with the pressing operation of the reset button as a trigger.

The processing section 120 performs ink amount detection processing of detecting the amount of ink IK accommodated in the ink tank 310, based on the output of a sensor unit 320 provided corresponding to the ink tank 310. The processing section 120 performs ink type determination processing of determining the type of the ink IK accommodated in the ink tank 310, based on the output of the sensor unit 320 provided corresponding to the ink tank 310. Details of the ink amount detection processing and the ink type determination processing are described later.

1.5 Detailed Configuration Example of Sensor Unit

Figure 6:
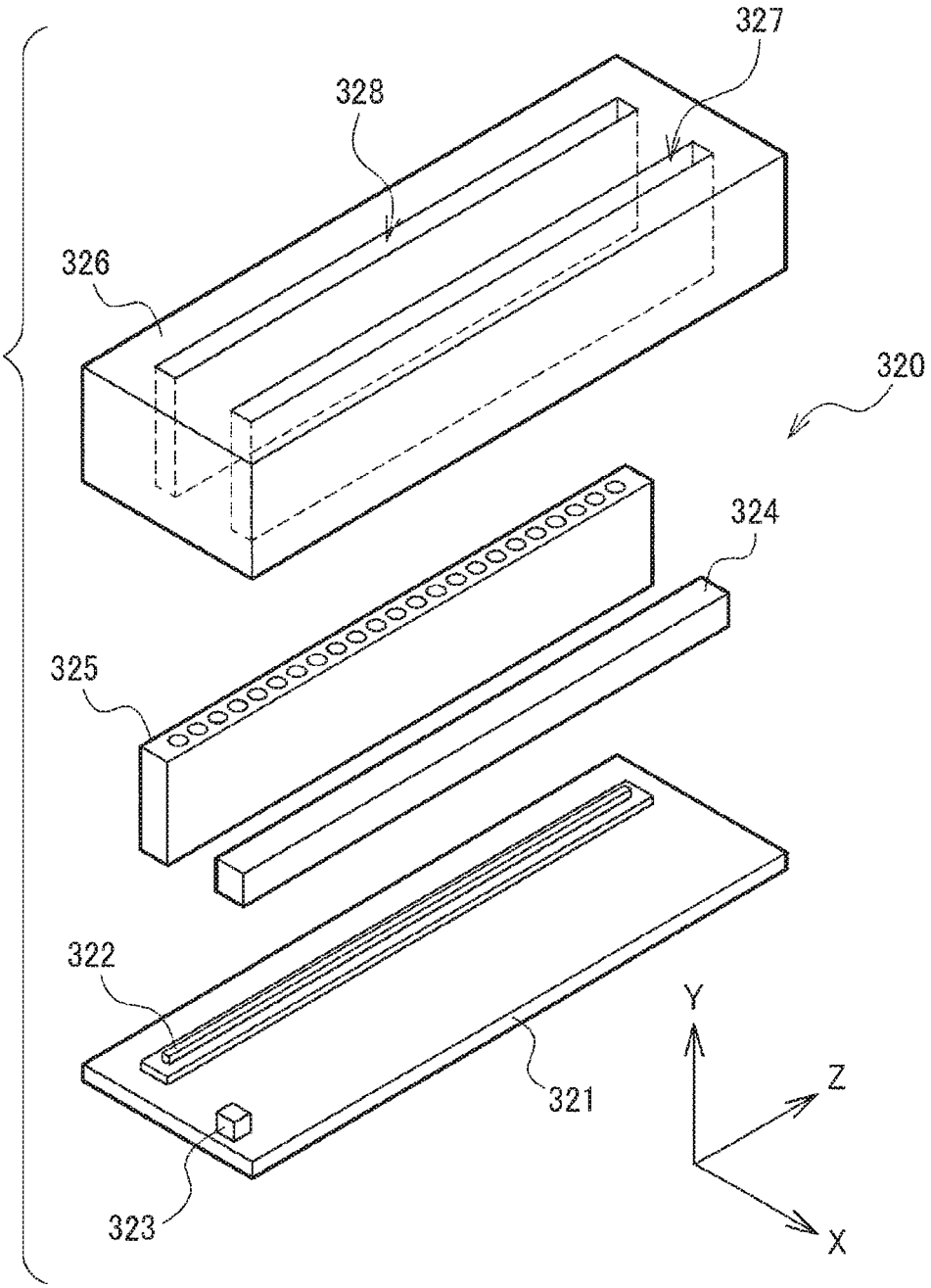
FIG. 6 is an exploded diagram of a sensor unit.

FIG. 6 is an exploded perspective diagram schematically illustrating the configuration of the sensor unit 320. The sensor unit 320 includes a substrate 321, a photoelectric conversion device 322, a light source 323, a light guide 324, a lens array 325, and a case 326.

The light source 323 and the photoelectric conversion device 322 are mounted on the substrate 321. The photoelectric conversion device 322 is a linear image sensor in which, for example, photoelectric conversion elements are disposed in a predetermined direction. The linear image sensor may be a sensor in which photoelectric conversion elements are disposed in one row or a sensor in which photoelectric conversion elements are disposed in two or more rows. The photoelectric conversion element is, for example, a photodiode (PD). A plurality of output signals based on a plurality of photoelectric conversion elements are acquired by using the linear image sensor. Therefore, not only the presence or absence of the ink IK but also the position of the liquid level can be estimated. The liquid level may be referred to as an interface.

The light source 323 has, for example, R, G, and B light emitting diodes (LED: Light emitting diode) and emits light sequentially while switching the R, G, and B light emitting diodes at high speed. Hereinafter, the light emitting diode of R is represented as a red LED 323R, the light emitting diode of G is represented as a green LED 323G, and the light emitting diode of B is represented as a blue LED 323B. The light guide 324 is a rod-like member for guiding light, and the cross-sectional shape may be a square shape, a circular shape, or another shape. The longitudinal direction of the light guide 324 is a direction along the longitudinal direction of the photoelectric conversion device 322. Since light from the light source 323 goes out from the light guide 324, the light guide 324 and the light source 323 may be collectively referred to as a light source when it is not necessary to distinguish the light guide 324 and the light source 323.

The light source 323, the light guide 324, the lens array 325, and the photoelectric conversion device 322 are accommodated between the case 326 and the substrate 321. The case 326 is provided with a first opening portion 327 for a light source and a second opening portion 328 for a photoelectric conversion device. Light emitted from the light source 323 enters the light guide 324, thereby the entire light guide emits light. Light emitted from the light guide 324 is emitted to the outside of the case 326 through the first opening portion 327. Light from the outside is input to the lens array 325 through the second opening portion 328. The lens array 325 guides the input light to the photoelectric conversion device 322. Specifically, the lens array 325 has a Selfoc lens array (Selfoc is a registered trademark) in which many refractive index distribution type lenses are disposed.

Figure 7:
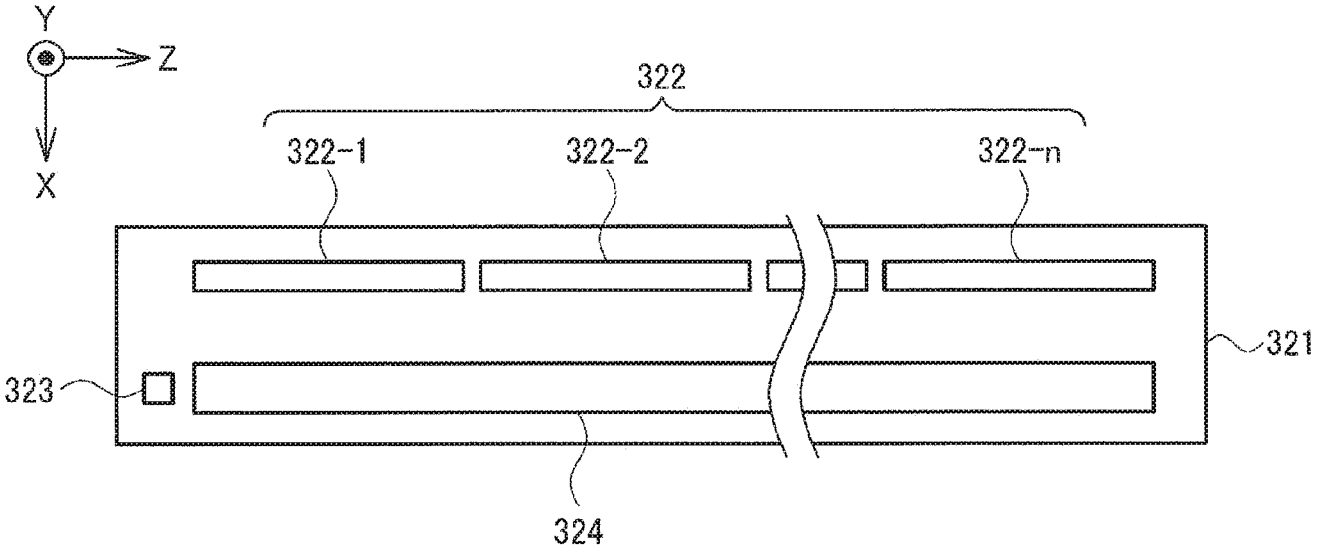
FIG. 7 is a diagram illustrating a positional relationship between a substrate, a photoelectric conversion device, and a light source.

FIG. 7 is a diagram schematically illustrating the disposition of the photoelectric conversion devices 322. As illustrated in FIG. 7, n, n being an integer of 1 or more, photoelectric conversion devices 322 are disposed along a given direction on the substrate 321 side by side. Here, n may be 2 or more as illustrated in FIG. 7. That is, the sensor unit 320 includes a second linear image sensor provided on the longitudinal direction side of the linear image sensor. The linear image sensor is, for example, 322-1 in FIG. 7, and the second linear image sensor is 322-2. Each photoelectric conversion device 322 is a chip having many photoelectric conversion elements disposed side by side as described above. By using a plurality of photoelectric conversion devices 322, a range for detecting incident light is widened, thereby a target range for detecting the ink amount can be widened. However, the number of linear image sensors, that is, the setting of the target range for detecting the ink amount can be performed in various ways, and it is not hindered that there is only one linear image sensor.

Figure 8:
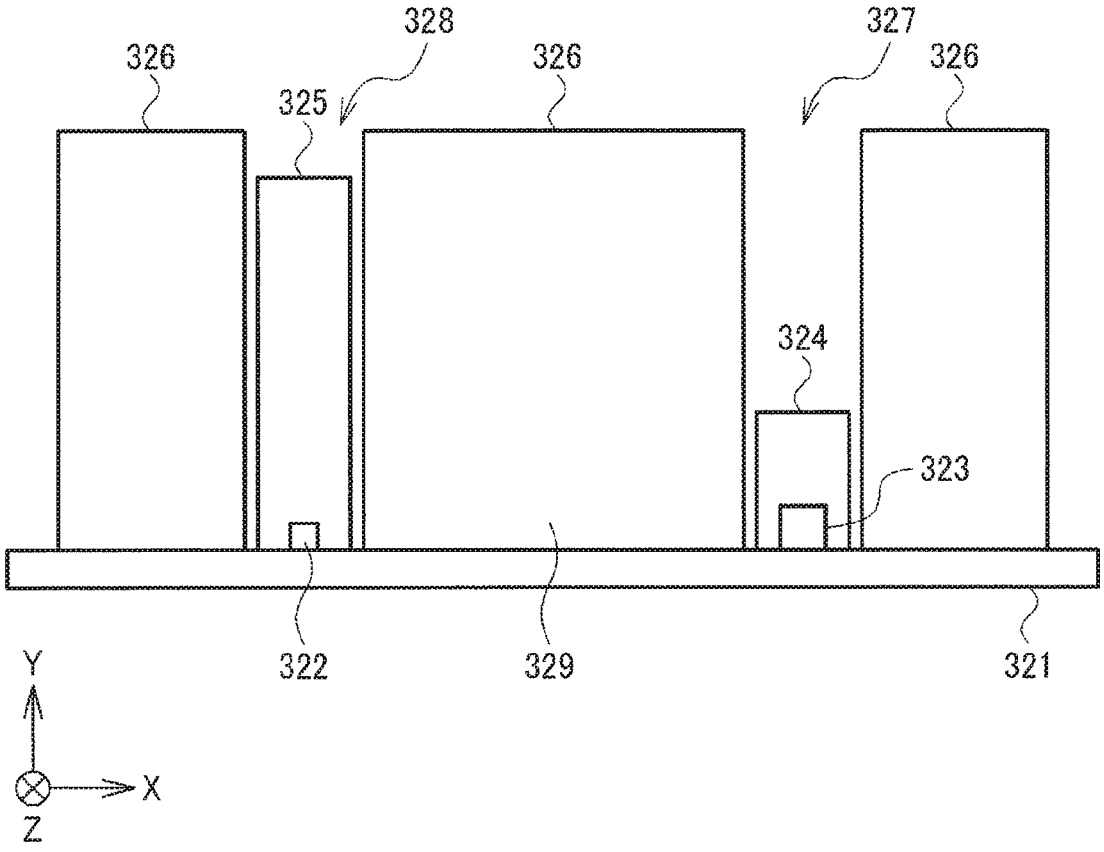
FIG. 8 is a cross-sectional diagram of a sensor unit.

FIG. 8 is a cross-sectional diagram schematically illustrating the disposition of the sensor units 320. As can be seen from FIGS. 6 and 7, although the positions of the photoelectric conversion device 322 and the light source 323 do not overlap in the Z-axis, for convenience of describing the positional relationship with other members, the light source 323 is illustrated in FIG. 8. As illustrated in FIG. 8, the sensor unit 320 includes a light shielding wall 329 provided between the light source 323 and the photoelectric conversion device 322. The light shielding wall 329 is, for example, a portion of the case 326 and formed by extending a beam-like member between the first opening portion 327 and the second opening portion 328 to the substrate 321. The light shielding wall 329 shields direct light from the light source 323 toward the photoelectric conversion device 322. Since incidence of the direct light can be suppressed by providing the light shielding wall 329, detection accuracy of the ink amount can be enhanced. It is preferable that the light shielding wall 329 is capable of shielding direct light from the light source 323 toward the photoelectric conversion device 322, and the concrete shape is not limited to that in FIG. 8. A member separate from the case 326 is preferably used as the light shielding wall 329.

Figure 9:
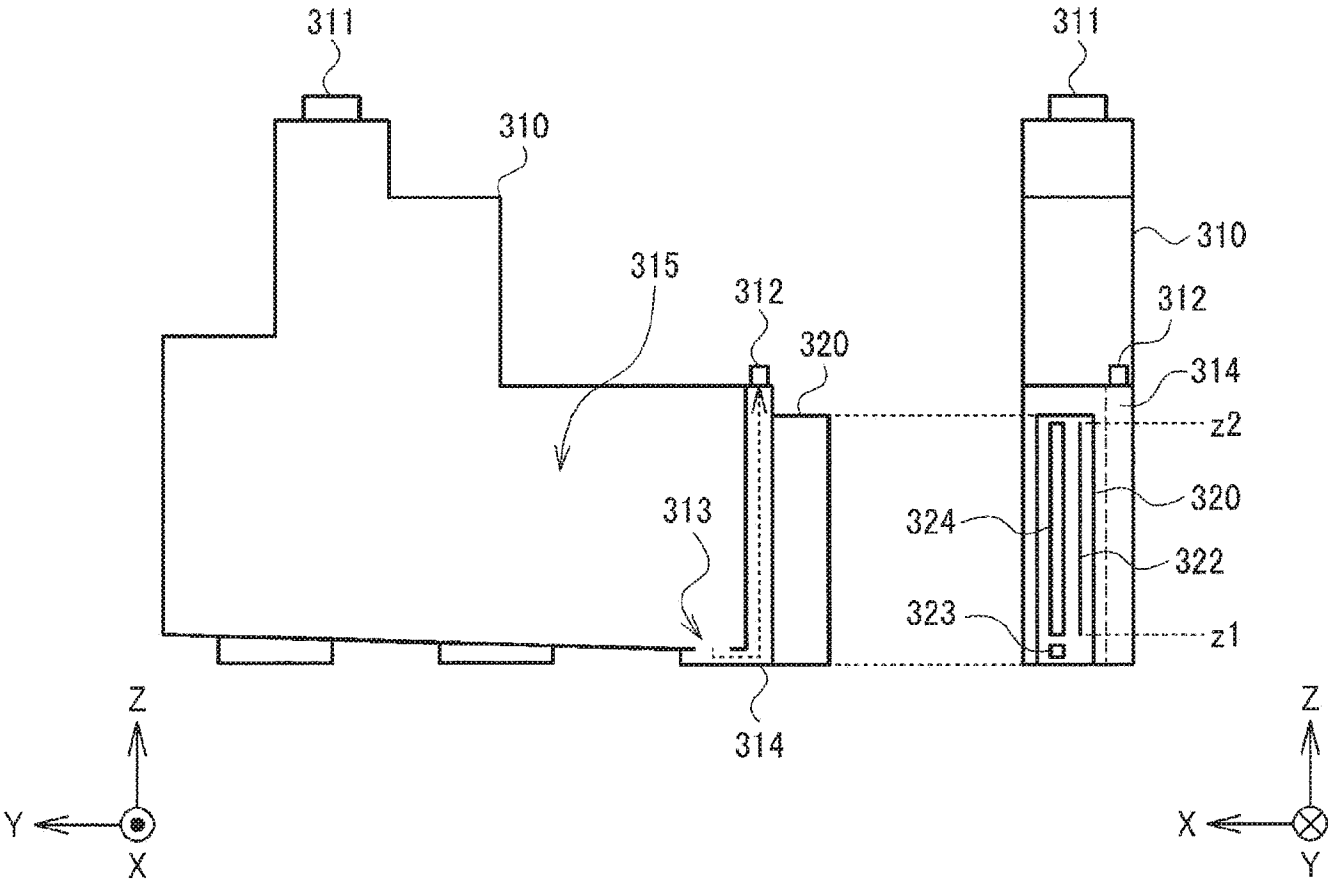
FIG. 9 is a diagram for explaining a positional relationship between an ink tank, a light source, and a photoelectric conversion device.

FIG. 9 is a diagram for explaining the positional relationship between the ink tank 310 and the sensor unit 320. As illustrated in FIG. 9, the sensor unit 320 is fixed to any wall surface of the ink tank 310 in such a posture that the longitudinal direction of the photoelectric conversion device 322 is the ±Z direction. That is, the photoelectric conversion device 322 as the linear image sensor is provided so that the longitudinal direction goes along the vertical direction. Here, the vertical direction represents the gravity direction and the reverse direction when the electronic apparatus 10 is used in a proper posture.

In the example illustrated in FIG. 9, the sensor unit 320 is fixed to the side surface of the ink tank 310 in the −Y direction. That is, the substrate 321 provided with the photoelectric conversion device 322 is closer to the discharging port 312 than the filling port 311 of the ink tank 310. Whether printing in the printer unit 100 can be executed depends on whether the ink IK is supplied to the print head 107. Therefore, by providing the sensor unit 320 on the discharging port 312 side, the ink amount detection processing can be performed for a position where the ink amount is particularly important in the ink tank 310.

As illustrated in FIG. 9, the ink tank 310 may include a main container 315, a second discharging port 313, and an ink flow path 314. The main container 315 is a portion of the ink tank 310 that is used for accommodating the ink IK. The second discharging port 313 is, for example, an opening provided at a position in the most −Z direction in the main container 315. However, various modifications can be performed for the position and shape of the second discharging port 313. For example, when suction by a suction pump or supply of pressurized air by a pressure pump is performed on the ink tank 310, ink IK accumulated in the main container 315 of the ink tank 310 is discharged from the second discharging port 313. The ink IK discharged from the second discharging port 313 is guided in the +Z direction by the ink flow path 314, and discharged from the discharging port 312 to the outside of the ink tank 310. In this case, as illustrated in FIG. 9, detection processing of the proper ink amount can be performed by setting the positional relationship in which the ink flow path 314 and the photoelectric conversion device 322 do not face each other. For example, the ink flow path 314 is provided at the end of the ink tank 310 in the −X direction, and the sensor unit 320 is provided in the +X direction from the ink flow path 314. In this way, the decrease in accuracy of the ink amount detection processing can be suppressed by the ink in the ink flow path 314.

As described above, the "discharging port" in the present embodiment includes the discharging port 312 for discharging ink IK to the outside of the ink tank 310, and the second discharging port 313 for discharging ink IK from the main container 315 to the discharging port 312. Among them, the second discharging port 313 is more strongly related to whether ink IK is supplied to the print head 107. As illustrated in FIG. 9, the substrate 321 provided with the photoelectric conversion device 322 is closer to the second discharging port 313 than the filling port 311 of the ink tank 310. Thus, the ink amount detection processing can be performed for a position where the ink amount is particularly important. However, as the distance between the discharging port 312 and the second discharging port 313 becomes longer, it is necessary to lengthen the ink flow path 314, and the placement of the ink flow path 314 may become complicated. That is, it is desirable that the discharging port 312 and the second discharging port 313 are provided at positions close to each other. Therefore, as described above, by providing the substrate 321 at a position closer to the discharging port 312 than to the filling port 311, the ink amount detection processing can be performed for a position where the ink amount becomes important. The same applies to the following description. In the expression that a given member is "closer to the filling port 311 than to the discharging port 312 of the ink tank 310" or similar expressions, the discharging port 312 can be appropriately replaced to the second discharging port 313.

The sensor unit 320 may be bonded to the ink tank 310, for example. Alternatively, the sensor unit 320 may be mounted on the ink tank 310 by providing fixing members respectively to the sensor unit 320 and the ink tank 310 and fixing the members by fitting or the like. Various modifications can be performed in the shape, material, or the like of the fixing member. Further, as will be described later with reference to FIGS. 38 to 40, the sensor unit 320 may be configured to be movable relative to the ink tank 310.

The photoelectric conversion device 322 is provided in the range of z1 to z2, for example, in the Z-axis. The z1 and z2 are coordinate values in the Z-axis, and z1<z2. When the ink tank 310 is irradiated with light from the light source 323, absorption and scattering of light occur by the ink IK filled in the ink tank 310. Therefore, the portion of the ink tank 310 not filled with the ink IK becomes relatively bright, and the portion filled with the ink IK becomes relatively dark. For example, when the liquid level of the ink IK exists at the position having a coordinate value in the Z-axis of z0, in the ink tank 310, the area having a coordinate value in the Z-axis of z0 or smaller becomes dark and the area having a coordinate value in the Z-axis of greater than z0 becomes bright.

As illustrated in FIG. 9, the position of the liquid level of the ink IK can be appropriately detected by providing the photoelectric conversion device 322 so that the longitudinal direction is the vertical direction. Specifically, when z1<z0<z2, the photoelectric conversion elements disposed at a position corresponding to the range of z1 to z0 out of the photoelectric conversion device 322 has a relatively small amount of light to be input. Therefore, the output value becomes relatively small. The photoelectric conversion elements disposed at a position corresponding to the range of z0 to z2 has a relatively large amount of light to be input, so that the output value becomes relatively large. That is, z0 which is the liquid level of the ink IK can be estimated based on the output of the photoelectric conversion device 322. That is, it is possible to detect not only binary information relating to whether the ink amount is equal to or more than a predetermined amount but also a specific position of the liquid level. When the position of the liquid level is known, the ink amount can be determined in units of milliliters or the like based on the shape of the ink tank 310. When the output value of the entire range of z1 to z2 is large, the liquid level can be determined to be lower than z1, and when the output value of the entire range of z1 to z2 is small, the liquid level can be determined to be higher than z2. The range where the ink amount can be detected is a range of z1 to z2 which is a range where the photoelectric conversion device 322 is provided. Therefore, the detection range can be easily adjusted by changing the number of photoelectric conversion devices 322 and the length per chip. The resolution of ink amount detection is determined based on the pixel pitch of the photoelectric conversion device 322 and the pitch of the lens array 325. In the example described later with reference to FIG. 15, the ink amount detection is performed at the resolution corresponding to k times the pixel pitch. The specific resolution can be variously modified. However, according to the method of the present embodiment, it is possible to detect the ink amount with higher accuracy than the related art.

In consideration of the accurate detection of the ink amount, it is preferable that light emitted to the ink tank 310 be made to be approximately the same degree regardless of the position in the vertical direction. As described above, since the presence or absence of the ink IK appears as a difference in brightness, variation in light amount of the irradiation light leads to reduction in accuracy. Therefore, the sensor unit 320 has a light guide 324 disposed so that the longitudinal direction thereof is the vertical direction. The light guide 324 here is a rod-like light guide as described above. In consideration of uniformly illuminating the light guide 324, in the light source 323, light preferably enters the light guide 324 from the lateral direction, that is, the direction along the longitudinal direction of the light guide 324. Since the incident angle becomes large in this way, total reflection is easily generated.

Figure 10:
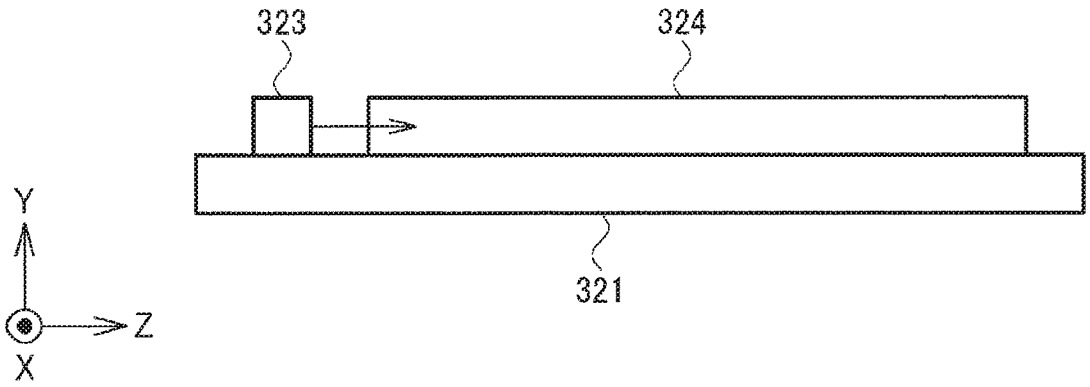
FIG. 10 is a diagram for explaining a positional relationship between a light source and a light guide.
Figure 11:
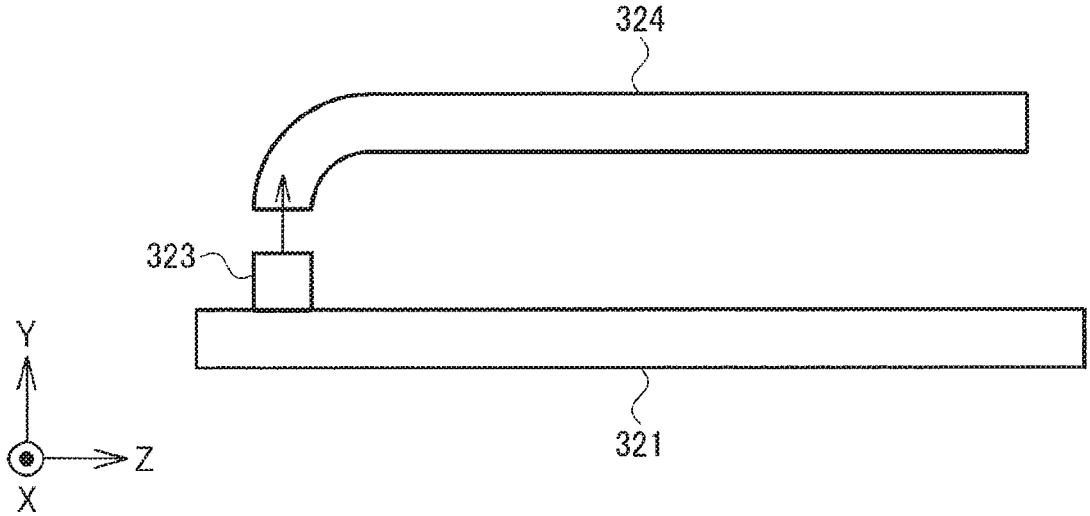
FIG. 11 is a diagram for explaining a positional relationship between a light source and a light guide.
Figure 12:
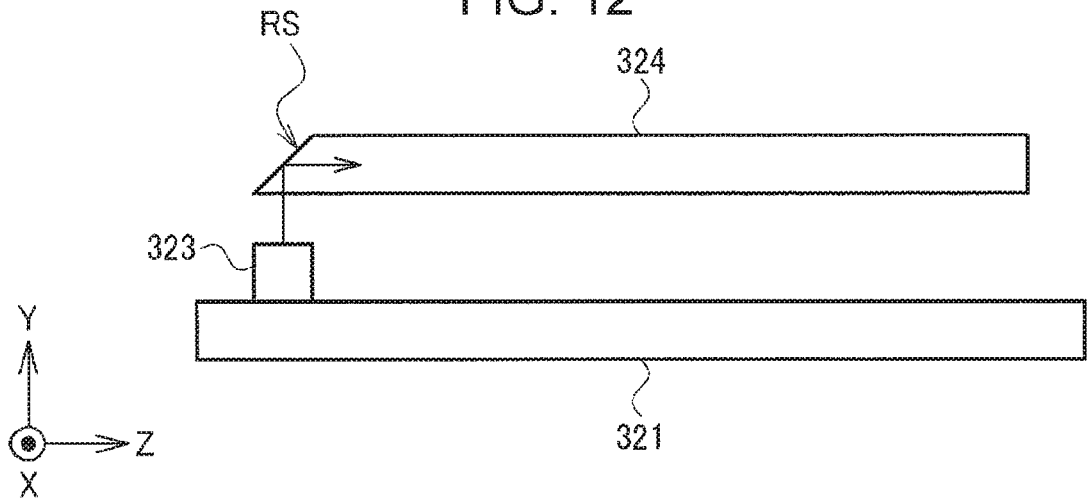
FIG. 12 is a diagram for explaining a positional relationship between a light source and a light guide.

FIGS. 10 to 12 are diagrams for explaining the positional relationship between the light source 323 and the light guide 324. For example, as illustrated in FIG. 10, the light source 323 and the light guide 324 may be provided so as to be aligned in the Z-axis. The light source 323 can guide light in the longitudinal direction of the light guide 324 by emitting light in the +Z direction. Alternatively, as illustrated in FIG. 11, the end of the light guide 324 on the light source side may be bent. In this way, the light source 323 can guide light in the longitudinal direction of the light guide 324 by emitting light in the direction perpendicular to the substrate 321. Alternatively, as illustrated in FIG. 12, a reflective surface RS may be provided at the end of the light guide 324 on the light source side. The light source 323 emits light in a direction perpendicular to the substrate 321. Light from the light source 323 is guided in the longitudinal direction of the light guide 324 by being reflected on the reflective surface RS. The light guide 324 according to the present embodiment can be widely applied to a known configuration such as providing a reflective plate on the −Y direction surface of the light guide 324 and changing the density of the reflective plate according to the position from the light source 323. The light source 323 may be provided in the +Z direction from the light guide 324, or the light sources 323 of the same color may be provided at both ends of the light guide 324, or the configuration of the light source 323 and the light guide 324 can be variously modified.

It is desirable that at least a portion of the inner wall of the ink tank 310 that faces the photoelectric conversion device 322 is higher in ink repellency than the outer wall of the ink tank 310. Of course, the entire inner wall of the ink tank 310 may be processed to enhance the ink repellency in comparison with the outer wall of the ink tank 310. The portion facing the photoelectric conversion device 322 may be the entire inner wall in the −Y direction of the ink tank 310 or a portion of the inner wall. Specifically, in the inner walls of the ink tank 310 in the −Y direction, the portion of the inner wall is an area including a portion where the position on the XZ plane overlaps the photoelectric conversion device 322. When an ink droplet adheres to the inner wall of the ink tank 310, the portion of the ink droplet becomes darker than a portion where no ink exists. Therefore, there is a possibility that the ink amount detection accuracy may be lowered due to the ink droplet. By enhancing the ink repellency of the inner wall of the ink tank 310, the adhesion of the ink droplet can be suppressed.

1.6 Detailed Configuration Example of Sensor Unit and Processing Section

Figure 13:
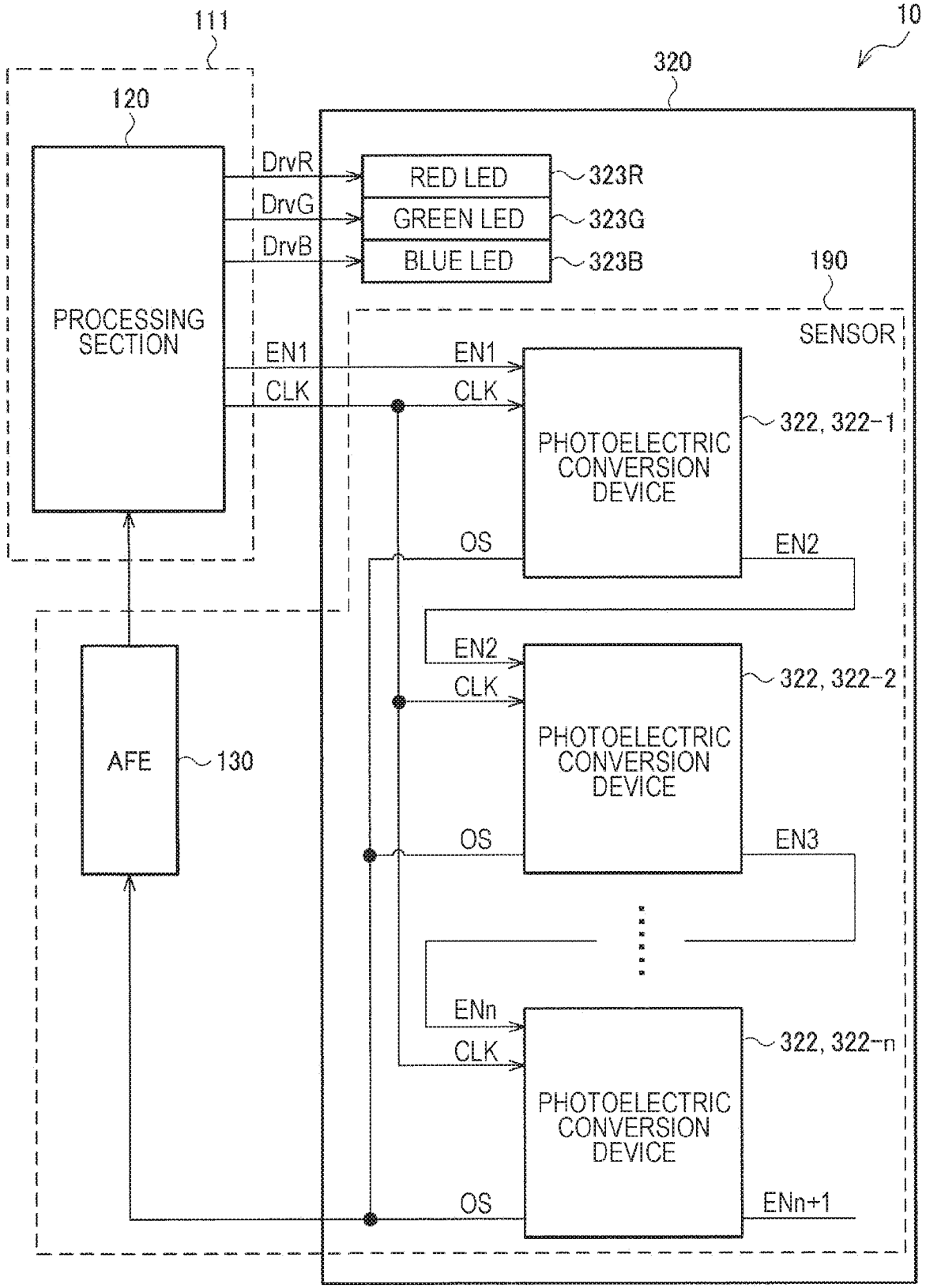
FIG. 13 is a diagram illustrating a configuration example of a sensor unit and a processing section.

FIG. 13 is a functional block diagram relating to the sensor unit 320. The electronic apparatus 10 includes a processing section 120 and an analog front end (AFE) circuit 130. In the present embodiment, the photoelectric conversion device 322 and the AFE circuit 130 are represented as a sensor 190. The processing section 120 is provided on the second substrate 111. The processing section 120 corresponds to the processing section 120 illustrated in FIG. 5 and outputs a control signal for controlling the photoelectric conversion device 322. The control signal includes a clock signal CLK and a chip enable signal EN1 described later. The AFE circuit 130 is a circuit having at least a function of A/D converting an analog signal from the photoelectric conversion device 322. The second substrate 111 is, for example, a main substrate of the electronic apparatus 10, and the substrate 321 is a sub-substrate for a sensor unit.

In FIG. 13, the sensor unit 320 includes a red LED 323R, a green LED 323G, a blue LED 323B, and n photoelectric conversion devices 322. As described above, n being an integer of 1 or more. The red LED 323R, the green LED 323G, and the blue LED 323B are provided in the light source 323, and a plurality of photoelectric conversion devices 322 are disposed side by side on a substrate 321. A plurality of red LEDs 323R, green LEDs 323G, and blue LEDs 323B may exist, respectively.

The AFE circuit 130 is realized by, for example, an integrated circuit (IC). The AFE circuit 130 includes a non-volatile memory (not illustrated). The non-volatile memory here is, for example, an SRAM. Note that, the AFE circuit 130 may be provided on the substrate 321 or may be provided on a substrate different from the substrate 321.

The processing section 120 controls the operation of the sensor unit 320. First, the processing section 120 controls operations of the red LED 323R, the green LED 323G, and the blue LED 323B. Specifically, the processing section 120 supplies a drive signal DrvR to the red LED 323R at a fixed period T for a fixed exposure time Δt and causes the red LED 323R to emit light. Similarly, the processing section 120 supplies the green LED 323G with a drive signal DrvG for the exposure time Δt at the period T to cause the green LED 323G to emit light, and supplies the blue LED 323B with a drive signal DrvB for the exposure time Δt at the period T to cause the blue LED 323B to emit light. The processing section 120 causes the red LED 323R, the green LED 323G, and the blue LED 323B to emit light exclusively one by one in order during the period T.

The processing section 120 controls operations of n photoelectric conversion devices 323 (322-1 to **322-*n*). Specifically, the processing section 120 supplies the clock signals CLK in common to the n photoelectric conversion devices 322. The clock signals CLK are operation clock signals of the n photoelectric conversion devices 322, and each of the n photoelectric conversion devices 322** operates based on the clock signal CLK.

Each photoelectric conversion device **322-*j*** (j=1 to n) generates and outputs an output signal OS based on light received by each photoelectric conversion element in synchronization with the clock signal CLK, when receiving a chip enable signal ENj after each photoelectric conversion element receives light.

The processing section 120 causes the red LED 323R, the green LED 323G, or the blue LED 323B to emit light, generates a chip enable signal EN1 that is active only until the photoelectric conversion device 322-1 finishes outputting the output signal OS, and supplies it to the photoelectric conversion device 322-1.

The photoelectric conversion device **322-*j* generates a chip enable signal ENj+1 before the output of the output signal OS is finished. The chip enable signals EN2 to ENn are supplied to photoelectric conversion devices 322-2 to 322-*n***, respectively.

Thus, after the red LED 323R, the green LED 323G, or the blue LED 323B emits light, the n photoelectric conversion devices 322 sequentially output the output signals OS. Then, the sensor unit 320 outputs the output signal OS sequentially output by the n photoelectric conversion devices 322 from a terminal (not illustrated). The output signal OS is transferred to the AFE circuit 130.

The AFE circuit 130 sequentially receives the output signals OS output from the n photoelectric conversion devices 322 in order, performs amplification processing and A/D conversion processing with respect to each output signal OS to convert into digital data including a digital value corresponding to the amount of light received by each photoelectric conversion element, and sequentially transmits each digital data to the processing section 120. The processing section 120 receives each digital data sequentially transmitted from the AFE circuit 130, and performs ink amount detection processing and ink type determination processing described later.

Figure 14:
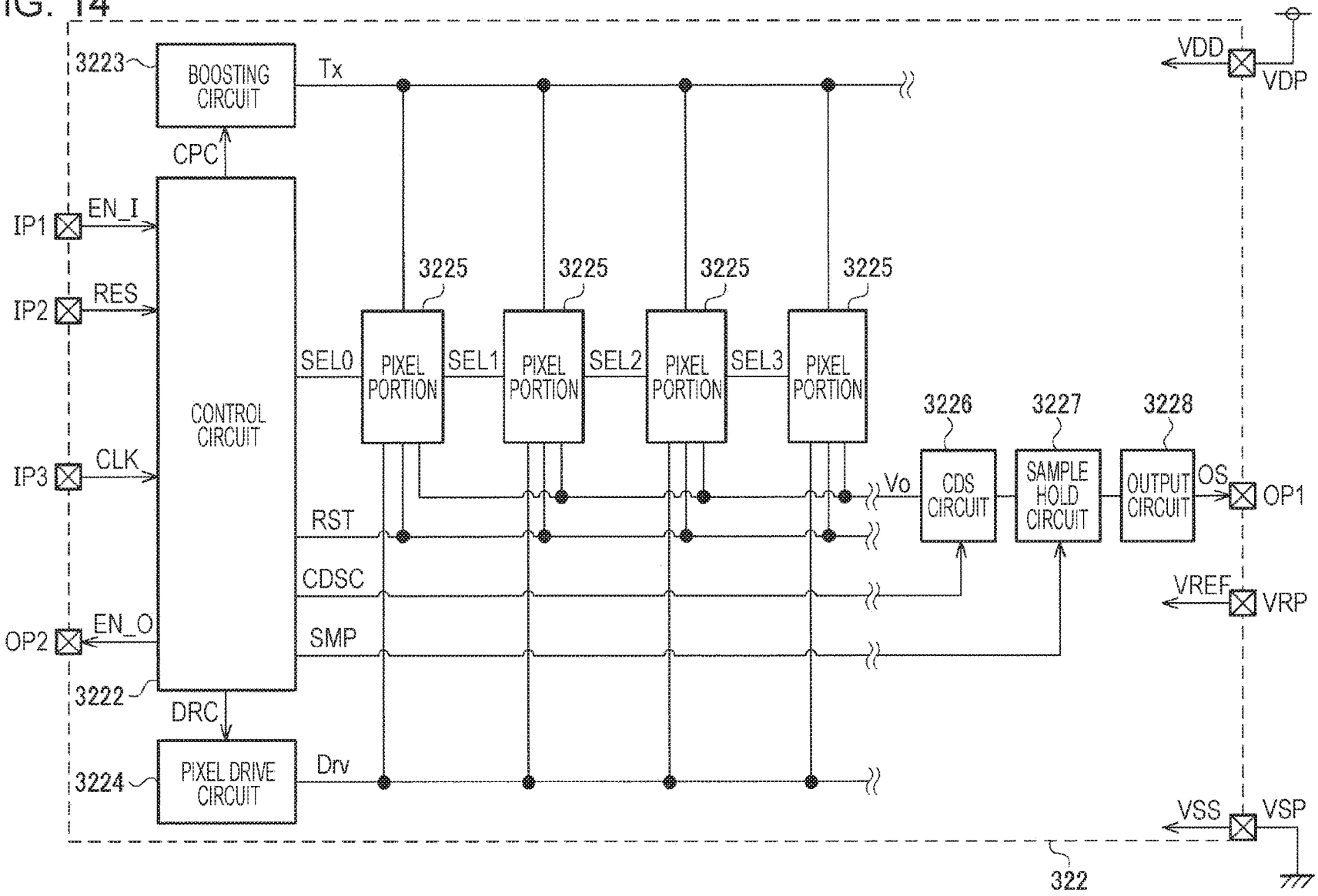
FIG. 14 is a diagram illustrating a configuration example of a photoelectric conversion device.

FIG. 14 is a functional block diagram of the photoelectric conversion device 322. The photoelectric conversion device 322 is provided with a control circuit 3222, a boosting circuit 3223, a pixel drive circuit 3224, p pixel portions 3225, a correlated double sampling (CDS) circuit 3226, a sample hold circuit 3227, and an output circuit 3228. Note that, the configuration of the photoelectric conversion device 322 is not limited to that in FIG. 14, and modifications such as omitting a part of the configuration are possible. For example, the CDS circuit 3226, the sample hold circuit 3227, and the output circuit 3228 may be omitted, and the AFE circuit 130 may perform corresponding processing such as noise reduction processing and amplification processing.

The photoelectric conversion device 322 is supplied with a power supply voltage VDD and a power supply voltage VSS from the two power supply terminals VDP and VSP, respectively. The photoelectric conversion device 322 operates based on a chip enable signal EN_I, a clock signal CLK, and a reference voltage VREF supplied from a reference voltage supply terminal VRP. The power supply voltage VDD corresponds to a high potential side power supply, and is 3.3 V, for example. The VSS corresponds to a low potential side power supply, and is 0 V, for example. The chip enable signal EN_I is any one of chip enable signals EN1 to ENn in FIG. 13.

The chip enable signal EN_I and the clock signal CLK are input to the control circuit 3222. The control circuit 3222 controls operations of the boosting circuit 3223, the pixel drive circuit 3224, the p pixel portions 3225, the CDS circuit 3226, and the sample hold circuit 3227 based on the chip enable signal EN_I and the clock signal CLK. Specifically, the control circuit 3222 generates a control signal CPC that controls the boosting circuit 3223, a control signal DRC that controls the pixel drive circuit 3224, a control signal CDSC that controls the CDS circuit 3226, a sampling signal SMP that controls the sample hold circuit 3227, a pixel selection signal SEL0 that controls the pixel portion 3225, a reset signal RST, and a chip enable signal EN_O.

The boosting circuit 3223 boosts the power supply voltage VDD based on the control signal CPC from the control circuit 3222, and generates a transfer control signal Tx that sets the boosted power supply voltage to a high level. The transfer control signal Tx is a control signal for transferring electric charges generated during exposure time Δt based on photoelectric conversion by the photoelectric conversion element and is commonly supplied to the p pixel portions 3225.

The pixel drive circuit 3224 generates a drive signal Dry for driving the p pixel portions 3225 based on the control signal DRC from the control circuit 3222. The p pixel portions 3225 are disposed side by side in a one-dimensional direction, and the drive signal Dry is transferred to the p pixel portions 3225. When the drive signal Dry is active and a pixel selection signal SELi−1 is active, an i-th, i being any one of 1 to p, pixel portion 3225 activates a pixel selection signal SELi and outputs a signal. The pixel selection signal SELi is output to an (i+1)-th pixel portion 3225.

The p pixel portions 3225 include photoelectric conversion elements that receive light and perform photoelectric conversion, and based on the transfer control signal Tx, the pixel selection signal SEL (any one of SEL0 to SELp−1), the reset signal RST, and the drive signal Drv, output a signal having a voltage corresponding to light received by the photoelectric conversion element during the exposure time Δt respectively. Signals output from the p pixel portions 3225 are sequentially transferred to the CDS circuit 3226.

The CDS circuit 3226 receives a signal Vo sequentially including the signals respectively output from the p pixel portions 3225, and operates based on the control signal CDSC from the control circuit 3222. The CDS circuit 3226 removes noise generated by the characteristics variation in the amplification transistors of the p pixel portions 3225 and superimposed on the signal Vo by the correlated double sampling with the reference voltage VREF as a reference. That is, the CDS circuit 3226 is a noise reduction circuit for reducing noise included in the signals output from the p pixel portions 3225.

The sample hold circuit 3227 samples the signal from which noise is removed by the CDS circuit 3226 based on the sampling signal SMP, holds the sampled signal, and outputs it to the output circuit 3228.

The output circuit 3228 amplifies the signal output from the sample hold circuit 3227 to generate the output signal OS. As described above, the output signal OS is output from the photoelectric conversion device 322 via an output terminal OP1 and supplied to the AFE circuit 130.

The control circuit 3222 generates a chip enable signal EN_O which is a high pulse signal shortly before the output of the output signal OS from the output circuit 3228 is finished, and outputs it from an output terminal OP2 to a next-stage of photoelectric conversion device 322. The chip enable signal EN_O here is any one of chip enable signals EN2 to ENn+1 in FIG. 13. Thereafter, the control circuit 3222 causes the output circuit 3228 to stop outputting the output signal OS and further sets the output terminal OP1 to high impedance.

As described above, the sensor 190 of the present embodiment includes the photoelectric conversion device 322 and the AFE circuit 130 coupled to the photoelectric conversion device 322. In this way, it becomes possible to output appropriate pixel data based on the output signal OS output from the photoelectric conversion device 322. The output signal OS is an analog signal and the pixel data is digital data. Note that, the sensor 190 may output pixel data of a number corresponding to the number of photoelectric conversion elements included in the photoelectric conversion device 322, and the number is not limited to this. As will be described later with reference to FIG. 16, the photoelectric conversion device 322 may generate an output signal OS representing the sum of the outputs of a plurality of pixels. Alternatively, as will be described later with reference to FIG. 20 and the like, in the AFE circuit 130, a part of the outputs of the plurality of pixels may be thinned out, or information corresponding to the sum of the outputs of the plurality of pixels may be calculated.

2. Lens Pitch and Pixel Pitch

As described above, the sensor unit 320 of the present embodiment includes a lens array 325 in which a plurality of Selfoc lenses are disposed side by side in a predetermined direction. The photoelectric conversion element included in the photoelectric conversion device 322 outputs a signal corresponding to the light amount by receiving light from the lens array 325.

Figure 15:
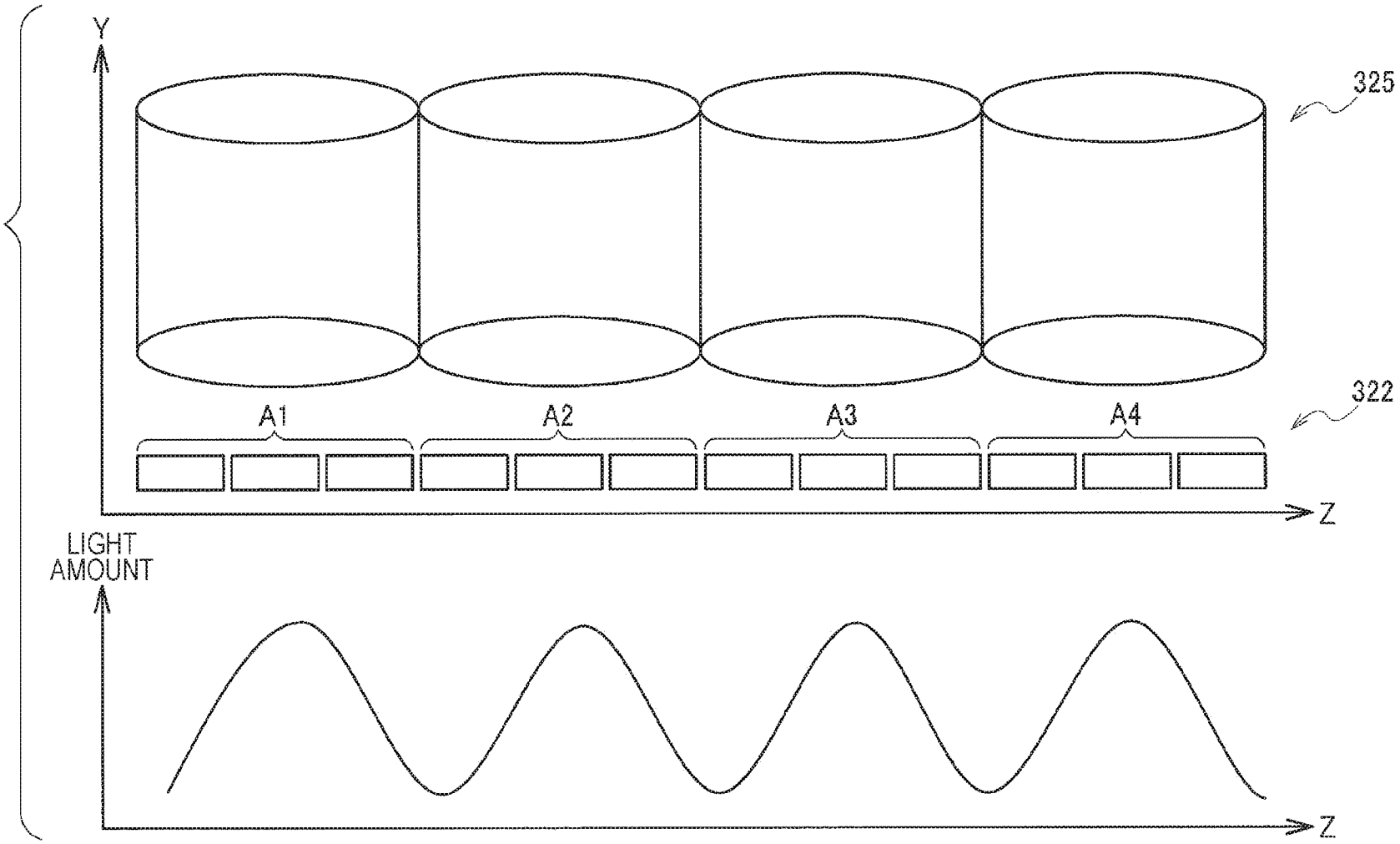
FIG. 15 is a diagram illustrating a lens pitch, a pixel pitch, and a light amount unevenness.

FIG. 15 is a diagram illustrating a relationship between a plurality of Selfoc lenses and a plurality of photoelectric conversion elements disposed in the ±Z direction, and the amount of light after passing through the lens array 325. One Selfoc lens has a light amount distribution in which the light amount in the direction along the optical axis is large and the light amount decreases as the distance from the optical axis increases. The optical axis here is, for example, an axis that passes through the center of the Selfoc lens and is parallel to the Y-axis. In the Selfoc lens array, the image produced by a given Selfoc lens overlaps the image produced by the Selfoc lens in the vicinity of the given Selfoc lens. Since the light amount of the Selfoc lens array is a sum of the light amount of each Selfoc lens, as illustrated in FIG. 15, the light amount has a periodic unevenness corresponding to the pitch of the lens. For example, even when a uniform amount of light is incident on the lens array 325, the light amount of light transmitted through the lens array 325 changes periodically in the ±Z direction.

In the present embodiment, the ink amount detection processing and the ink type determination processing are performed based on the light amount detected by the photoelectric conversion device 322 as described later. The light amount unevenness becomes a factor that reduces the accuracy of these processing. Specifically, an erroneous determination may occur in comparison processing with a threshold which will be described later, due to the light amount unevenness.

When the lens array 325 and the photoelectric conversion device 322 are used in a scanner, a shading correction is performed. Since the reference value in the shading correction becomes information including the light amount unevenness, it is possible to reduce the light amount unevenness by performing the shading correction using the reference value. Also, in the present embodiment, it is not hindered to perform the shading correction. However, in order to perform the shading correction, it is necessary to measure the reference value in advance and write it in the non-volatile memory. Therefore, the number of steps before shipment increases, which leads to an increase in cost. Further, the processing section 120 needs to perform ink amount detection processing or the like after performing correction processing using a reference value on the pixel data output from the sensor 190. Therefore, the processing load during the operation of the printer is also large.

Therefore, in the present embodiment, the pitch of the plurality of lenses may be k times the pixel pitch of the sensor 190, k being an integer of 2 or more. The lens pitch is a disposition interval of the lenses included in the lens array 325. Specifically, the lens pitch is a distance from a reference position of a given lens to a reference position of an adjacent lens. The reference position here may be a center of the lens, one end point on the Z-axis, or another position. As illustrated in FIG. 15, when the lenses are considered to be disposed without a gap, the lens pitch corresponds to a length of one lens on the Z-axis, specifically, a diameter. The pixel pitch of the sensor 190 is a disposition interval of the photoelectric conversion elements included in the photoelectric conversion device 322. Specifically, the pixel pitch is a distance from a reference position of a given photoelectric conversion element to a reference position of an adjacent photoelectric conversion element.

Then, the processing section 120 determines the ink amount based on the sum of the outputs of the k continuous pixels. The pixel here corresponds to the pixel portion 3225 in FIG. 14 and represents an output of the minimum unit in the photoelectric conversion device 322. Specifically, one pixel corresponds to one photoelectric conversion element.

As described above, the light amount unevenness of the lens array 325 has a periodicity corresponding to the lens pitch. By setting the lens pitch to be k times the pixel pitch, k continuous pixels have a length corresponding to a wavelength of the light amount unevenness. Therefore, the light amount unevenness can be reduced by summing the outputs of k continuous pixels. For example, the degree of occurrence of light amount unevenness in three pixels indicated by A1 in FIG. 15 is equal to the degree of occurrence of light amount unevenness in three pixels indicated by A2. Therefore, when the outputs of the three pixels indicated by A1 and the three pixels indicated by A2 are summed respectively, the difference caused by the light amount unevenness is sufficiently reduced between the two sums. The same applies to the sum of the outputs of the three pixels indicated by A3 and A4. It should be noted that the information used by the processing section 120 may be information based on the sum of the outputs of the k continuous pixels, and is not limited to the sum itself. For example, the processing section 120 may determine the ink amount by using an average of the outputs of k continuous pixels. In a broad sense, the processing section 120 may determine the ink amount based on information obtained by multiplying the sum of the outputs of k pixels by a constant. The constant here is not limited to 1/k, and information other than the average based on the sum may be used.

Here, the lens pitch is, for example, 300 micrometers. 300 micrometers is a pitch widely used in the Selfoc lens array. For example, the Selfoc lens array widely used in the scanners can be applied to the method of the present embodiment.

Further, k may be 3 to 5. The size of the photoelectric conversion element can be variously designed. However, it is not easy to manufacture an excessively large element. Further, an extremely high resolution is not required for the ink amount detection processing and the like in the present embodiment. For example, a scanner may have a resolution of 600 dpi (dots per inch), 1200 dpi, 4800 dpi, or the like, but the resolution of the present embodiment may be lower than this. For example, by using the photoelectric conversion device 322 having a pixel pitch used in a low-resolution scanner having a resolution of about 250 to 430 dpi, it is possible to reduce costs while diverting parts. When the lens pitch is 300 micrometers, the pixel pitch is about 60 to 100 micrometers. Hereinafter, an example of k=3 will be described.

The sensor 190 may output pixel data in one pixel unit to the processing section 120, and the processing section 120 may perform processing of obtaining the sum or average of pixel data of k continuous pixels. Also, in this case, it is possible to reduce the light amount unevenness.

Alternatively, the sensor 190 may output pixel data corresponding to the sum of the outputs of k continuous pixels. In this way, the sensor 190 performs the processing of obtaining the sum or average of the pixel data. Compared to when the processing section 120 calculates the sum or the average, it is possible to reduce the amount of data stored in the SRAM in the AFE circuit 130, and the amount of communication data between the AFE circuit 130 and the processing section 120. Details of the data amount will be described later with reference to FIGS. 19 to 26.

Figure 16:
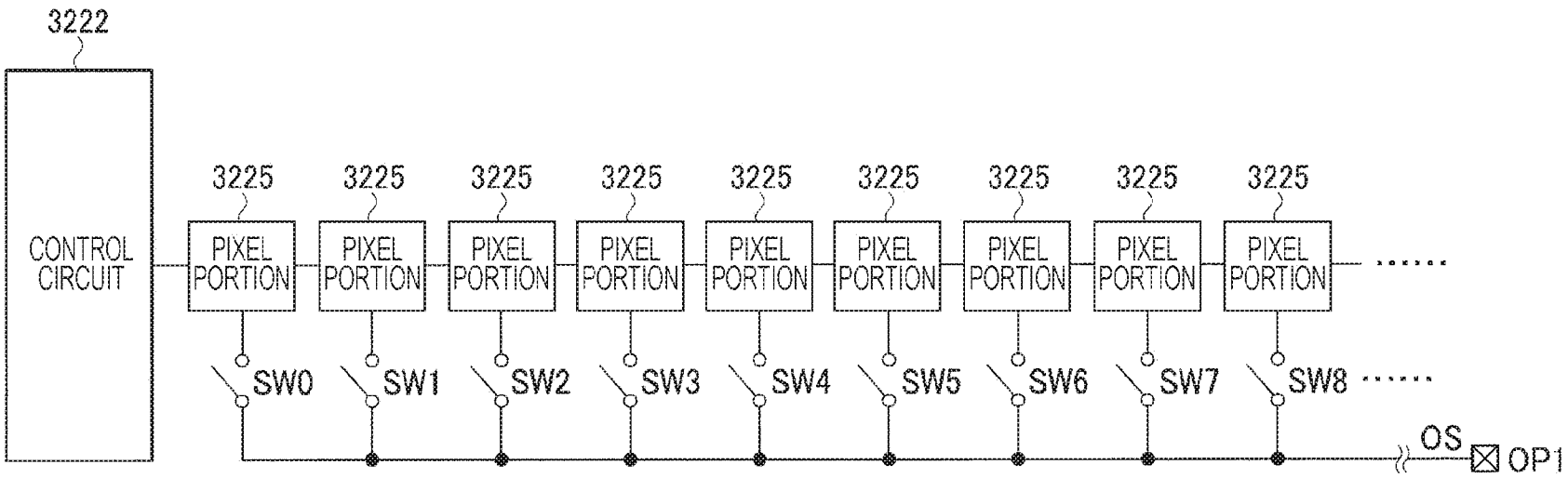
FIG. 16 is a diagram illustrating another configuration example of a photoelectric conversion device.

FIG. 16 is a diagram illustrating a configuration of the photoelectric conversion device 322. Note that, the configuration similar to that of FIG. 14 is omitted as appropriate. As illustrated in FIG. 16, each pixel portion 3225 is coupled to the output terminal OP1 via a switch. Note that, as illustrated in FIG. 14, a CDS circuit 3226 or the like may be provided between the output terminal OP1 and the pixel portion 3225. Here, since nine pixel portions are illustrated, switches SW0 to SW8 are described. Each switch is realized by, for example, a transistor. The control circuit 3222 controls on and off of the switch based on an instruction from the processing section 120.

The control circuit 3222 turns on the switches SW0, SW1, and SW2 and turns off the other switches in a period during which the first to third pixel portions 3225 out of the p pixel portions 3225 output signals. In this case, the analog signal corresponding to the sum of the three pixel portions 3225 is output from the output terminal OP1. By subjecting the signal to A/D conversion processing in the AFE circuit 130, pixel data corresponding to the sum of the outputs of three continuous pixels is output. Note that, the pixel portion 3225 may include an amplifier. In this case, by adjusting the gain of the amplifier in advance, it is possible to output the sum for the three pixels or the average for the three pixels. Alternatively, the gain of the amplifier included in the AFE circuit 130 may be adjusted.

Similarly, in the period during which the fourth to sixth pixel portions 3225 output signals, the switches SW3, SW4, and SW5 are turned on, and the other switches are turned off, so that the sum for the next three continuous pixels is output. The same applies to the subsequent steps, and the sensor 190 can output pixel data corresponding to the sum of the outputs of the k continuous pixels by performing control to sequentially turn on a set of k switches. In this case, the output signal OS output from one photoelectric conversion device 322 is a signal including p/k signals in order.

Note that, the photoelectric conversion device 322 may output pixel data in one pixel unit to the AFE circuit 130, and the AFE circuit 130 may perform processing of obtaining the sum or average of the pixel data for the k continuous pixels.

Further, the sensor 190 may be capable of switching the output in one pixel unit and the output in units of k pixels. For example, the processing section 120 gives the sensor 190 either an output instruction in one pixel unit or an output instruction in units of k pixels. When the output instruction in one pixel unit is received, the control circuit 3222 of the photoelectric conversion device 322 turns on the switches provided corresponding to the pixel portions 3225 one by one. Specifically, only the switch corresponding to the active pixel portion 3225 is turned on and the other switches are turned off. Further, when the output instruction in units of k pixels is received, the control circuit 3222 of the photoelectric conversion device 322 turns on the switches provided corresponding to the pixel portions 3225 in groups of k, as described above. In this way, it is possible to switch whether the light amount unevenness is corrected by the sensor 190. For example, when the processing load on the processing section 120 is reduced, the outputs for k pixels are summed by the sensor 190. On the other hand, when the accuracy is important, the sensor 190 outputs pixel data in one pixel unit, and the processing section 120 performs the shading correction.

Note that, the lens pitch is, for example, 300 micrometers, the pixel pitch is, 100 micrometers, and k=3, for example. However, since a manufacturing error occurs in the lens pitch and the pixel pitch, the lens pitch may not be the integral multiple of the pixel pitch. As described above, when strictly correcting the light amount unevenness, it is desirable to set so that the lens pitch matches k times the pixel pitch. This is because the k continuous pixels correspond to the wavelength of the light amount unevenness. However, it is confirmed that, by using the pixel data corresponding to the sum of a plurality of continuous pixels, it is possible to reduce the light amount unevenness to the extent that there is no problem in the ink amount detection processing. Therefore, the fact that "the lens pitch is k times the pixel pitch" in the present embodiment means that it is sufficient as long as the lens pitch is designed to be k times or substantially k times the pixel pitch, and the actual pitch ratio is not limited to being the integral multiple. For example, the lens pitch, the pixel pitch, and k in the present embodiment have an effective digit of one digit.

In other words, the processing section 120 determines the ink amount based on the sum of the outputs of k continuous pixels provided in the sensor 190 corresponding to each lens of the plurality of lenses. That is, it is sufficient as long as the lens and the k continuous pixels have a correspondence relationship, and they do not have to exactly match.

For example, the lens pitch may be 300±40 micrometers. In the present embodiment, it is confirmed that the ink amount detection processing can be performed with sufficient accuracy, even when an error of about 10% occurs in the lens pitch, the pixel pitch, or a relative relationship between the two pitches.

3. Ink Amount Detection Processing

Next, processing of determining the amount of ink IK accommodated in the ink tank 310 based on the output of the sensor 190 will be described.

3.1 Basic Ink Amount Detection Processing

Figure 17:
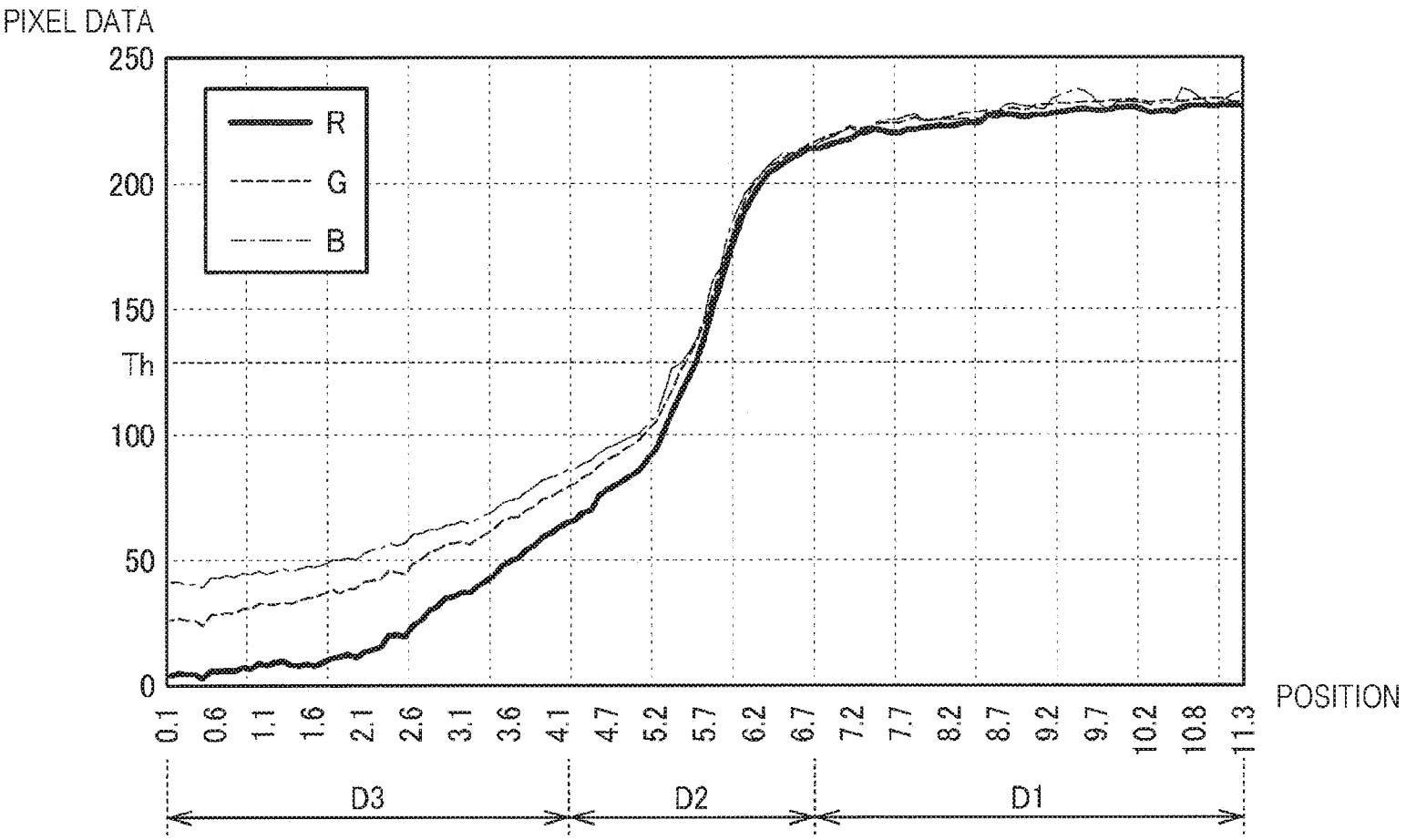
FIG. 17 is an example of pixel data which are outputs from a sensor.

FIG. 17 is a diagram illustrating waveforms representing the pixel data which are outputs from the sensor 190. As described above with reference to FIG. 13, the output signal OS of the photoelectric conversion device 322 is an analog signal, and pixel data as digital data is acquired by the A/D conversion by the AFE circuit 130.

The horizontal axis of FIG. 17 represents a position of the photoelectric conversion device 322 in the longitudinal direction, and the vertical axis represents a value of pixel data corresponding to the photoelectric conversion element provided at the position. The numerical values of the horizontal axis of FIG. 17 represent the distances from the reference position in unit of millimeters. FIG. 17 illustrates an example in which the red LED 323R, the green LED 323G, and the blue LED 323B are provided as the light sources 323. The processing section 120 acquires three pixel data of RGB as pixel data of the photoelectric conversion device 322.

When the longitudinal direction of the photoelectric conversion device 322 is the vertical direction, the left direction on the horizontal axis corresponds to the −Z direction, and the right direction corresponds to the +Z direction. When the positional relationship between the photoelectric conversion device 322 and the ink tank 310 is known, it is possible to associate each photoelectric conversion element with the distance from the reference position of the ink tank 310. The reference position of the ink tank 310 is, for example, a position corresponding to an inner bottom surface of the ink tank 310. The inner bottom surface is the position of the assumed lowest ink level.

Further, pixel data corresponding to one photoelectric conversion element is, for example, 8-bit data and has a value in the range of 0 to 255. However, the values of the vertical axis can be replaced with data after the normalization processing or the like is performed. Of course, it is not limited to 8 bits, and other bits such as 4 bits or 12 bits may be used.

As described above, the photoelectric conversion element corresponding to the area where the ink IK does not exist has relatively large amount of light received, and the photoelectric conversion element corresponding to the area where the ink IK exists has relatively small amount of light received. In the example illustrated in FIG. 17, the value of output data is large in the range indicated by D1, and the value of output data is small in the range indicated by D3. Then, the value of the pixel data is greatly changed with respect to the change of the position in the range indicated by D2 between D1 and D3. That is, the range of D1 is an ink non-detection area having a high probability that the ink IK does not exist. The range of D3 is an ink detection area having a high probability that the ink IK exists. The range of D2 is an ink boundary area representing a boundary between an area where the ink IK exists and an area where the ink IK does not exist.

The processing section 120 performs ink amount detection processing based on the pixel data output by the sensor 190. Specifically, the processing section 120 detects a position of the liquid level of the ink IK based on the pixel data. As illustrated in FIG. 17, the liquid level of the ink IK is considered to exist at any position of the boundary area D2. Therefore, the processing section 120 detects the liquid level of the ink IK based on a given threshold Th that is smaller than the value of the pixel data in the ink non-detection area and greater than the value of the pixel data in the ink detection area.

For example, the processing section 120 specifies the maximum value of the pixel data as the value of the pixel data in the ink non-detection area. The processing section 120 determines a value smaller than the specified value by a predetermined amount as the threshold Th. Alternatively, the processing section 120 specifies the minimum value of the pixel data as the value of the pixel data in the ink detection area. The processing section 120 determines a value greater than the specified value by a predetermined amount as the threshold Th. Alternatively, the processing section 120 may determine the threshold Th based on the average of the maximum value and the minimum value of the pixel data.

However, when the type of the ink IK and the type of the light source 323 are determined, the value of the pixel data corresponding to the ink level can be determined in advance. Therefore, the processing section 120 may perform processing of reading out the predetermined threshold Th from the storage section 140 without obtaining the threshold Th each time.

When the threshold Th is acquired, the processing section 120 detects a position where the output value becomes Th as a position of the liquid level of the ink IK. In this way, the amount of ink included in the ink tank 310 can be detected by using the photoelectric conversion device 322 which is a linear image sensor. Information obtained directly by using Th is a relative position of the ink level with respect to the photoelectric conversion device 322. Therefore, the processing section 120 may perform calculation for obtaining the remaining amount of the ink IK based on the position of the liquid level.

When all output data is greater than Th, the processing section 120 determines that ink does not exist in the target range of the ink amount detection, that is, the liquid level is located at a position lower than the end point of the photoelectric conversion device 322 in the −Z direction. When all output data is smaller than Th, the processing section 120 determines that the target range of the ink amount detection is filled with ink, that is, the liquid level is at a position higher than the end point of the photoelectric conversion device 322 in the +Z direction. When it is not possible that the liquid level is located at a position higher than the end point of the photoelectric conversion device 322 in the +Z direction, it may be determined that an abnormality has occurred.

The ink amount detection processing is not limited to processing using the threshold Th in FIG. 17. For example, the processing section 120 performs processing of obtaining an inclination of the graph illustrated in FIG. 17. The inclination is specifically a differentiation value and more specifically, a differential value of adjacent pixel data. The processing section 120 detects a point where the inclination is greater than a predetermined threshold, more specifically, a position where the inclination becomes maximum, as the position of the liquid level. When the maximum value of the obtained inclination is equal to or less than a given inclination threshold, the processing section 120 determines that the liquid level is at a position lower than the end point of the photoelectric conversion device 322 in the −Z direction or a position higher than the end point in the +Z direction. Which side the liquid level is on can be identified from the value of the pixel data.

When a plurality of pixel data is acquired based on a plurality of lights having different wavelength bands as illustrated in FIG. 17, the ink amount detection processing may be performed based on any one pixel data. Alternatively, the processing section 120 may specify the position of each pixel using each output data, and determine the final position of the liquid level based on the specified position. For example, the processing section 120 determines, as the position of the liquid level, an average value or the like of a position of a liquid level obtained based on pixel data of R, a position of a liquid level obtained based on pixel data of G, and a position of a liquid level obtained based on pixel data of B. Alternatively, the processing section 120 may obtain synthetic data obtained by synthesizing three pixel data of RGB and obtain the position of the liquid level based on the synthetic data. The synthetic data is average data obtained by averaging pixel data of RGB at each point, for example.

Figure 18:
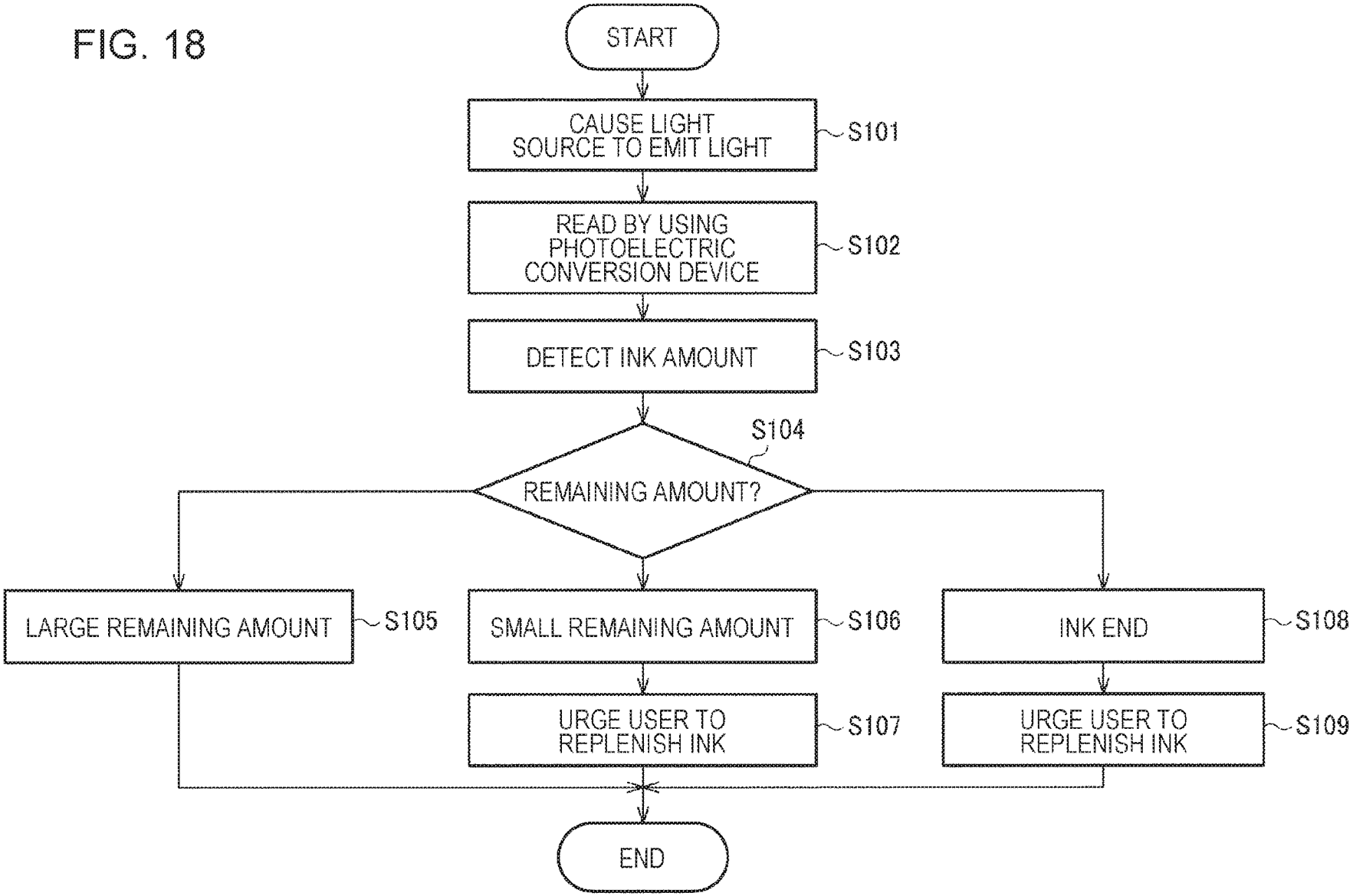
FIG. 18 is a flowchart for explaining ink amount detection processing.

FIG. 18 is a flowchart for explaining processing including the ink amount detection processing. When the processing is started, the processing section 120 performs control for causing the light source 323 to emit light (S101). Then, in the period during which the light source 323 emits light, reading processing using the photoelectric conversion device 322 is performed (S102). When the light source 323 includes a plurality of LEDs, the processing section 120 sequentially performs processing of S101 and S102 for each of the red LED 323R, the green LED 323G, and the blue LED 323B. Through the above processing, three pixel data of RGB illustrated in FIG. 17 are acquired.

Next, the processing section 120 performs ink amount detection processing based on the acquired pixel data (S103). As described above, various modifications can be made to the specific processing of S103, such as comparison processing of comparing with the threshold Th and detection processing of detecting the maximum value of the inclination.

The processing section 120 determines the amount of ink IK filled in the ink tank 310 based on the detected position of the liquid level (S104). For example, the processing section 120 sets ink amounts in three stages of "large remaining amount", "small remaining amount", and "ink end" in advance, and determines whether the current ink amount corresponds to which one of them. The large remaining amount represents a state in which a sufficient amount of the ink IK is left and no user action is required for continuing printing. The small remaining amount represents a state in which the continuation of printing itself is possible but the amount of ink is reduced and replenishment by the user is desirable. The ink end represents a situation where the ink amount is remarkably reduced and the printing operation should be stopped.

When it is determined that the remaining amount is large in processing of S104 (S105), the processing section 120 ends the processing without performing notification or the like. When it is determined that the remaining amount is small in the processing of S104 (S106), the processing section 120 performs notification processing for urging the user to replenish the ink IK (S107). The notification processing is performed by displaying a text or an image on a display section 150, for example. However, the notification processing is not limited to display, and may be notification by emitting light from a light emitting section for notification, notification by sound using a speaker, or notification by combining these. When the ink end is determined in the processing of S104 (S108), the processing section 120 performs notification processing of urging the user to replenish the ink IK (S109). The notification processing of S109 may be the same as the notification processing of S107. However, as described above, it is difficult to continue the printing operation in the ink end, which is a serious state as compared with the small remaining amount. Thus, the processing section 120 may perform notification processing in S109 different from that of S107. Specifically, when comparing with the processing of S107, the processing section 120 may execute processing such as changing the text to be displayed to a content that strongly urges the user to replenish the ink IK, increasing the light emission frequency, increasing the sound, and the like in S109. The processing section 120 may perform processing (not illustrated) such as printing operation stop control after the processing of S109.

The execution trigger of the ink amount detection processing illustrated in FIG. 18 can be set in various ways. For example, the execution start of a given print job may be used as the execution trigger or a lapse of a predetermined time may be used as the execution trigger.

The processing section 120 may store the ink amount detected by in the ink amount detection processing to the storage section 140. The processing section 120 performs processing based on the time series change of the detected ink amount. For example, the processing section 120 obtains an ink increase amount or an ink decrease amount based on a difference between the ink amount detected at a given timing and the ink amount detected at a timing before the given timing.

Since the ink IK is used for printing, head cleaning, or the like, the reduction of the ink amount is natural in consideration of the operation of the electronic apparatus 10. However, the amount of ink IK consumed per unit time in printing and the amount of ink IK consumed per head cleaning are determined to some extent, and when the amount of consumption is extremely large, there may be an abnormality such as ink leakage.

For example, the processing section 120 obtains a standard ink consumption assumed in printing or the like in advance. The standard ink consumption may be obtained based on the estimated ink consumption per unit time or based on the estimated ink consumption per job. The processing section 120 determines that there is an abnormality when the ink reduction amount obtained based on the time-series ink amount detection processing is greater than the standard ink consumption by a predetermined amount or more. Alternatively, the processing section 120 may perform consumption calculation processing of calculating the amount of ink consumption by counting the number of times of discharge of ink IK. In this case, the processing section 120 determines that there is an abnormality when the ink reduction amount obtained based on the time series ink amount detection processing is greater than the ink consumption calculated by the consumption calculation processing by a predetermined amount or more.

The processing section 120 sets an abnormality flag to be ON when the abnormality is determined. In this way, when the ink amount is excessively reduced, some kind of error processing can be executed. Various processing can be considered when the abnormality flag is set to ON. For example, the processing section 120 may re-execute the ink amount detection processing illustrated in FIG. 18 with the abnormality flag as a trigger. Alternatively, the processing section 120 may perform notification processing for urging the user to confirm the ink tank 310 based on the abnormality flag.

The ink amount increases by replenishing the ink IK by the user. However, it is conceivable that the ink amount increases even when the ink IK is not replenished, such as a temporary change of the liquid level due to the shaking of the electronic apparatus 10, a backflow of ink IK from the tube 105, a detection error of the photoelectric conversion device 322, or the like. Therefore, when the ink increase amount is equal to or less than a given threshold, the processing section 120 determines that the ink IK is not replenished and the increase width is within an allowable error range. In this case, since it is determined that the change in the ink amount is in a normal state, no additional processing is performed.

On the other hand, when the ink increase amount is greater than the given threshold, the processing section 120 determines that the ink is replenished and sets an ink replenishment flag to ON. The ink replenishment flag is used as the execution trigger for ink type determination processing which will be described later, for example. The ink replenishment flag may be used as a trigger for processing of resetting an initial value in the consumption calculation processing.

However, when the ink increase amount is greater than the given threshold, it cannot be denied that there is a possibility of an unacceptably large error due to some abnormality. Thus, the processing section 120 performs notification processing for requesting the user to input whether the ink IK has been replenished, and may determine whether to set the abnormality flag or the ink replenishment flag based on the result input by the user.

3.2 Ink Amount Detection Processing Capable of Reducing Data Amount

As described above with reference to FIGS. 13 and 14, the output signal OS of the photoelectric conversion device 322 is transmitted to the AFE circuit 130, and the AFE circuit 130 transmits pixel data that is digital data to the processing section 120. The AFE circuit 130 includes a memory (not illustrated), and it is necessary to temporarily accumulate the pixel data after the A/D conversion in the memory. Hereinafter, an example in which the memory is an SRAM will be described.

Figure 19:
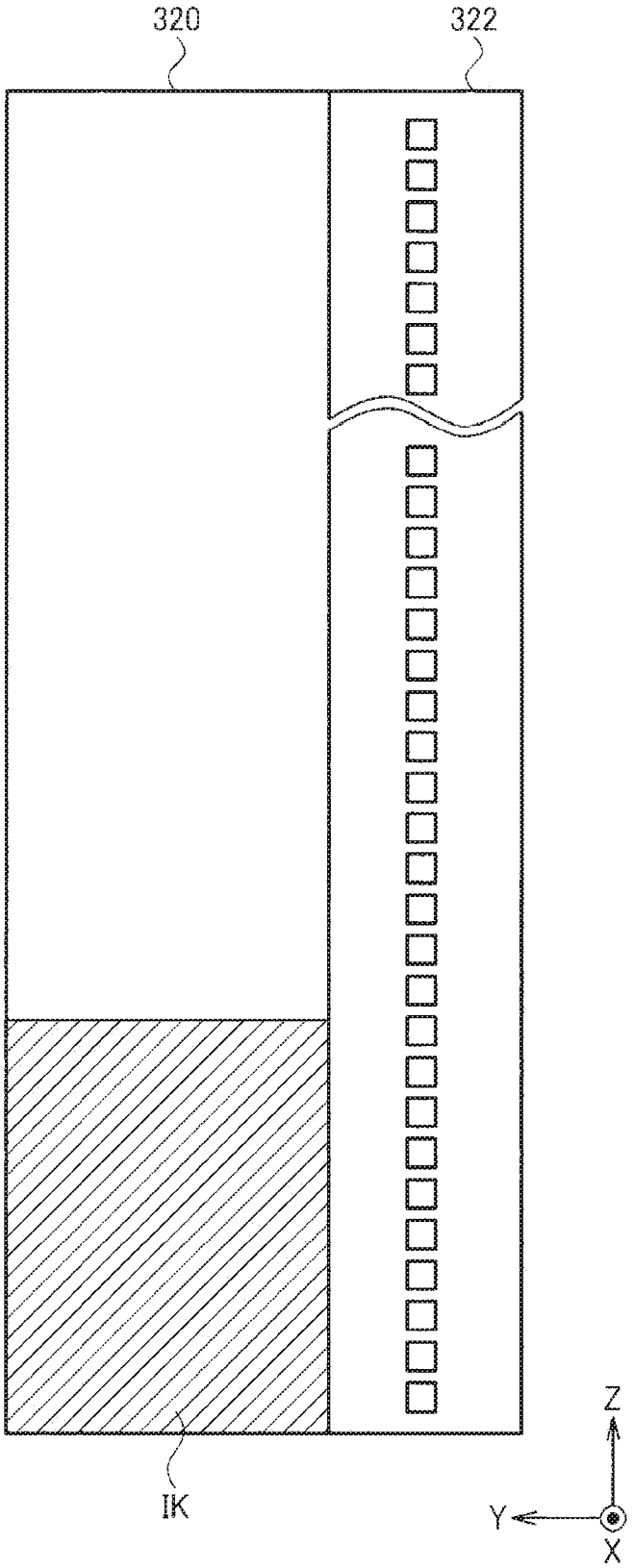
FIG. 19 is a diagram for explaining a positional relationship between an ink tank and a photoelectric conversion device.

FIG. 19 is a diagram illustrating the disposition of the ink tank 310 and the photoelectric conversion device 322. As described above with reference to FIG. 9, the photoelectric conversion device 322 is a linear image sensor and is disposed such that a longitudinal direction thereof is a vertical direction. That is, a plurality of photoelectric conversion elements included in the photoelectric conversion device 322 are disposed side by side in the vertical direction. The number of photoelectric conversion devices 322 included in one sensor 190 can be variously modified, and the number of photoelectric conversion elements included in one photoelectric conversion device 322 can also be variously modified. That is, the number of photoelectric conversion elements included in the sensor 190 can be variously modified. Hereinafter, the number of photoelectric conversion elements included in the sensor 190 is assumed to be q. q is an integer of 2 or more.

For example, the AFE circuit 130 receives an output signal OS including q signals based on q photoelectric conversion elements, performs A/D conversion of the output signal OS, and writes q pieces of pixel data which is the result of the A/D conversion, in the SRAM. Note that, as described above with reference to FIGS. 15 and 16, a case can be considered in which the output signal OS of the photoelectric conversion device 322 includes q/k signals obtained by summing up the k continuous pixels. However, such an example will be described later, and here, an example in which the photoelectric conversion device 322 outputs in one pixel unit will be described.

When one pixel data is represented by 8 bits, the SRAM included in the AFE circuit 130 needs to be able to store q×8 bits of data, which increases the size of the SRAM. The interface between the AFE circuit 130 and the processing section 120 is a serial interface such as a serial peripheral interface (SPI). Therefore, when the amount of transfer data is large, the time required for communication becomes long. Therefore, the sensor 190 of the present embodiment may reduce the amount of data. Hereinafter, a specific method will be described.

3.2.1 Designation of Reading Area and Two-Stage Reading

For example, the processing section 120 designates a reading area for the sensor 190, and determines the ink amount based on the pixel data of the reading area output from the sensor 190. The reading area here represents a part of the area where the sensor 190 can detect light. The area where the sensor 190 can detect light is an area where the photoelectric conversion elements are disposed.

In the present embodiment, there is a case where the photoelectric conversion element is disposed in a range wider than the area corresponding a range from an ink-low state to an ink-full state. The ink-low state corresponds to the minimum amount of ink IK to be detected, and the ink-full state corresponds to the maximum amount of ink IK to be detected. Hereinafter, an area corresponding to a range from the ink-low state to the ink-full state will be referred to as a detection area.

For example, when the detection area is a range corresponding to 180 photoelectric conversion elements, the sensor 190 having 200 photoelectric conversion elements is used. In this way, even when the relative position of the sensor unit 320 with respect to the ink tank 310 is deviated in the ±Z direction due to the mounting error, it is possible to perform the ink amount detection processing for the detection area. However, in this case, the photoelectric conversion elements are disposed at a position that is not the target of the ink amount detection, and the output of the photoelectric conversion element is less required to be used for the processing.

The designation of the reading area in the present embodiment may be designation of the detection area in the area where the photoelectric conversion element is provided. For example, the ink tank 310 may have a mark at a predetermined position on the wall surface on the sensor unit 320 side. The processing section 120 detects the mark position based on the output of the sensor 190. Since the relationship between the mark position and the detection area is known, the processing section 120 designates the target range of the ink amount detection processing as the reading area based on the mark detection result.

The photoelectric conversion device 322 performs the output in one pixel unit as described above, and the AFE circuit 130 receives the output signal OS including 200 signals based on 200 photoelectric conversion elements. The AFE circuit 130 stores, in the SRAM, pixel data obtained by A/D converting signals corresponding to 180 designated photoelectric conversion elements out of 200 signals. On the other hand, the AFE circuit 130 discards the signals corresponding to the 20 undesignated photoelectric conversion elements out of the 200 signals without storing them in the SRAM. In this way, it is possible to reduce the amount of data stored in the SRAM and the amount of data transmitted to the processing section 120.

In consideration of further reducing the data amount, the designated reading area may be a part of the detection area. For example, it is possible to reduce the pixel data stored in the SRAM to 90 by setting the reading area to a lower half area of the detection area. The "lower" here represents the −Z direction. However, when the liquid level of the ink IK exists in the upper half area of the detection area, the ink amount cannot be appropriately detected. Specifically, the values of all pixel data become small, and the liquid level position cannot be determined.

Therefore, the processing section 120 may estimate the position of the liquid level of the ink IK based on the low resolution pixel data output by the sensor 190, and designate the area including the estimated position of the liquid level as the reading area. Then, the processing section 120 determines the ink amount based on the high resolution pixel data in the reading area output from the sensor 190. In other words, the processing section 120 instructs the sensor 190 to perform a two-stage reading.

First, by estimating an approximate position of the liquid level and designating the reading area based on the estimated position, it is possible to increase the probability that the liquid level exists in the reading area. Therefore, even when a part of the detection area is excluded from the reading area, the ink amount can be appropriately determined. Note that, it is desirable that the reading area does not include the area outside the detection area. This is because, as described above, the photoelectric conversion element outside the detection area is provided in consideration of the mounting error and the like, and it is not necessary to detect the liquid level outside the detection area. Hereinafter, an example will be described in which the detection area is an area corresponding to 180 photoelectric conversion elements, and a part of the area is designated as a reading area. However, in consideration of reducing the data amount, the reading area may be limited to a part of the area where the photoelectric conversion element is provided, and the reading area may include the area outside the detection area.

Various methods are conceivable for acquisition of low resolution pixel data and setting of the reading area. For example, the sensor 190 may include a plurality of photoelectric conversion elements, and the processing section 120 may acquire pixel data obtained by thinning out the outputs from a part of the photoelectric conversion elements out of a plurality of photoelectric conversion elements as low resolution pixel data.

Figure 20:
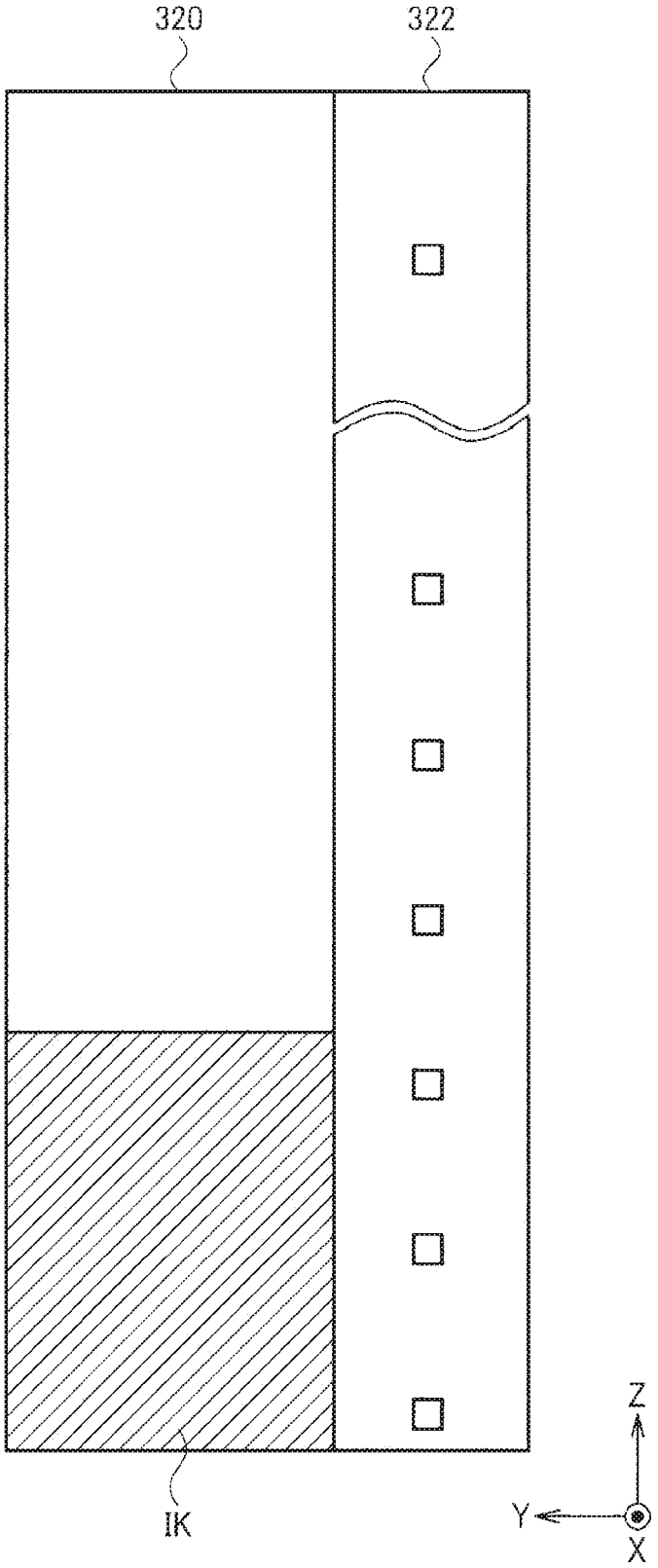
FIG. 20 is a diagram for explaining processing of acquiring low resolution pixel data by thinning out pixels.

FIG. 20 is a diagram for explaining a method of acquiring low resolution pixel data. For example, the processing section 120 divides the detection area into sections for every 18 pixels, leaves 1 pixel for each section, and instructs the sensor 190 to thin out 17 pixels to acquire low resolution pixel data. For example, when the bottom pixel of each section is left, the processing section 120 does not thin out the first pixel, the 19th pixel, the 37th pixel, . . . , and the 163rd pixel from the bottom of the detection area, and sends an instruction to the sensor 190 to thin out other pixels. The AFE circuit 130 stores the pixel data of the pixels for which the instruction that the thinning is not performed is performed in the SRAM, and discards other pixel data without storing it. In this case, the SRAM only needs to store pixel data for ten pixels, and the amount of data can be reduced. Hereinafter, the ten pieces of pixel data will be referred to as first pixel data to tenth pixel data.

When the liquid level exists at the position illustrated in FIG. 20, for the first pixel data to the third pixel data, the values are equal to or less than the threshold so as to be determined as the ink detection area, and for the fourth pixel data to the tenth pixel data, the values are greater than the threshold so as to be determined as the ink non-detection area. That is, the liquid level of the ink IK is estimated to be between the position of the photoelectric conversion element corresponding to the third pixel data and the position of the photoelectric conversion element corresponding to the fourth pixel data. Hereinafter, the position of the photoelectric conversion element corresponding to given pixel data will be simply referred to as the position of the pixel data. In the above example, out of the 180 pixels corresponding to the detection area, the liquid level position is estimated to be in the section between the 37th pixel and the 55th pixel. As described above, by using the low resolution pixel data, it is possible to reduce the amount of data while performing the liquid level estimation covering a wide range of the detection area, in a narrow sense, the entire detection area.

The processing section 120 sets the reading area so as to include the area between the third pixel data and the fourth pixel data. However, when the liquid level position is located in the vicinity of the photoelectric conversion element of the 37th pixel, the value of the third pixel data may change significantly depending on the fluctuation of the liquid level or the like. In other words, since it was erroneously determined that the liquid level position was located between the 37th pixel and the 55th pixel due to noise, it is also conceivable that the actual liquid level position is below the 37th pixel. Similarly, it is conceivable that the actual liquid level position exists above the 55th pixel.

Therefore, when the processing section 120 estimates that there is a liquid level position between the t-th pixel data, t being an integer satisfying $2 \leq t \leq 5\ s-2$, and the (t+1)-th pixel data of the first pixel data to the s-th pixel data, s being an integer of 4 or more, which are the pixel data after thinning, the processing section 120 designates an area obtained by expanding the area as a reading area. The designation of the area obtained by expanding the area means, for example, in this case, designating an area including a section between the (t−1)-th pixel data and the (t+2)-th pixel data as a reading area. In the above example, s=10 and t=3.

Figure 21:
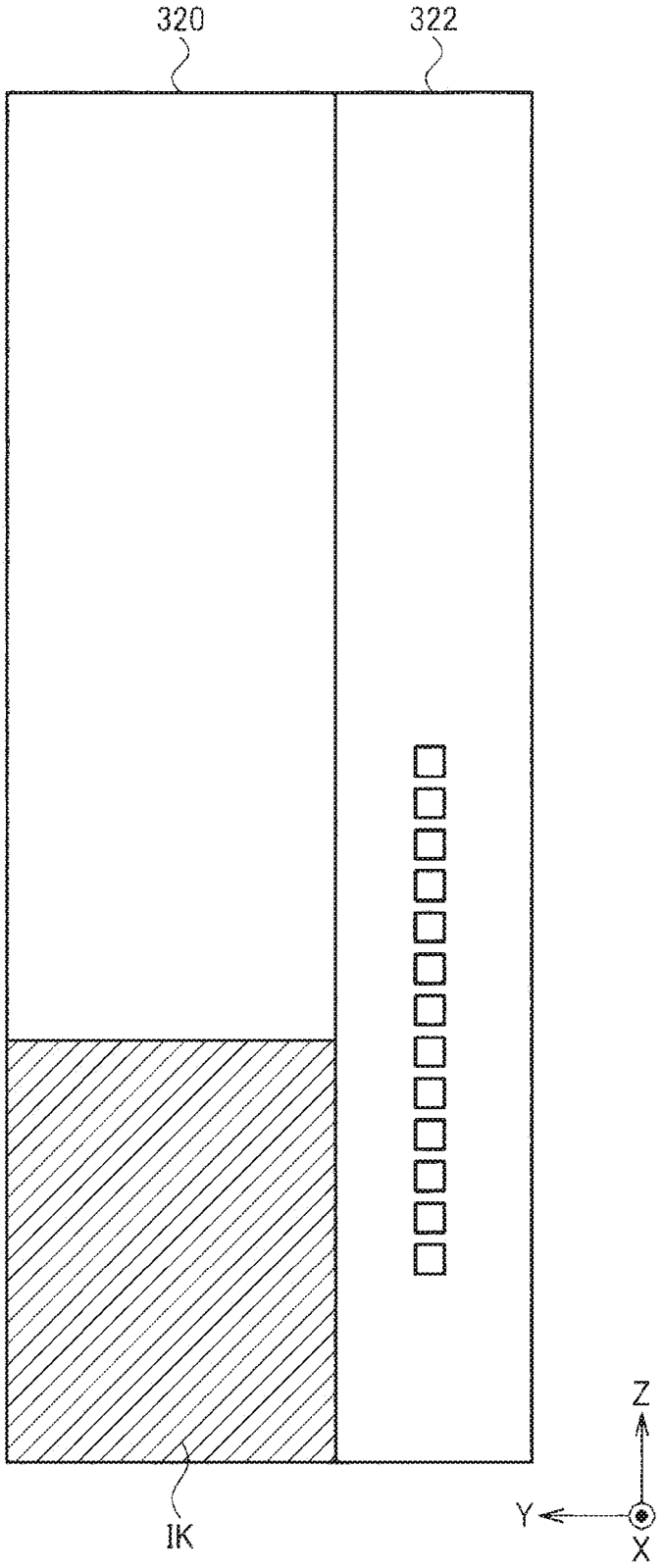
FIG. 21 is a diagram for explaining processing of acquiring high resolution pixel data in a reading area.

FIG. 21 is a diagram illustrating a specific example of the designated reading area. Note that, in FIG. 21, for convenience of drawing, the number of photoelectric conversion elements included in one section is four. However, in the above example, the number of photoelectric conversion elements included in one section is 18. The processing section 120 designates not only a section corresponding to a range between the third pixel data and the fourth pixel data, but also a section corresponding to a range between the second pixel data and the third pixel data and a section corresponding to a range between the fourth pixel data and the fifth pixel data as reading areas. For example, a section corresponding a range between the 19th pixel corresponding to the second pixel data to the 73rd pixel corresponding to the fifth pixel data is designated as the reading area.

In addition, when it is determined that the liquid level exists between the first pixel data and the second pixel data, there is no area lower than that, and thus the processing section 120 designates two sections between the first pixel data and the third pixel data as the reading area. Similarly, when it is determined that the liquid level exists above the tenth pixel data, the processing section 120 designates two sections, between the ninth pixel data and the tenth pixel data, and above the tenth pixel data as the reading areas. Further, the first pixel data existing at the end point of the detection area can be omitted. Even when the first pixel data is omitted, it is possible to determine whether the liquid level is below the second pixel data, based on the value of the second pixel data.

The processing section 120 acquires pixel data that is not thinned out in the reading area as high resolution pixel data. In the above example, the AFE circuit 130 discards the information of the first to 18th pixels based on the designation of the reading area from the processing section 120, stores the pixel data for 55 pixels corresponding to the 19th pixel to the 73rd pixel in the SRAM, and discards the information of the 74th pixel to the 180th pixel. The processing section 120 acquires 55 pieces of pixel data from the AFE circuit 130 as high resolution pixel data, and determines the liquid level position by performing processing such as a threshold determination as described above with reference to FIG. 17.

Figure 22:
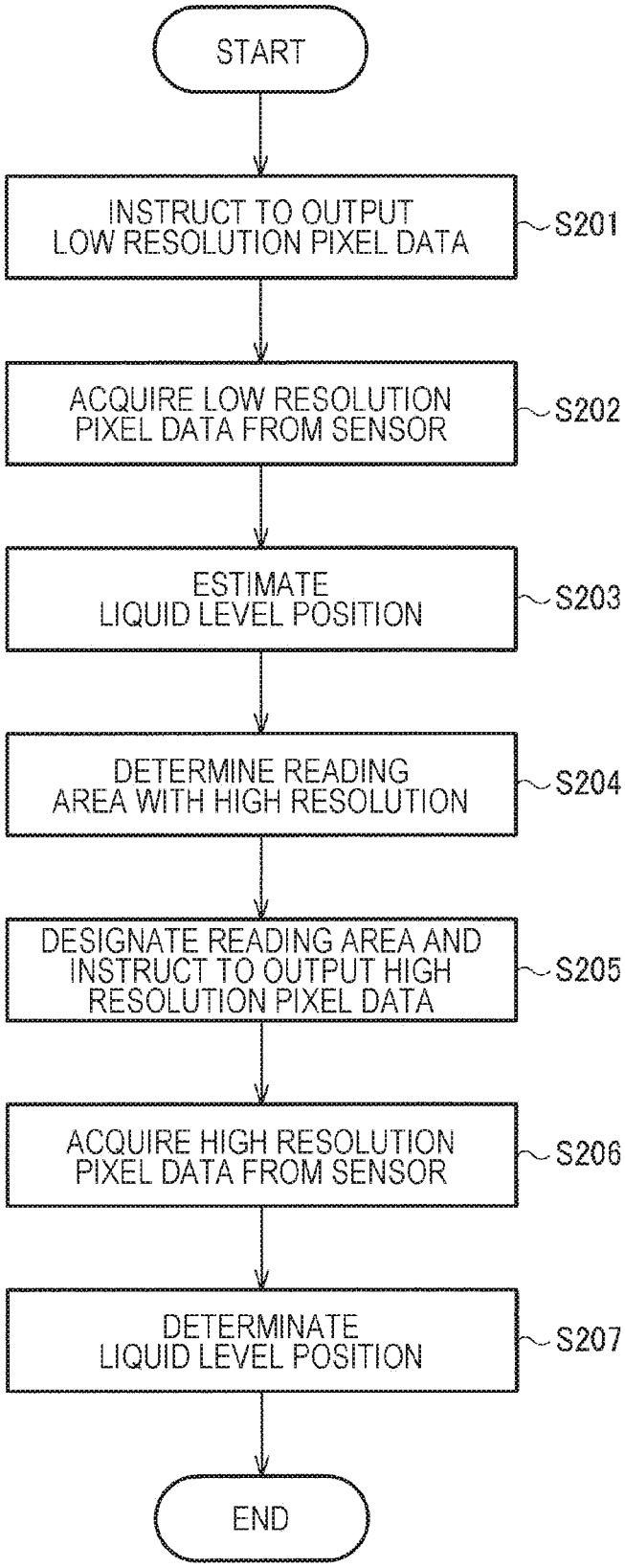
FIG. 22 is a flowchart for explaining two-stage ink amount detection processing.

FIG. 22 is a flowchart for explaining the ink amount detection processing using the method illustrated in FIGS. 20 and 21. When the processing is started, the processing section 120 first instructs the sensor 190 to output low resolution pixel data (S201). Information for specifying pixels to be thinned out and pixels to be not thinned out is stored in, for example, the storage section 140, and the processing section 120 gives an instruction in S201 by reading the information. The sensor 190 outputs the low resolution pixel data based on the instruction from the processing section 120. The processing section 120 acquires low resolution pixel data from the sensor 190 (S202).

Next, the processing section 120 estimates an approximate position of the liquid level based on the low resolution pixel data (S203). The processing of S203 is, for example, as described above, comparison processing of comparing the pixel data after thinning with the threshold. The processing section 120 sets a reading area used for the acquisition of the high resolution pixel data based on the estimated position of the liquid level (S204).

The sensor 190 receives an instruction with respect to the reading area by the processing section 120 (S205). Specifically, the sensor 190 is instructed to output the high resolution pixel data in which pixels are not thinned out in the reading area. The sensor 190 outputs the high resolution pixel data based on the instruction from the processing section 120. The processing section 120 acquires the high resolution pixel data from the sensor 190 (S206).

The processing section 120 determines a highly accurate liquid level position based on the acquired high resolution pixel data (S207). The processing of S207 is the same as that of S103 of FIG. 18, and is comparison processing of comparing the value of the pixel data with a threshold, comparison processing of comparing an inclination of the pixel data with a threshold, or the like.

Further, the low resolution pixel data for estimating the approximate position of the liquid level is not limited to the pixel data acquired by thinning out some pixels. For example, the pixel data including information corresponding to the sum or average of outputs of a plurality of pixels may be low resolution pixel data.

Figure 23:
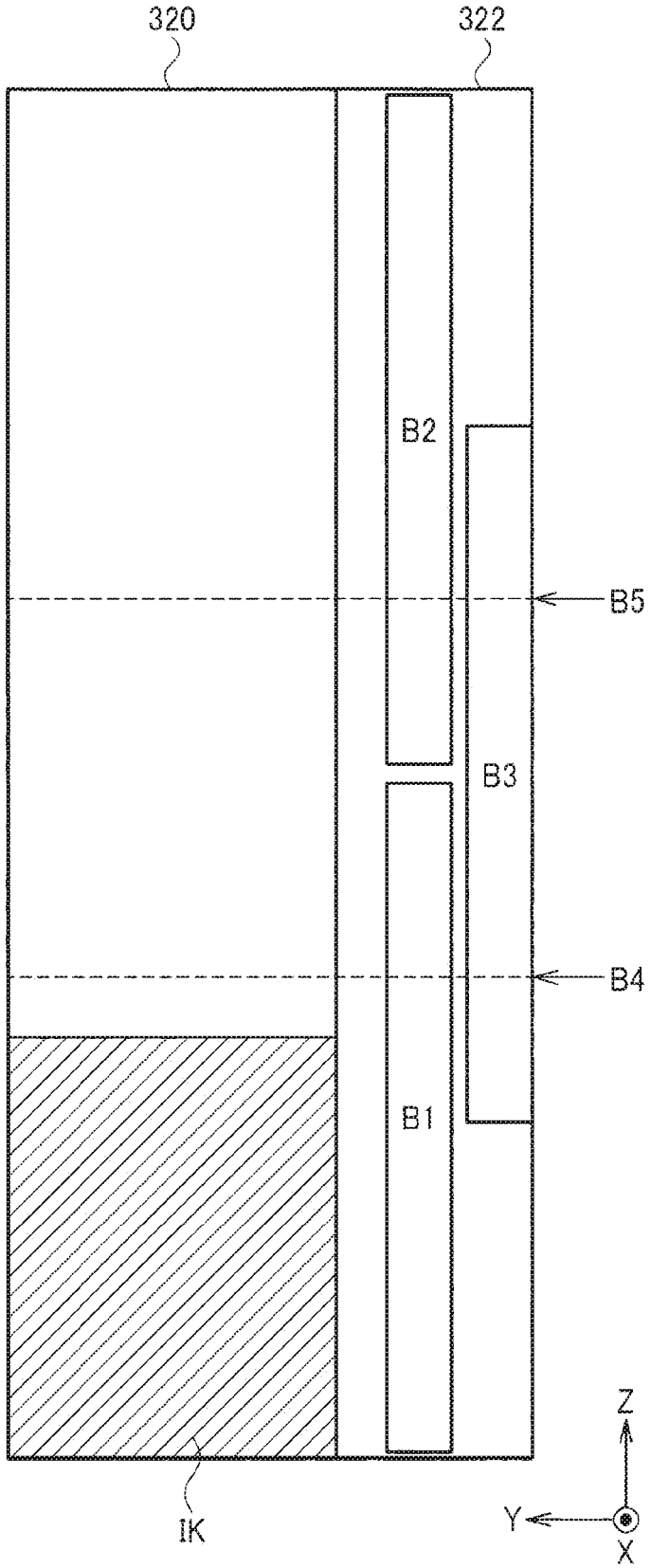
FIG. 23 is a diagram illustrating a setting example of a first area to a third area.

FIG. 23 is a diagram for explaining another method of performing a two-stage reading. As illustrated in FIG. 23, a first area, a second area, and a third area that overlaps a part of the first area and a part of the second area are set in an area that can be read by the sensor 190. The area that can be read by the sensor 190 may be the entire area in which the photoelectric conversion element is provided or the detection area. In the example of FIG. 23, the first area indicated by B1 is a lower half area of the detection area, and the second area indicated by B2 is an upper half area of the detection area R2. The lower half of the third area indicated by B3 overlaps the first area, and the upper half thereof overlaps the second area. More specifically, the first area is the first to 90th pixels, the second area is the 91st to 180th pixels, and the third area is the 46th to 135th pixels. However, various modifications can be made to the specific range of each area.

The low resolution pixel data in the example of FIG. 23 includes first data based on the sum of the outputs of the photoelectric conversion elements included in the first area, second data based on the sum of the outputs of the photoelectric conversion elements included in the second area, and third data based on the sum of the outputs of the photoelectric conversion elements included in the third area.

For example, the first data is the sum or average of 90 pieces of pixel data from the first pixel to the 90th pixel. The photoelectric conversion device 322 outputs the output signal OS including the signals corresponding to the 180 photoelectric conversion elements to the AFE circuit 130 as described above. The AFE circuit 130 sequentially A/D converts 180 analog signals included in the output signal OS.

The AFE circuit 130 includes, for example, a digital adder, sequentially adds the pixel data of the first pixel to the 90th pixel, and stores only the addition result in the SRAM. Since the sum of 90 pieces of pixel data has a value in the range of 0 to 255×90, it can be represented by 15 bits. The sum output of the first area is calculated by adding up to the pixel data of the 90th pixel. The AFE circuit 130 may output the sum to the processing section 120 as the first data, or may perform a calculation for obtaining an average and output the obtained average to the processing section 120 as the first data. Similarly, the AFE circuit 130 sequentially adds the pixel data of the 91st pixel to the 180th pixel, and stores only the addition result in the SRAM to obtain the second data. The AFE circuit 130 sequentially adds the pixel data of the 46th pixel to the 135th pixel, and stores only the addition result in the SRAM to obtain the third data.

For example, the AFE circuit 130 performs addition processing of obtaining the first data for the first pixel to the 45th pixel. By using two digital adders for the 46th pixel to the 90th pixel, the addition processing of obtaining the first data and the addition processing of obtaining the third data are performed in parallel. By using two digital adders for the 91st pixel to the 135th pixel, the addition processing of obtaining the third data and the addition processing of obtaining the second data are performed in parallel. Since the addition processing of the first data is completed in this range, the adder for the first data can be used for the addition processing of obtaining the second data. For the 136th pixel to the 180th pixel, addition processing of obtaining the second data is performed. In this case, the SRAM only needs to hold the three addition results, and for example, it is sufficient as long as it has an area of 3×15 bits. That is, the data amount can be reduced as compared with a case of holding 180 pieces of 8-bit pixel data. Although an example of digitally performing the addition processing has been described above, the AFE circuit 130 does not prevent the addition processing from being performed in an analog manner.

The processing section 120 designates the reading area based on the first data, the second data, and the third data. Hereinafter, an example in which the first to third data are average data will be described.

When the first area is entirely included in the ink detection area, the values of all pixel data corresponding to the first area are sufficiently small, and thus the first data also has a small value. On the other hand, when the first area is entirely included in the ink non-detection area, the values of all pixel data corresponding to the first area are sufficiently large, and thus the first data also has a large value. For simplification of explanation, it is assumed that the value of the pixel data in the ink detection area is normalized to 0 and the value of the pixel data in the ink non-detection area is normalized to 255. In this case, the first data is 0 when the entire first area is the ink detection area, and the first data is 255 when the entire first area is the ink non-detection area.

When the liquid level is located at any position in the first area, the pixel data from the first pixel to the predetermined pixel in the first area is 0, and the pixel data above that is 255. The first data that is the average data has a value between 0 and 255, and the value changes according to the height of the liquid level. For example, when the liquid level is at the center of the first area, the number of pixel data to be 0 is equal to the number of pixel data to be 255, so that the first data has a value of about 128. The same applies to the second area and the third area, and the position of the liquid level in each area can be estimated according to the values of the second data and the third data.

The processing section 120 determines the reading area based on the relationship between the first to third data. For example, the processing section 120 determines whether the estimated position of the liquid level is below B4, between B4 and B5, or above B5. B4 is a position near the center of the overlapping portion of the first area and the third area. In this case, the first data has a value of about 50, the second data has a value of about 255, and the third data has a value of about 200. B5 is a position near the center of the overlapping portion of the second area and the third area. In this case, the first data has a value of about 0, the second data has a value of about 200, and the third data has a value of about 50. By comparing these values with the actual first to third data, it is possible to determine whether the estimated position of the liquid level is below B4, between B4 and B5, or above B5.

Note that, as described above with reference to FIG. 17, the pixel data output by the sensor 190 does not abruptly change from 0 to 255 on the liquid level of the ink IK, and there is an area having an intermediate value. Further, as will be described later with reference to FIGS. 28 to 33 and the like, the specific waveform differs depending on the type of ink IK and the wavelength band of light. Since the first data is the sum or average in the first area, detailed information in the ±Z direction is lost, and it is difficult to estimate the liquid level position with high accuracy from only the first data. Similarly, highly accurate liquid level estimation using only the second data or the third data is not easy. In this respect, as described above, by obtaining the first to third data and comparing the relationships, it is possible to improve the estimation accuracy of the liquid level position, so that an appropriate reading area can be set. For example, the processing section 120 estimates the liquid level position based on the magnitude relationship between the first data to the third data, the ratio of the first data to the second data, the ratio of the first data to the third data, the ratio of the second data to the third data, and the like.

As illustrated in FIG. 23, the first area is an area including the position of the liquid level corresponding to the ink-low state, and the second area is an area including the position of the liquid level corresponding to the ink-full state. The processing section 120 may designate an area corresponding to any one of the first area, the second area, and the third area as a reading area based on the first data, the second data, and the third data.

In the example illustrated in FIG. 23, the detection area is covered by the first to third areas. Therefore, regardless of the position of the liquid level in the detection area, the liquid level position can be accurately determined by using any of the first to third areas as the reading area. When only the first area and the second area are set, when the liquid level is near the boundary between the first area and the second area, the actual liquid level may deviate from the reading area. However, by providing the third area, an appropriate reading area can be set even in such a case. Specifically, when the estimated position of the liquid level is below B4, the first area is set as the reading area. When the estimated position is between B4 and B5, the third area is set as the reading area. When the estimated position is above B5, the second area is set as the reading area. The actual reading area does not have to match any one of the first to third areas, and an area substantially equal to any one of the areas may be set as the reading area.

The processing flow in FIG. 23 is similar to that in FIG. 22. However, the first to third data are used as the low resolution pixel data (S201 and S202). Further, the estimation of the liquid level position is determined based on sets of the first to third data as described above (S203). The reading area is an area corresponding to any of the first to third areas (S204). The processing after the reading area determination is the same, and the processing section 120 executes the processing of determining the liquid level by using the data in which pixels are not thinned out in the reading area as high resolution pixel data.

Even when the method illustrated in FIG. 23 is used, it is possible to estimate an approximate liquid level position over the entire detection area and to determine a highly accurate liquid level position by setting an appropriate reading area. At that time, since the low resolution pixel data is used in the first reading and the reading area is limited in the second reading using the high resolution pixel data, the data amount can be reduced.

Note that, in FIG. 23, an example in which the three areas of the first to third areas are set as the detection area has been described. However, the processing of the present embodiment is not limited to this. For example, five areas of the first area to the fifth area may be set as the detection areas. The first area to the third area divides the detection area into three areas. For example, the first area is the first to 60th pixels, the second area is the 61st to 120th pixels, and the third area is the 121st to 180th pixels. The fourth area overlaps a part of the first area and a part of the second area, and the fifth area overlaps a part of the second area and a part of the third area. The fourth area is the 31st to 90th pixels, and the fifth area is the 91st to 150th pixels. The processing section 120 sets the area corresponding to any of the first area to the fifth area as the reading area based on the first to fifth data corresponding to the sum of the respective areas. Even in this case, it is possible to execute an appropriate ink amount detection processing while reducing the data amount. Further, the set area can be expanded to 2×j+1, j being an integer of 1 or more.

3.2.2 First Reading

The data amount reduction in the ink amount detection processing is not limited to the above method. For example, the processing section 120 determines the ink amount based on the low resolution pixel data output by the sensor 190 in the first reading area and the high resolution pixel data output by the sensor 190 in the second reading area other than the first reading area. In this way, by setting the area for outputting the low resolution pixel data and the area for outputting the high resolution pixel data respectively, the data amount can be reduced as compared with the case where the high resolution pixel data is used for all areas. Each of the first reading area and the second reading area is a part of the area that can be read by the sensor 190, and is a part of the detection area in a narrow sense. The second reading area is an area different from the first reading area, and is specifically an area that does not overlap the first reading area. More specifically, the second reading area is an area other than the first reading area in the area that can be read by the sensor 190 or the detection area.

Specifically, the sensor 190 outputs low resolution pixel data and high resolution pixel data by one time of reading. In this way, it is possible to shorten the time required for the ink amount detection processing as compared with the two-stage reading described above with reference to FIGS. 20 to 23.

Figure 24:
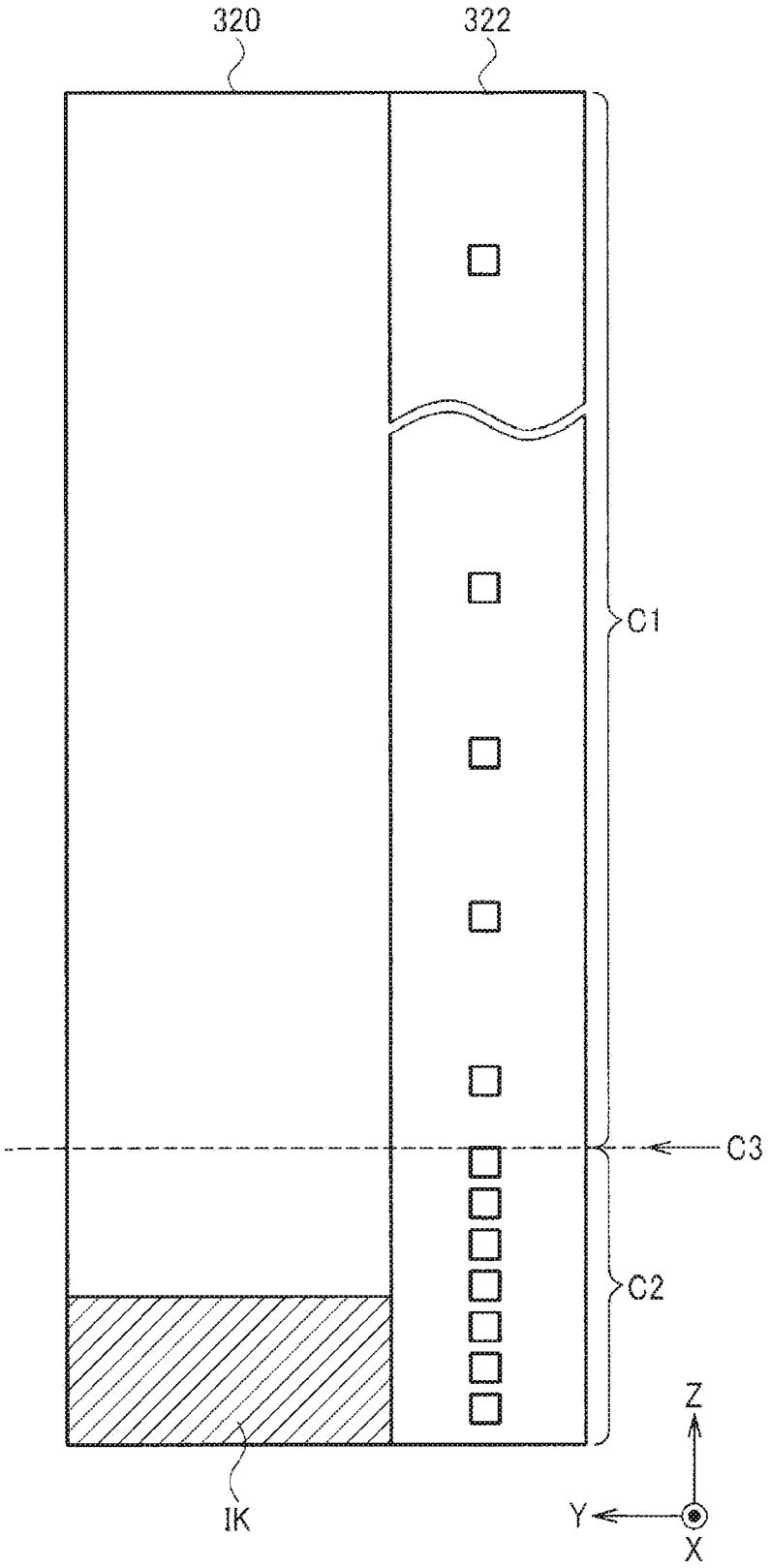
FIG. 24 is a diagram illustrating a setting example of a first reading area and a second reading area.

FIG. 24 is a setting example of the first reading area and the second reading area. C1 in FIG. 24 corresponds to the first reading area, and C2 corresponds to the second reading area. As illustrated in FIG. 24, the second reading area is an area including the position of the liquid level corresponding to the ink-low state. Here, the ink-low state represents a state where the ink IK in the ink tank 310 is smaller than a given amount, and in a narrow sense, corresponds to the minimum amount of the ink IK to be detected. The ink-low state is, for example, the ink end described above in FIG. 18. When the ink IK in the ink tank 310 is used up, the ink IK is not discharged onto the printing medium P, and there is a risk of waste paper. Further, since blanking occurs in the print head 107, which results in a head failure such as discharge failure. By setting the second reading area as illustrated in FIG. 24, it is possible to accurately detect the ink-low state by using the high resolution pixel data, and it is possible to suppress the waste paper and the head failure. Note that, as illustrated in FIG. 24, the high resolution pixel data is pixel data in which pixels are not thinned.

In addition, the processing section 120 may acquire pixel data obtained by thinning out the outputs from a part of photoelectric conversion elements of the plurality of photoelectric conversion elements as low resolution pixel data. For example, as in the example described above with reference to FIG. 21, the sensor 190 divides the pixels included in the first reading area into sections of predetermined number of pixels, leaves one pixel from each section, and thins out other pixels to output low resolution pixel data.

The processing section 120 performs processing of designating the first reading area and the second reading area for the sensor 190. In the example of FIG. 24, the processing section 120 designates the boundary pixel which is the boundary between the first reading area and the second reading area. The boundary in FIG. 24 corresponds to C3. For example, when the sensor 190 sequentially acquires pixel data from the lower side pixel to the upper side pixel, the processing section 120 outputs to the sensor 190 an instruction to output the pixel data from the first pixel to the boundary without thinning out, and for the pixels above the boundary, to output the low resolution pixel data in which a part of pixels are thinned out.

In this way, the sensor 190 can output appropriate low resolution pixel data and high resolution pixel data based on the instruction from the processing section 120. A fixed value may be used for the position of the boundary pixel and the ratio of pixels thinned out in the first reading area, and the processing section 120 may be able to dynamically change the value.

Figure 25:
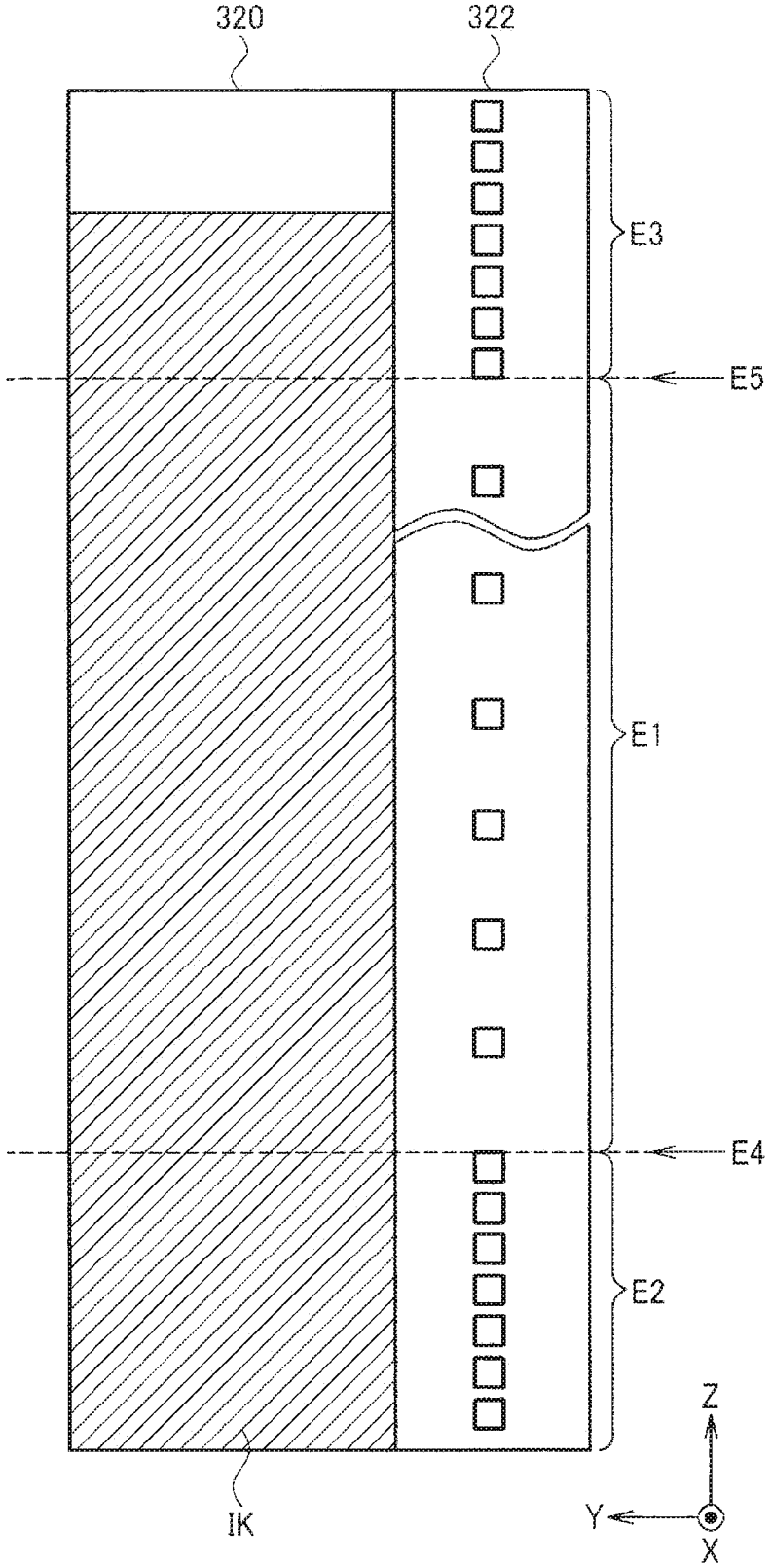
FIG. 25 is a diagram illustrating a setting example of a first reading area and a second reading area.

The setting of the first reading area and the second reading area is not limited to that illustrated in FIG. 24. In the example of FIG. 25, E1 corresponds to the first reading area, and E2 and E3 correspond to the second reading areas. The boundaries between the first reading area and the second reading areas are E4 and E5. As illustrated in FIG. 25, the second reading area is an area including the liquid level position corresponding to the ink-full state. Note that, FIG. 25 illustrates an example in which two areas of an area including the liquid level position corresponding to the ink-low state and an area including the position of the liquid level corresponding to the ink-full state are set as the second reading area.

The ink-full state represents a state in which the ink amount is sufficiently large, and in a narrow sense, the ink-full state represents the maximum amount of ink IK to be detected. More specifically, the ink-full state is a state in which the ink amount is close to the maximum value of the capacity of the ink tank 310. When the user further replenishes the ink IK from the ink-full state, the ink overflows from the ink tank 310, which may cause stains or malfunction inside the printer. Therefore, when the ink-full state is detected, the processing section 120 may perform notification processing for suppressing further ink replenishment. By setting the area including the liquid level position corresponding to the ink-full state as the second reading area, it is possible to increase the detection accuracy of ink-full state, so that the overflow of the ink can be appropriately suppressed.

As illustrated in FIGS. 24 and 25, it is possible to reduce the data amount by setting the relatively important area as the second reading area and the less important area as the first reading area. In addition, an important state in controlling the printer, such as ink-low state or ink-full state, can maintain the detection accuracy of the same level as when the data amount is not reduced.

3.2.3 Processing Using Results of Past Ink Amount Detection Processing

In the above, various methods capable of reducing the data amount in one ink amount detection processing have been described. In the present embodiment, it is assumed that the ink amount detection processing is repeatedly executed. This is for appropriately detecting the fluctuation, because the ink amount fluctuates with the lapse of time. The fluctuation of the ink amount can be considered to be a decrease due to the execution of printing or maintenance, or an increase due to the user replenishing the ink IK.

However, it is possible to predict the fluctuation of the ink amount to some extent. For example, the consumption of the ink IK for printing can be estimated by the product of the number of times the ink IK is discharged from the nozzle and the discharge amount per one time. Further, the amount of ink IK consumed by one flushing or cleaning can be estimated in advance based on the design. Therefore, the processing section 120 can estimate the current ink amount based on the ink amount determined by the previous ink amount detection processing and the execution status of printing or maintenance from the previous ink amount detection processing to the present. Alternatively, in order to reduce the processing load, simple ink amount estimation may be performed based on the result of the previous ink amount detection processing and the elapsed time. In order to further simplify the processing, it is also possible to use the result of the previous ink amount detection processing as it is as the estimated amount of the current ink amount.

In this case, the ink amount can be appropriately determined by intensively searching the area including the liquid level position corresponding to the estimated amount of the ink IK. For example, the processing section 120 designates the first reading area and the second reading area for the sensor 190 based on the predicted ink amount.

Specifically, the processing section 120 sets an area including the liquid level position corresponding to the estimated ink amount as the second reading area. For example, an area of a given pixel range with the estimated liquid level position as the center is set as the second reading area. The processing section 120 sets the area other than the second reading area in the detection area as the first reading area.

Figure 26:
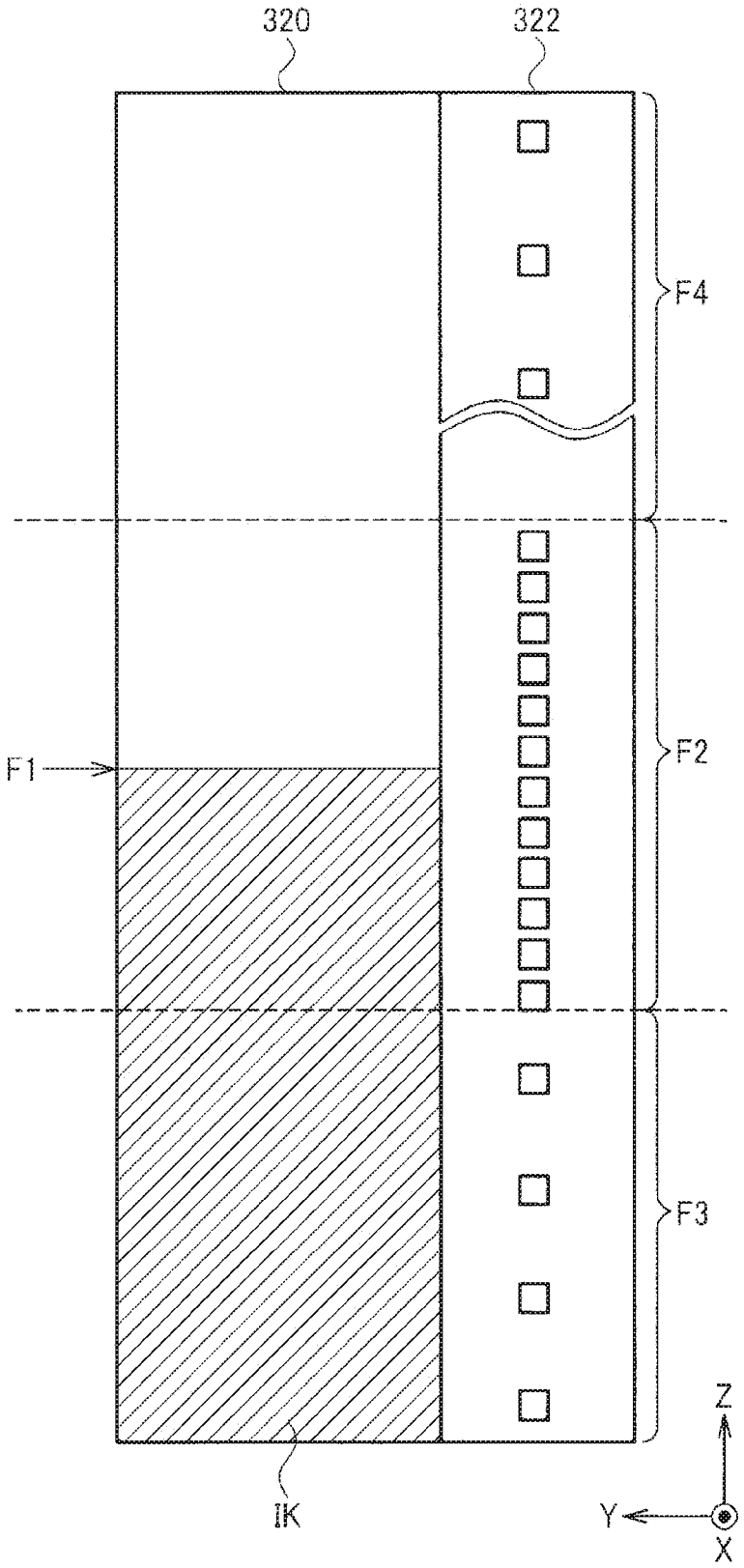
FIG. 26 is a diagram illustrating a setting example of a first reading area and a second reading area.

FIG. 26 is a diagram illustrating an example of area designation based on the predicted amount of ink. F1 in FIG. 26 is the liquid level position corresponding to the predicted amount. In this case, the processing section 120 performs, on the sensor 190, the designation of F2, which is an area including F1, as the second reading area, and the designation of the other F3 and F4 as the first reading areas. In this way, it is possible to read a highly probable area where the liquid level exists with high accuracy. Further, since the determination using the low resolution pixel data is performed for the area other than the second reading area, even when the ink amount fluctuates more than expected, it is possible to follow the fluctuation. For example, when the user replenishes the ink IK, the ink amount will increase rapidly, but in that case as well, the ink level can be estimated.

Alternatively, the first reading area may not be used in consideration of reducing the load of the ink amount detection processing and increasing the speed. Specifically, when the predicted amount of the ink amount can be acquired, the processing section 120 acquires high resolution pixel data for only a part of the detection area, as in the two-stage reading illustrated in FIG. 21. For the other areas of the detection area, not only the high resolution pixel data is not acquired, but also the acquisition of the low resolution pixel data is omitted. However, in this case, when the actual liquid level exists other than the reading area, the ink amount cannot be appropriately detected. Therefore, when the processing section 120 determines that the liquid level exists outside the reading area, the processing section 120 performs the ink amount detection processing again using any of the methods illustrated in FIGS. 20, 21, and 23 to 25. That is, the processing section 120 may perform the ink amount detection processing for the entire detection area when the ink amount is not detected or when the ink amount cannot be appropriately tracked, and may perform the ink amount detection processing for a part of the detection area in other situations.

3.2.4 Additive Reading

Note that, it is also possible to combine the method of reducing the data amount described above and the method of reducing the light amount unevenness described above with reference to FIGS. 15 and 16.

The processing of obtaining the sum of the outputs of k continuous pixels may be performed by the processing section 120. In this case, the processing section 120 performs processing of obtaining the sum of k pieces of pixel data corresponding to the k continuous pixels out of the pixel data acquired from the sensor 190. When the low resolution pixel data is data obtained by thinning out a part of pixels, the low resolution pixel data may not have pixel data corresponding to k continuous pixels. Therefore, in this case, the processing section 120 performs processing of obtaining the sum of k pieces of pixel data corresponding to k continuous pixels for the high resolution pixel data. Alternatively, low resolution pixel data may be used such that k continuous pixels remain after thinning. For example, in FIG. 20, the thinning-out is performed so that not only the first pixel, the 19th pixel, the 37th pixel, . . . , and the 163rd pixel are left, but also the first to third pixels, the 19th to 21st pixels, the 37th to 39th pixels, . . . , and the 163rd to 165th pixels are left. The processing section 120 transmits to the sensor 190 an instruction to output the pixel data of the above pixels.

Alternatively, the processing of obtaining the sum of the outputs of the k continuous pixels may be performed by the sensor 190, or in a narrow sense, may be performed by the photoelectric conversion device 322 as illustrated in FIG. 16. In this case, the AFE circuit 130 receives the output signal OS including q/k signals. For example, as described above, q=180 and k=3, and the AFE circuit 130 can acquire 60 pieces of pixel data.

In this case, it is possible to perform the same processing as in the above example by assuming that the number of pixels corresponding to the detection area is changed to 60 instead of 180. For example, in a first-stage reading illustrated in FIG. 20, a part of the 60 pixels are thinned out. For example, the AFE circuit 130 outputs low resolution pixel data by leaving one pixel out of six pixels and thinning out five pixels. In a two-stage reading illustrated in FIG. 21, high resolution pixel data is output by using the pixels in the reading area without thinning out. For example, in the example of FIG. 21, which does not consider the light amount unevenness, pixel data for a sum of 55 pixels, that is, four pixels of a (t−1)-th pixel, a t-th pixel, a (t+1)-th pixel, and a (t+2)-th pixel in addition to 17×3=51 pixels between them, was acquired as high resolution pixel data. In the modification, in addition to the four pixels of the (t−1)-th pixel, the t-th pixel, the (t+1)-th pixel, and the (t+2)-th pixel, 5×3=15 pixels between them may be set as the reading area, and the high resolution pixel data is the pixel data for the 19 pixels. The same applies to the cases of FIGS. 24 to 26. In the first reading area, low resolution pixel data is output by thinning out five pixels out of six pixels, and in the second reading area, high resolution pixel data is output by not thinning out pixels in the area. The method illustrated in FIG. 23 is the same as the above example except that each of the first to third areas is an area for 30 pixels.

That is, also when suppressing the light amount unevenness, as in the example of FIGS. 20 to 23, the processing section 120 estimates the position of the liquid level of the ink IK based on the low resolution pixel data output by the sensor 190, and designates the area including the estimated position of the liquid level as the reading area. Then, the processing section 120 determines the ink amount based on the high resolution pixel data in the reading area output from the sensor 190. Alternatively, as in the examples of FIGS. 24 to 26, the processing section 120 determines the ink amount based on the low resolution pixel data output by the sensor 190 in the first reading area and the high resolution pixel data output by the sensor 190 in the second reading area other than the first reading area.

When acquiring the low resolution pixel data, the processing section 120 may control the sensor 190 to output pixel data corresponding to the sum of the outputs of k continuous pixels. Specifically, the low resolution pixel data here is pixel data obtained by thinning out the outputs from a part of the photoelectric conversion elements out of the plurality of photoelectric conversion elements. That is, the low resolution pixel data is pixel data acquired by thinning out a part of the pixels.

When pixels are thinned out, information on the thinned pixels is lost. When the outputs of the k continuous pixels are not summed, for example, 17 pixels out of 18 pixels are thinned out as described above. Since the ratio of the remaining pixels is small, when the pixel data of the remaining pixels include noise, the influence of the noise on the ink amount detection processing becomes large. On the other hand, when the sensor 190 obtains the sum of the k continuous pixels, the pixel data output from the sensor 190 includes information for k pixels. For example, when outputting 10 pieces of pixel data as the low resolution pixel data in the same example as in FIG. 20, the first pixel data corresponds to the sum of the first pixel to the third pixel. Therefore, even when noise is included in the pixel data of the first pixel, the influence of the noise can be suppressed by using the pixel data of the second pixel and the third pixel. That is, by performing the processing for suppressing the light amount unevenness, it is possible to suppress the influence of noise different from the light amount unevenness. It can be said that the processing of suppressing the light amount unevenness is particularly effective when the low resolution pixel data in which the weight per pixel becomes large is acquired.

4. Ink Type Determination

Further, in the present embodiment, the processing section 120 may determine the ink type of the ink IK in the ink tank 310 based on the output of the sensor 190.

4.1 Overview of Ink Type Determination

As described above with reference to FIGS. 2 and 3, the electronic apparatus 10 may include a plurality of ink tanks 310 filled with different kinds of ink IK. In this case, there is a possibility that the user erroneously fills another ink tank 310 such as the ink tank 310*b* with the ink IKa to be filled in the ink tank 310*a*. Even when the electronic apparatus 10 is a monochrome printer having one ink tank 310, when the user uses printers of different models together, there is a possibility that the ink IK used for another printer is erroneously filled. Furthermore, even when the user uses only one monochrome printer, since many different inks are distributed in the market depending on the model, the possibility that the user erroneously purchases and fills ink for the different model cannot be denied.

For example, when the ink tank 310 to be filled with yellow ink is filled with magenta ink, the color of the printing result largely deviates from the desired color. That is, in order to perform appropriate printing, it is necessary to appropriately detect the error of the ink color. Therefore, the processing section 120 determines the ink color as the ink type.

Figure 27:
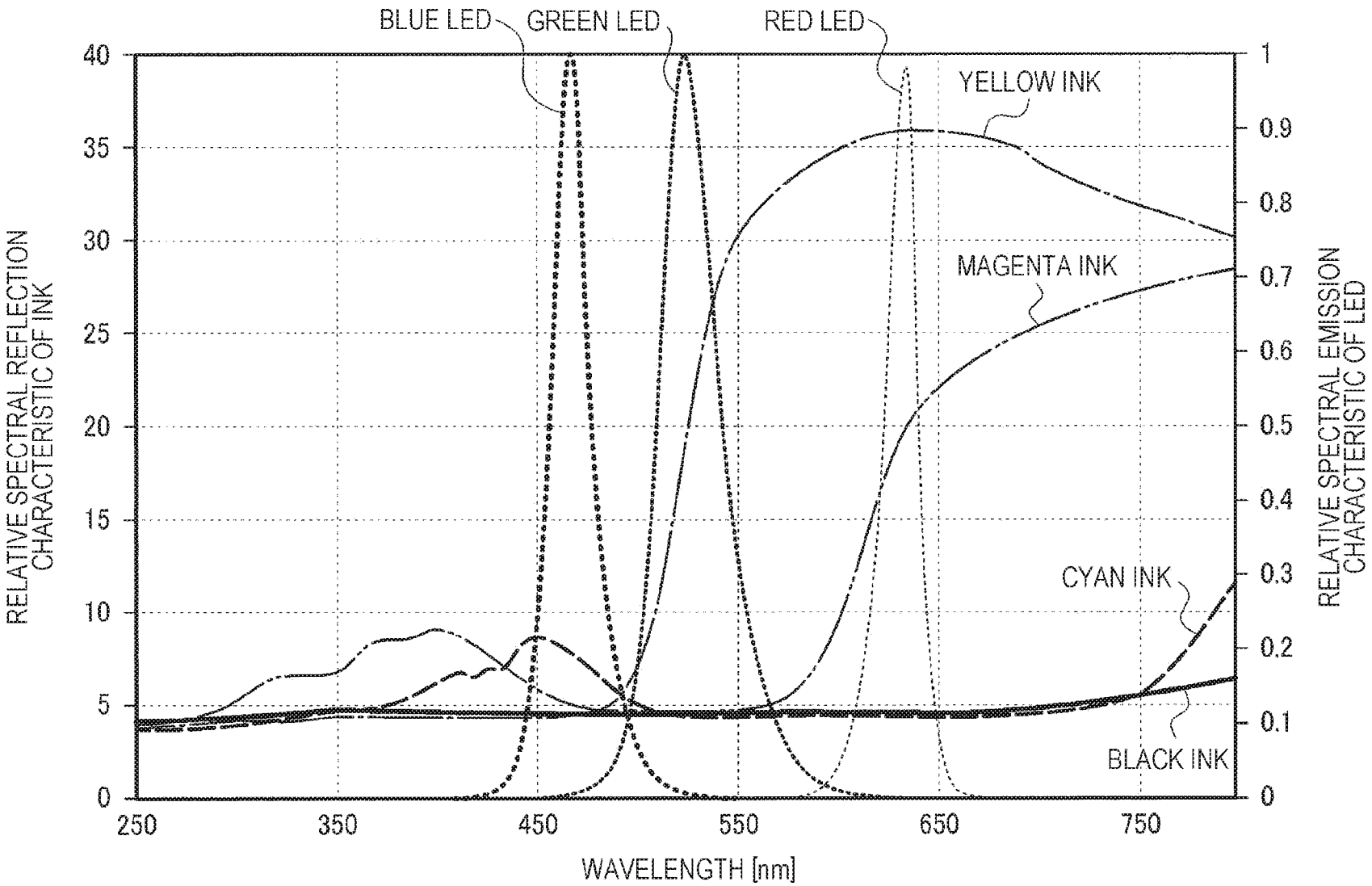
FIG. 27 is a diagram illustrating an example of a spectral emission characteristic of a light source and a spectral reflection characteristic of ink.

FIG. 27 is a diagram for explaining the spectral emission characteristic of the light emitted to the ink IK and the spectral reflection characteristic of the ink IK. The horizontal axis of FIG. 27 represents a wavelength, and the vertical axis represents the spectral emission characteristic or the spectral reflection characteristic.

In the present embodiment, the ink IK is irradiated with R light corresponding to a red color, G light corresponding to a green color, and B light corresponding to a blue color. For example, the wavelength band of B light is approximately 430 to 500 nm, the wavelength band of G light is approximately 500 to 600 nm, and the wavelength band of R light is approximately 600 to 650 nm. However, various modifications can be made to the wavelength band of each light, a peak wavelength, a half width, and the like.

Further, as illustrated in FIG. 27, the spectral reflection characteristic differs depending on the color of the ink IK. For example, black ink has a low reflectance in a wide wavelength band corresponding to RGB. The yellow ink has a low reflectance in the wavelength band of B light, and has a very high reflectance in the wavelength bands of G light and R light. The magenta ink has a low reflectance in the wavelength bands of B light and G light and a high reflectance in the wavelength band of R light. The cyan ink has a slightly high reflectance in the wavelength band of B light and a low reflectance in the wavelength bands of G light and R light.

When the input of the photoelectric conversion element is D, the spectral emission characteristic of the irradiation light is S (λ), and the spectral reflection characteristic of the ink IK is R (λ), D is represented by the following formula (1), for example. Since D is the result of receiving light from the area where the ink IK exists, the pixel data in the ink detection area has a value that correlates with D and a spectral sensitivity characteristic of the photoelectric conversion element. As described above, since the spectral reflection characteristic R (λ) in the wavelength band of RGB varies depending on the ink color, the characteristic of the pixel data in the ink detection area varies depending on the ink color.

FIGS. 28 to 33 illustrate waveforms representing pixel data of pigment ink for each ink color. Similar to the example illustrated in FIG. 17, the horizontal axis of each drawing represents a position of the photoelectric conversion device 322 in the longitudinal direction, and the vertical axis represents a value of pixel data corresponding to the photoelectric conversion element provided at the position. The vertical line in each drawing represents a position of the liquid level of the ink IK when pixel data is measured. For example, for the black ink of FIG. 28, the liquid level exists at the position around 7.3.

Figure 28:
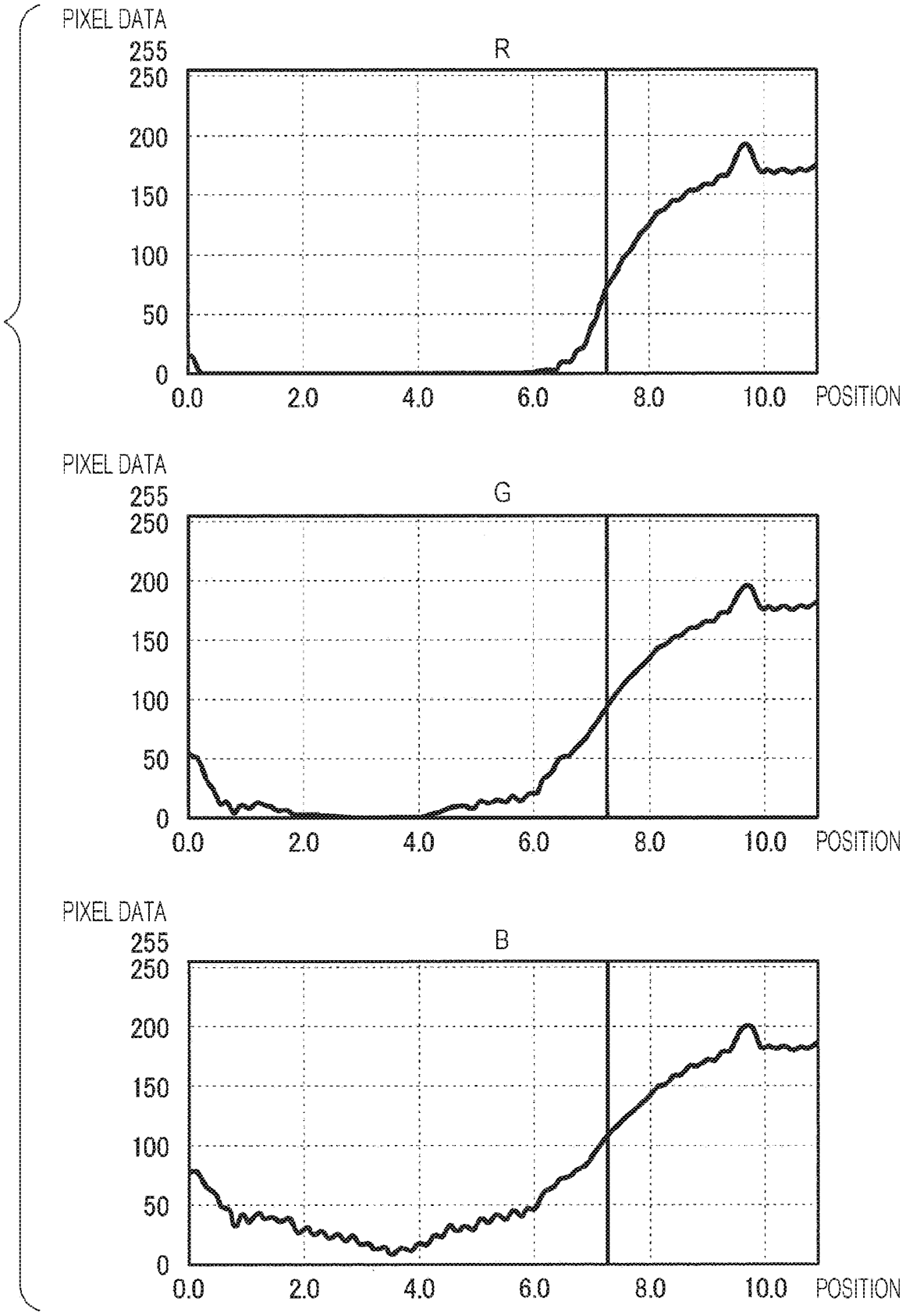
FIG. 28 is a diagram illustrating an example of pixel data of black pigment ink.

FIG. 28 represents pixel data of black ink. As illustrated in FIG. 28, the pixel data of black ink is 0 or a small value that is sufficiently close to 0 in the ink detection area below the liquid level, regardless of which of the RGB light is received. Further, in the ink non-detection area, pixel data has a large value of about 200. Note that, the pixel data values in the ink non-detection area are not significantly affected by the type of the ink IK, and therefore the description regarding the ink non-detection area will be appropriately omitted in FIG. 29 and the subsequent drawings.

Figure 29:
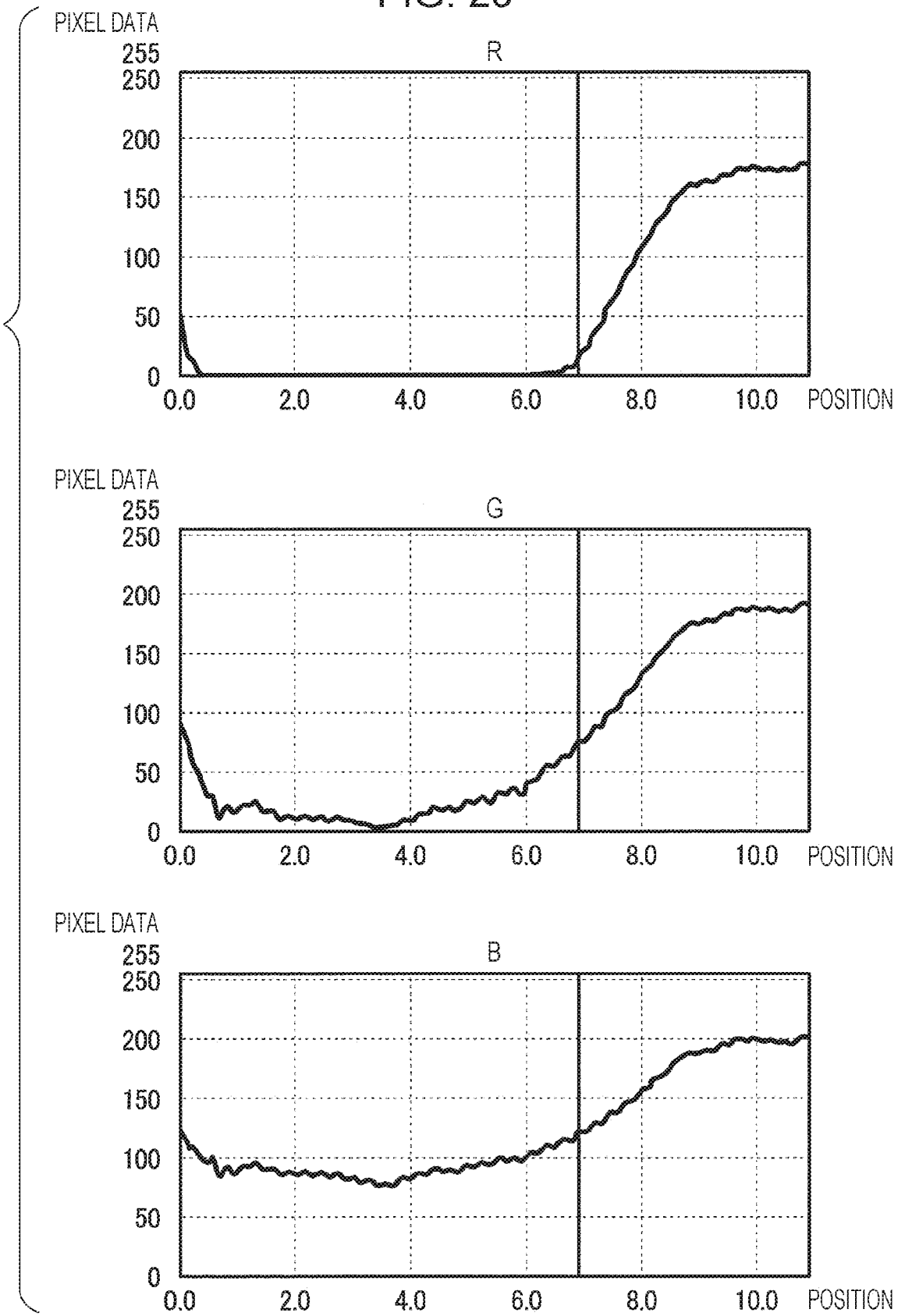
FIG. 29 is a diagram illustrating an example of pixel data of pigment cyan ink.

FIG. 29 represents pixel data of cyan ink. As illustrated in FIG. 29, the pixel data for R light and G light of cyan ink is 0 or a small value that is sufficiently close to 0 in the ink detection area. On the other hand, the pixel data for B light has a value of about 100 in the ink detection area. That is, the pixel data for B light in the ink detection area is small enough to be distinguished from the ink non-detection area, but has a value sufficiently greater than 0.

Figure 30:
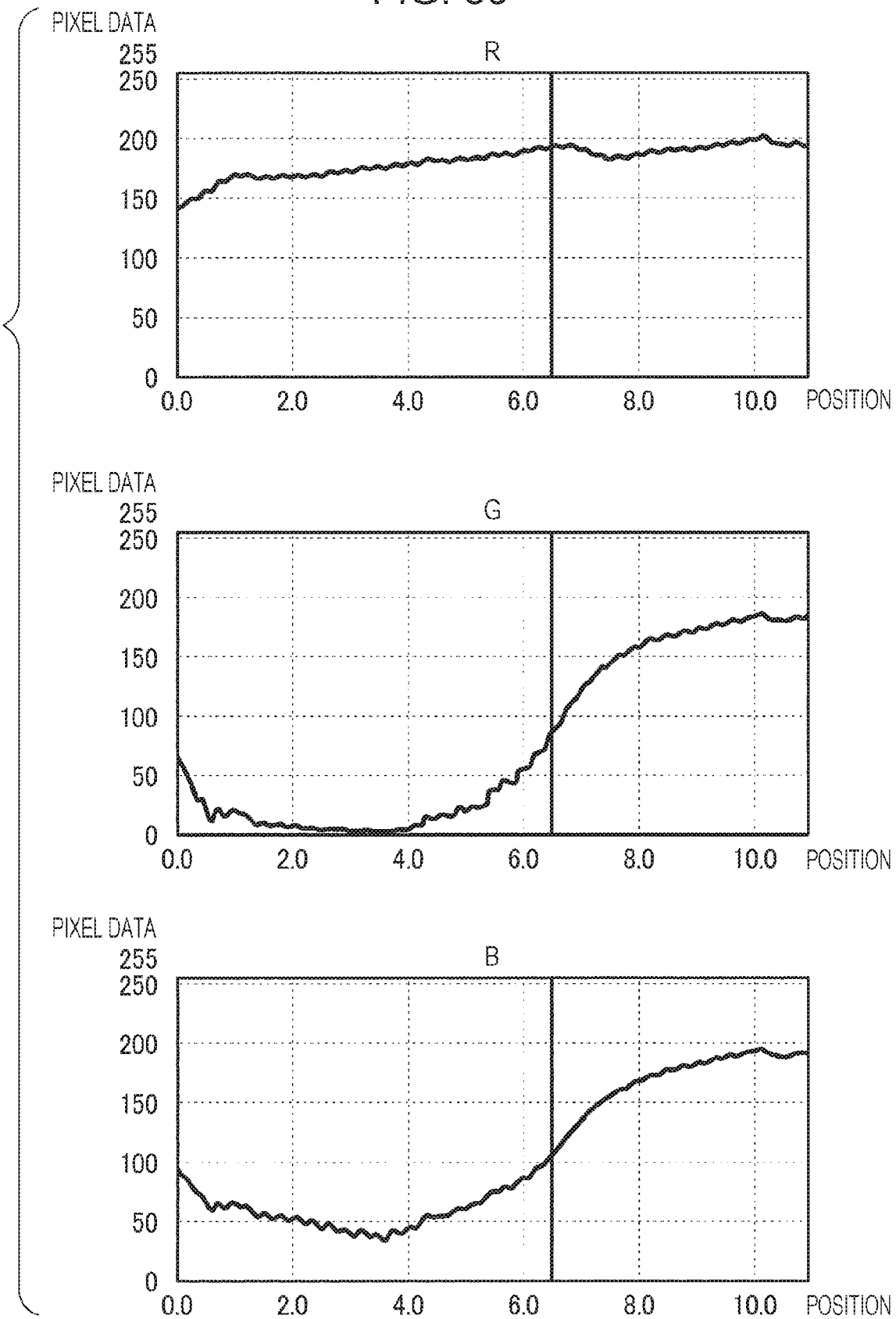
FIG. 30 is a diagram illustrating an example of pixel data of pigment magenta ink.

FIG. 30 represents pixel data of magenta ink. As illustrated in FIG. 30, the pixel data for R light of magenta ink is about 170 to 200 in the ink detection area. The pixel data for G light has a small value that is sufficiently close to 0 in the ink detection area. The pixel data for B light has a value of about 50 or smaller in the ink detection area.

Figure 31:
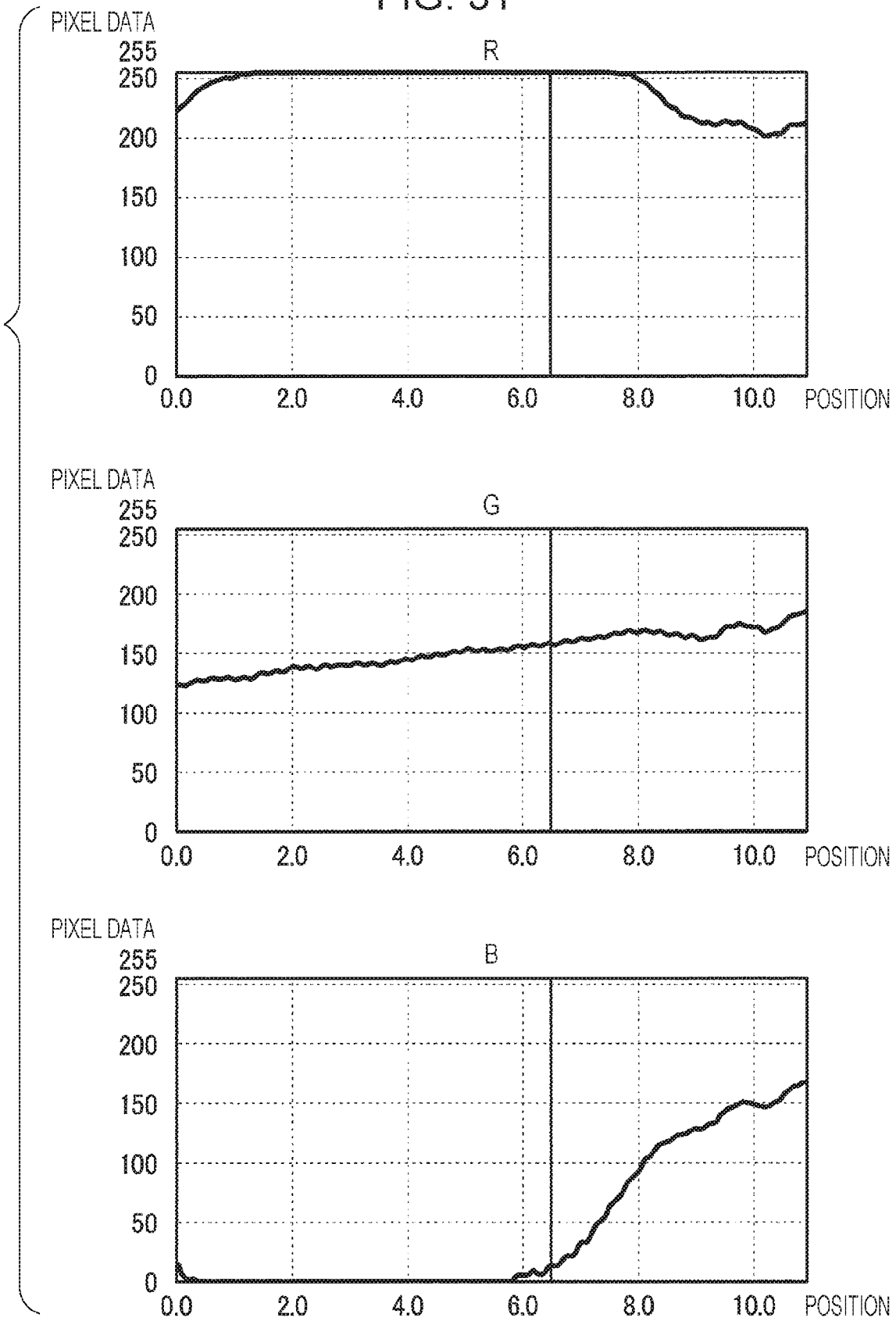
FIG. 31 is a diagram illustrating an example of pixel data of pigment yellow ink.

FIG. 31 represents pixel data of yellow ink. As illustrated in FIG. 31, the pixel data for R light of yellow ink has a value close to 255 in the ink detection area. The pixel data for G light has a value of around 150 in the ink detection area. The pixel data for B light has a small value that is sufficiently close to 0 in the ink detection area.

Further, in the present embodiment, the white ink and the clear ink may be targets of ink color determination. White ink is ink having a white color, and is used as a base when printing on a transparent material, for example. The clear ink is a transparent or semi-transparent ink that transmits light, and is used for the purpose of giving gloss to the printing medium P, changing the texture, giving a thickness, and the like.

Figure 32:
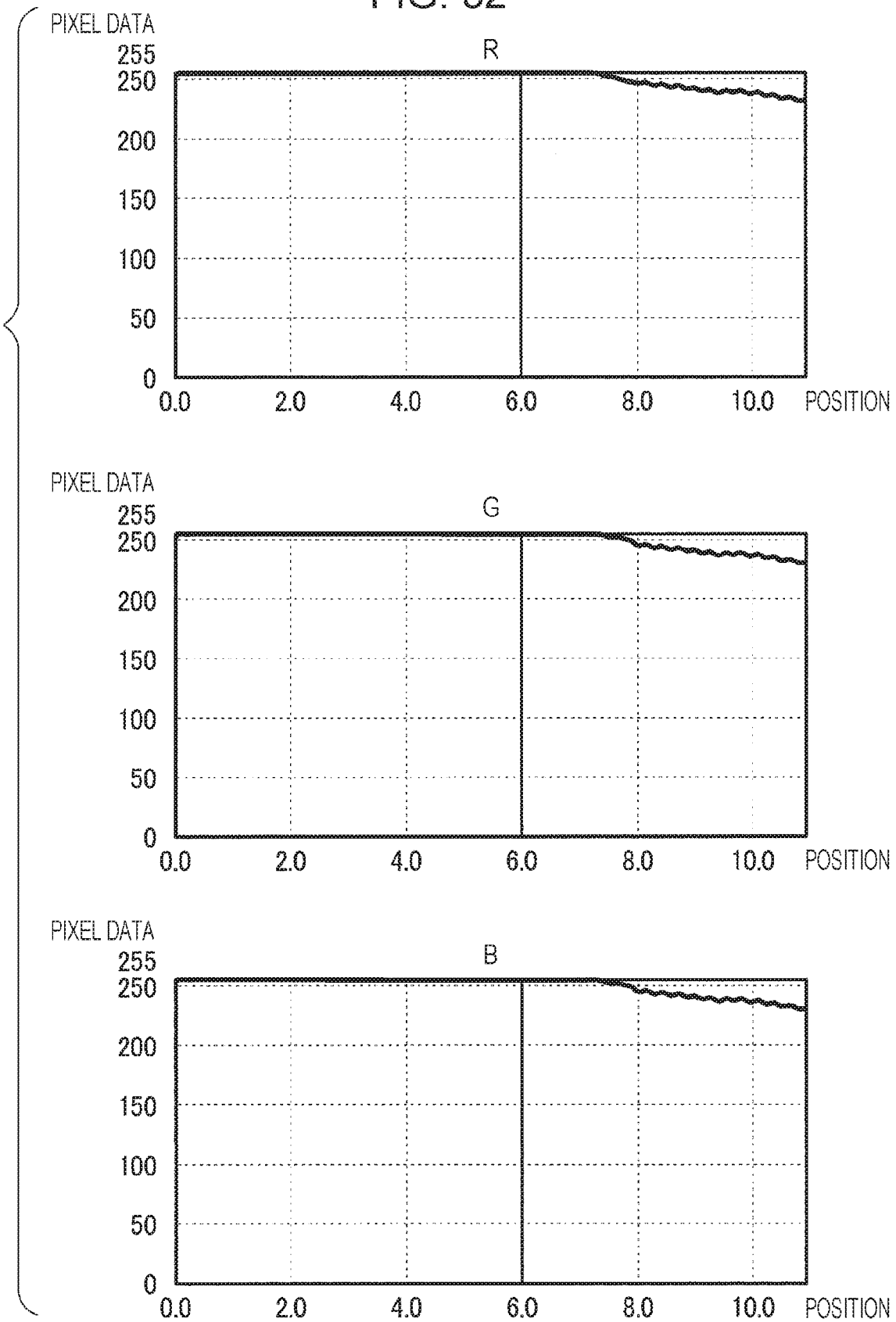
FIG. 32 is a diagram illustrating an example of pixel data of pigment white ink.

FIG. 32 represents pixel data of white ink. The area where the white ink exists becomes whiter than the wall surface color of the ink tank 310 in the ink non-detection area. Therefore, as illustrated in FIG. 32, the pixel data in the ink detection area of the white ink has a greater value than that in the ink non-detection area regardless of which of the RGB light is received. Specifically, the pixel data of white ink has a value close to 255 in the ink detection area.

Figure 33:
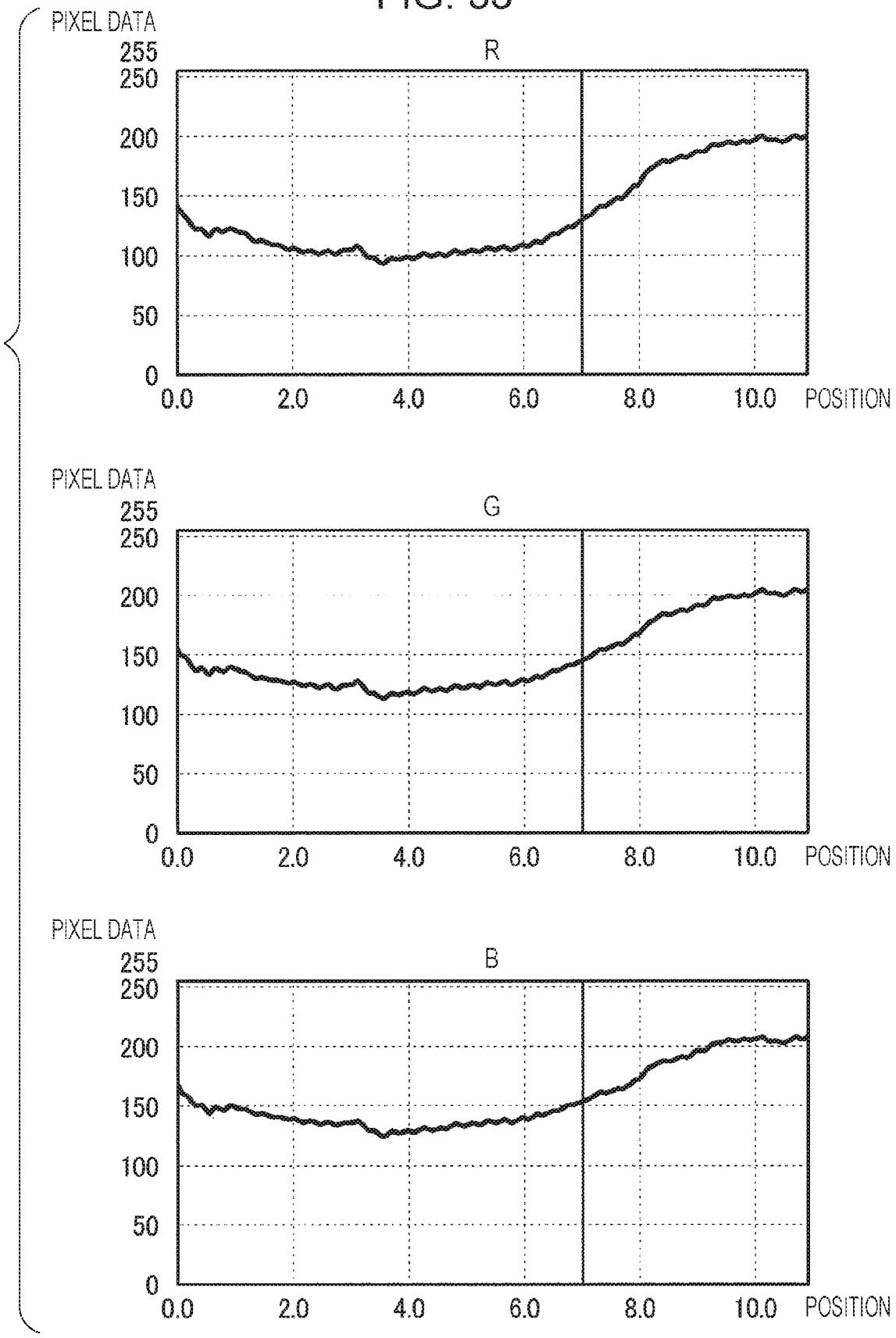
FIG. 33 is a diagram illustrating an example of pixel data of pigment clear ink.

FIG. 33 represents pixel data of clear ink. As illustrated in FIG. 33, the pixel data of the clear ink has a value of about 100 to 150 regardless of which of the RGB light is received.

As illustrated in FIGS. 27 to 33, due to the difference in the spectral reflection characteristic, the characteristic of the pixel data in the ink detection area is different for each ink color. As in the R light of the black ink and the R light of the cyan ink, the characteristic difference of the pixel data may be small depending on the color of the light, but the ink color can be determined by combining the light of a plurality of colors. For example, when distinguishing between black ink and cyan ink, B light may be used.

The sensor 190 of the present embodiment detects first light of a first wavelength band and second light of a second wavelength band that are incident from the ink tank 310 side in a period during which the light source 323 emits light. The processing section 120 determines the ink type of the ink IK in the ink tank 310 based on a first light amount of the first light at the position where the ink IK exists and a second light amount of the second light at the position where the ink IK exists. The processing section 120 acquires the first light amount and the second light amount from the sensor 190.

The first light amount and the second light amount are specifically pixel data in the ink detection area. The first light amount and the second light amount are, for example, the minimum values of pixel data in the ink detection area. However, as the first light amount and the second light amount, other information such as the average value or the median value of the pixel data in the ink detection area may be used. Further, the first wavelength band and the second wavelength band may be different from each other to the extent that there is a difference in the spectral reflection characteristic of the ink IK, and it is not prevented that the parts of them overlap.

In this way, it is possible to appropriately determine the ink type by using the light of a plurality of wavelength bands. For example, the black ink has a different B light amount when compared with the cyan ink. Further, the black ink has a different R light amount when compared with the magenta, yellow, white, and clear inks. That is, by using the R light and the B light, it is possible to distinguish the black ink from other inks.

The processing section 120 of the present embodiment may perform the ink color determination of the pigment ink based on the first light amount and the second light amount. This is because, as illustrated in FIGS. 28 to 33, the pigment ink has different spectral reflection characteristic depending on the ink color, and therefore the output of the sensor 190 for each ink color differs to the extent that the ink color can be identified. In this way, it becomes possible to appropriately detect the erroneous insertion of the pigment ink.

Hereinafter, an example in which the ink type determination is a pigment ink color determination will be described. However, even for the pigment ink having the same color, the color material used differs depending on the manufacturer, model number, and the like, and therefore, the characteristics of the light amount in the ink detection area are different. Here, the difference in the color material may be a difference in the substance itself as a material or a difference in the compounding ratio of a plurality of materials. For example, the waveform illustrated in FIG. 28 is a characteristic of a given black pigment ink, and the waveform is different for black pigment inks having different color materials. By using the difference in the waveform, it is possible to determine the difference in the type of the ink having the same color. In addition, since the pigment ink and the dye ink have different color materials, there is a difference in waveform even for the same color. That is, the ink type determination in the present embodiment is not limited to the pigment ink color determination, and can be extended to the determination of the ink type including the coloring material and the like.

The light source 323 of the present embodiment may emit the first light and the second light. For example, the light source 323 includes a plurality of light sources such as a red LED 323R, a green LED 323G, and a blue LED 323B that have different wavelength bands of light to be emitted. Alternatively, the light source 323 may include a color filter, and by switching the color filter, the first light and the second light may be emitted in a time-division manner. The first light amount is an output of the sensor 190 when the light source 323 emits the first light, and the second light amount is an output of the sensor when the light source 323 emits the second light. In this way, the ink type can be appropriately determined by using the light source 323 that can emit light of different wavelength bands.

However, in the ink type determination of the present embodiment, it is sufficient as long as the sensor 190 can receive a plurality of lights having different wavelength bands. For example, the light source 323 emits light having a wide wavelength band, for example, white light, and the sensor 190 receives the first light and the second light by using a color filter. In this case, the color filter includes an R filter, a G filter, and a B filter having a spectral transmission characteristic equivalent to the spectral emission characteristic of FIG. 27. Alternatively, the sensor 190 may have a configuration in which a photoelectric conversion device 322 that receives the first light and a photoelectric conversion device 322 that receives the second light are provided, the first light and the second light are separated by using a prism or a half mirror, and each separated light is made incident on the corresponding photoelectric conversion device 322.

The sensor 190 may also detect light of a third color. The processing section 120 detects the ink type based on a third light amount of the light of the third color, the first light amount, and the second light amount. By increasing the types of light used, more detailed ink type determination can be performed. For example, it is possible not only to determine whether the ink IK to be determined is black ink, but also to determine what color the ink IK is. As can be seen from the above description, the ink color determination of the present embodiment may be a determination of whether the ink IK to be determined is a correct color, or a determination of specifying the color of the ink IK.

Hereinafter, an example in which the first light, the second light, and the third light are R light corresponding to the red wavelength band, G light corresponding to the green wavelength band, and B light corresponding to the blue wavelength band will be described. The first light and the second light are any two of the R light, the G light, and the B light, and the combination of the lights when the ink type determination is performed based on the two lights is optional.

The processing section 120 determines the ink type based on the R light amount representing the amount of the R light incident on the sensor 190, the G light amount representing the amount of the G light incident on the sensor, and the B light amount representing the amount of the B light incident on the sensor. Hereinafter, an example in which each light amount is the minimum value of the pixel data will be described, but as described above, the data representing the light amount can be variously modified.

In this way, the ink type can be determined using the lights of the three colors of RGB. As illustrated in FIGS. 28 to 33, the characteristics of the light amounts of the three colors are different depending on the ink color, and therefore, an appropriate determination can be made. Further, since the combination of the three colors of RGB corresponds to white light, it is widely used in forming images with natural colors. That is, in the ink type determination of the present embodiment, it is possible to use the photoelectric conversion device 322 and the light source 323 used for the scanner or the like.

However, as can be seen from FIG. 27, the wavelength band in which the spectral reflection characteristic differs depending on the ink color is not limited to the wavelength band of RGB. Therefore, the light used for determining the ink type can be expanded to other lights such as V light corresponding to purple, ultraviolet light, and infrared light. Further, the number and type of light used can be appropriately selected depending on which ink needs to be distinguished from which ink. For example, only one type of white light may be used, or in addition to RGB, infrared light and orange light may be added to use five types of lights. When fluorescent ink is used, in addition to or instead of the spectral reflection characteristic of the ink, the spectral fluorescence characteristic can be used for discrimination. In this case, it is desirable that the sensor 190 can detect that the wavelength band of light incident on the ink tank is different from the wavelength band of light incident on the sensor, by using a color filter.

4.2 Determination Processing for Each Ink Color

At the position where the ink IK exists, the processing section 120 determines that the ink IK is black ink when the R light amount is equal to or less than a threshold $Th_{Bk_R}$, the G light amount is equal to or less than a threshold $Th_{Bk_G}$, and the B light amount is equal to or less than a threshold $Th_{Bk_B}$.

As illustrated in FIG. 28, when the black ink is a target, all the light amounts of RGB in the ink detection area have sufficiently small values. Therefore, it is possible to determine whether the ink is black ink by determining whether it is equal to or less than a given threshold. Each threshold here needs to be greater than a value assumed for black ink. However, in order to prevent the erroneous determination that the ink IK having another color is black ink, it is not desirable to make the values too large than the value assumed for the black ink. For example, each threshold is set to a value that is greater than the assumed value by Δ. The specific value of Δ may be variously modified, but is, for example, about 20 to 60. Further, the value of Δ may be changed in each of RGB. For example, ($Th_{Bk_R}$, $Th_{Bk_G}$, $Th_{Bk_B}$)=(50, 50, 50). By performing the determination using such a threshold, it is possible to appropriately determine, for example, cyan ink having similar characteristics.

The light amount in the ink detection area in the present embodiment may be the pixel data itself in the ink detection area, or may be a difference between the pixel data based on the ink non-detection area. As described above, the pixel data in the ink non-detection area is information corresponding to the wall surface of the ink tank 310, and the influence of the type of ink IK is small. Therefore, the light amount in the ink detection area may be calculated with reference to the light amount in the ink non-detection area. In this case, the determination as to whether or not the light amount in the ink detection area is equal to or less than the threshold can be realized by determining whether the differential value of the pixel data is equal to or more than the predetermined threshold. That is, the magnitude relationship in the threshold determination can be changed appropriately according to the expression of the light amount.

Further, at the position where the ink IK exists, the processing section 120 determines that the ink IK is cyan ink when the R light amount is equal to or less than a threshold $Th_{C_R}$, the G light amount is equal to or less than a threshold $Th_{C_G}$, and the B light amount is greater than a threshold $Th_{C_B}$. Similarly to the example of the black ink, $Th_{C_R}$ and $Th_{C_G}$ are set to values greater than the assumed value of the light amount by A. Further, the threshold value $Th_{C_B}$ is set to a value that is smaller than the assumed value of the light amount by Δ. For example, ($Th_{C_R}$, $Th_{C_G}$, $Th_{C_B}$)=(50, 50, 50).

Further, at the position where the ink IK exists, the processing section 120 determines that the ink IK is magenta ink when the R light amount is greater than a threshold $Th_{M_R}$, the G light amount is equal to or less than a threshold $Th_{M_G}$, and the B light amount is equal to or less than a threshold $Th_{M_B}$. For example, ($Th_{M_R}$, $Th_{M_G}$, $Th_{M_B}$)=(130, 50, 70). Note that, in consideration of sharing the determination with another ink color, $Th_{M_B}$=50 may be used.

Further, at the position where the ink IK exists, the processing section 120 determines that the ink is yellow ink when the R light amount is greater than the threshold $Th_{Y_R}$, the G light amount is greater than the threshold $Th_{Y_G}$, and the B light amount is equal to or less than the threshold $Th_{Y_B}$. For example, ($Th_{Y_R}$, $Th_{Y_G}$, $Th_{Y_B}$)=(220, 100, 50).

In addition, the processing section 120 determines that the ink IK is white ink, in at least two of the R light amount, the G light amount, and the B light amount, when the light amount at the position where the ink IK exists is greater than the light amount at the position where the ink IK does not exist. In this case, the processing section 120 obtains the value of the light amount in the ink non-detection area as a reference value, and determines whether the light amount exceeds the reference value at a position on the −Z side.

It should be noted that instead of actually measuring the reference value, a value assumed from the design may be set in advance. For example, the processing section 120 determines that the ink IK is white ink when the R light amount is greater than a threshold $Th_{W_R}$, the G light amount is greater than a threshold $Th_{W_G}$, and the B light amount is greater than a threshold $Th_{W_B}$. For example, ($Th_{Y_R}$, $Th_{Y_G}$, $Th_{Y_B}$)=(220, 220, 220).

Further, at the position where the ink IK exists, the processing section 120 determines that the ink IK is clear ink when the R light amount is greater than a threshold $Th_{CL_R}$, the G light amount is greater than a threshold $Th_{CL_G}$, and the B light amount is greater than a threshold $Th_{CL_B}$. For example, ($Th_{CL_R}$, $Th_{CL_G}$, $Th_{CL_B}$)=(50, 50, 50).

Since the white ink also satisfies the condition, it is desirable to identify the white ink by performing the above-described determination regarding the white ink in advance, or to set two types of the lower limit threshold and the upper limit threshold in the clear ink determination. For example, the processing section 120 sets the lower limit threshold to 50 and the upper limit threshold to 150, and determines that the ink IK is clear ink when the respective RGB light amounts are between the lower limit threshold and the upper limit threshold. Also, for the ink IK other than the clear ink, the lower limit threshold and the upper limit threshold may be set when the assumed value is an intermediate value. For example, for the B light amount of cyan ink, in addition to setting the lower limit threshold to 50, the upper limit threshold may be set to 150. For the R light amount of magenta ink, in addition to setting the lower limit threshold to 130, the upper limit threshold may be set to 220. For the G light amount of yellow ink, in addition to setting the lower limit threshold to 100, the upper limit threshold may be set to 200.

As described above, the processing section 120 may determine whether the ink IK to be determined is the first ink color based on a first ink color threshold corresponding to the first ink color, and determine whether the ink IK to be determined is the second ink color based on a second ink color threshold corresponding to the second ink color. That is, in the determination based on the first ink color threshold, only the ink of the first ink color satisfies the condition and the inks of other colors do not satisfy the condition. Therefore, the ink type can be determined by performing the determination using the threshold corresponding to the ink color.

In the present embodiment, light of a plurality of wavelength bands is used as described above. Therefore, the first ink color threshold includes a threshold Th11 used for comparison with the first light amount and a threshold Th12 used for comparison with the second light amount, and the second ink color threshold includes a threshold Th21 used for comparison with the first light amount and a threshold Th22 used for comparison with the second light amount. When the first ink color is black, the threshold Th11 is, for example, $Th_{Bk_R}$, and the threshold Th12 is, for example, $Th_{Bk_G}$. Further, as described above, the threshold such as Th11 is not limited to one value, and may include the lower limit threshold and the upper limit threshold. Further, the values of the respective thresholds described above are examples, and various modifications can be made to specific numerical values.

As described above, in order to perform appropriate printing, it is important to detect whether a given ink tank 310 is filled with an inappropriate type of ink IK. For example, for the ink tank 310 for black ink, it suffices to be able to detect whether the ink other than the black ink is filled, and it may not be necessary to specify the specific ink color. Therefore, the processing section 120 performs the ink color determination for determining whether the ink to be determined has the predicted ink color, based on the threshold set to correspond to the predicted ink color. The ink color determination starts, for example, when it is detected in the ink amount determination that the ink amount has increased beyond the range assumed to be an error.

Figure 34:
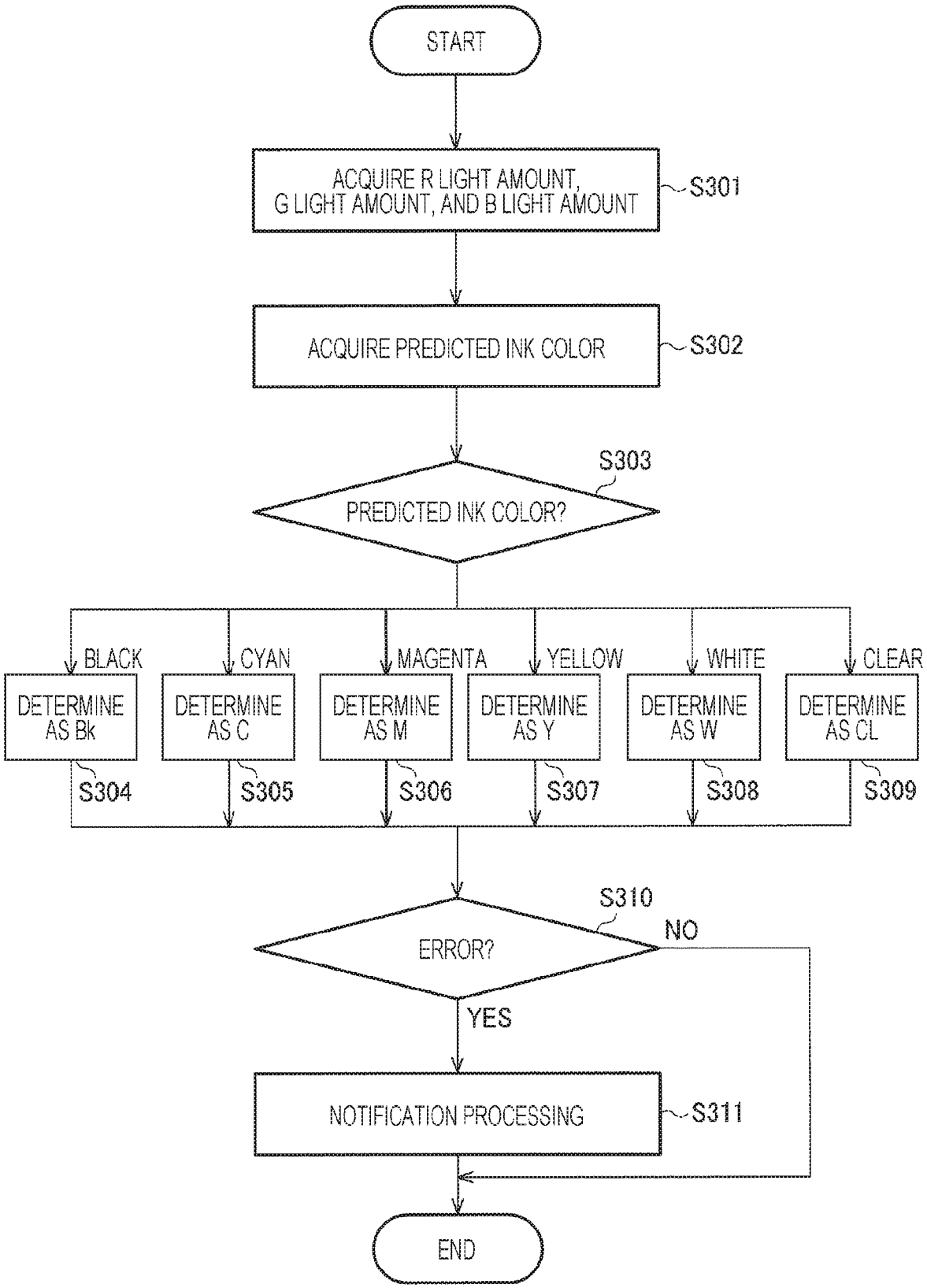
FIG. 34 is a flowchart for explaining ink type determination processing based on a predicted ink color.

FIG. 34 is a flowchart illustrating the ink color determination in this case. When the processing is started, the processing section 120 controls the light source 323 and the sensor 190 to acquire the R light amount, the G light amount, and the B light amount (S301). Further, the processing section 120 specifies the predicted ink color (S302). The ink tank 310 to be read by the photoelectric conversion device 322 is known, and the color of ink to be filled in the ink tank 310 is also known by design. When the photoelectric conversion device 322 is attached to the ink tank 310, the relationship between the photoelectric conversion device 322 and the ink tank 310 is fixed at the time of design. Further, as will be described later with reference to FIGS. 38 and 39, even when the positional relationship between the photoelectric conversion device 322 and the ink tank 310 changes, the relationship between the photoelectric conversion device 322 and the ink tank 310 can be obtained based on the control information of the drive mechanism such as the carriage.

Next, the processing section 120 branches the processing based on the predicted ink color (S303). When the predicted ink color is black, the processing section 120 determines whether the ink is black ink (S304). The determination as to whether the ink is black ink is specifically a threshold determination using $Th_{Bk_R}$, $Th_{Bk_G}$, and $Th_{Bk_B}$. Similarly, when the predicted ink color is cyan, the processing section 120 determines whether the ink is cyan ink (S305). When the predicted ink color is magenta, it is determined whether the ink is magenta ink (S306). When the predicted ink color is yellow, it is determined whether the ink is yellow ink (S307). When the predicted ink color is white, it is determined whether the ink is white ink (S308). When the predicted ink color is clear, it is determined whether the ink is clear ink (S309). In addition, when it is determined in S304 to S309 that the ink color is not the predicted ink color, the processing section 120 sets an error flag to ON.

Next, the processing section 120 determines whether the error flag is on (S310). When the error flag is on (Yes in S310), it is determined that the given ink tank 310 is filled with the inappropriate ink IK. Therefore, the processing section 120 performs processing of notifying the user to that effect (S311). When the error flag is off (No in S310), the processing ends without performing the notification processing.

Figure 35:
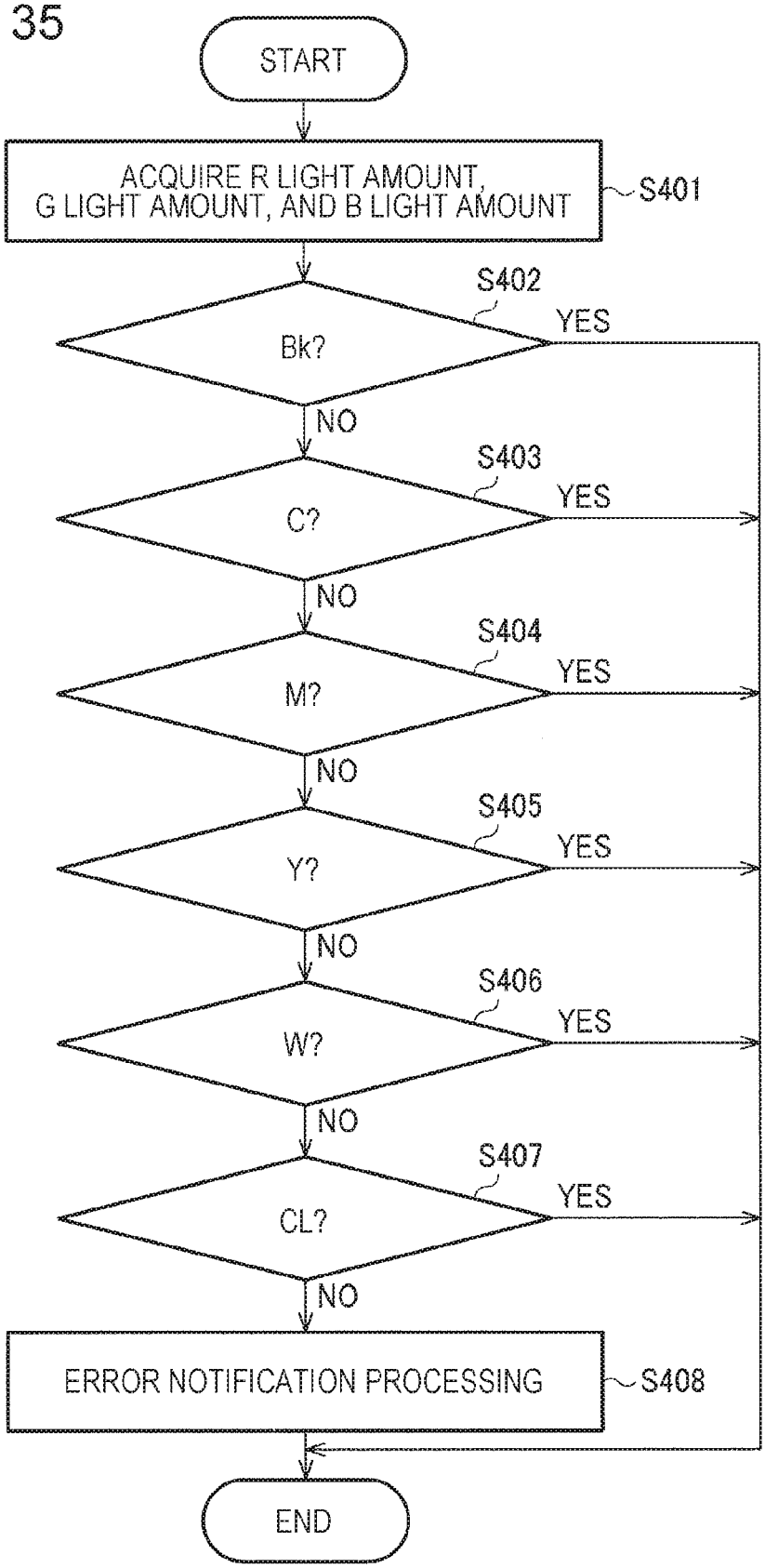
FIG. 35 is a flowchart for explaining ink type determination processing.

FIG. 35 is another flowchart illustrating the ink color determination processing. When this processing is started, the processing section 120 acquires the R light amount, the G light amount, and the B light amount (S401). The processing of S401 is the same as that of S301 of FIG. 34.

The processing section 120 determines whether the ink IK to be determined is black ink (S402). The processing of S402 is the same as that of S304. When it is determined that the ink IK is black ink (Yes in S402), the processing section 120 ends the ink color determination processing.

When it is determined that the ink IK is not black ink (No in S402), the processing section 120 determines whether the ink IK to be determined is cyan ink (S403). The processing of S403 is the same as that of S305. When it is determined that the ink IK is cyan ink (Yes in S403), the processing section 120 ends the ink color determination processing.

Hereinafter, the processing section 120 sequentially determines whether the ink IK is magenta ink, yellow ink, white ink, or clear ink (S404 to S407), and ends the processing when it is determined that the ink color is one of the ink colors. The order of the processing of S402 to S407 is not limited to the example illustrated in FIG. 35, and various modifications can be made.

By performing the processing illustrated in FIG. 35, it is possible not only to determine whether the ink IK has a predicted ink color, but also to specify a specific ink color. In addition, when it is determined to be No in any of S402 to S407, it means that the ink color cannot be specified, and therefore the processing section 120 performs processing of notifying an error (S408), and then ends the processing.

As illustrated in FIGS. 34 and 35, the ink color determination processing according to the present embodiment may be determination processing of determining whether the ink IK to be determined has a predicted ink color, or specific ink color identification processing.

4.3 Modification

The example in which the R light amount, the G light amount, and the B light amount are the minimum value or the average value of the pixel data in the ink detection area has been described above. That is, the light amount is one numerical data, and the ink color determination processing is comparison processing of the numerical data and the threshold. However, the light amount in the present embodiment may be a set of a plurality of pixel data in the ink detection area. For example, the processing section 120 performs comparison processing with the threshold for each pixel data of a plurality of pixel data. Then, the ink color of the ink IK to be determined is determined based on whether the pixel data of a predetermined ratio or more satisfies the condition.

Alternatively, the light amount may be waveform information including a plurality of pixel data in the ink detection area. For example, the storage section 140 stores reference waveform information for each color of ink IK. The reference waveform information is waveform information assumed for the ink IK of the corresponding color. For example, the reference waveform information of black ink is set based on the waveform information actually measured for the black ink. The processing section 120 may determine the ink color of the ink IK to be determined by comparing the waveform information acquired from the sensor 190 with the reference waveform information for each ink color. Here, the waveform information is a set of a plurality of pixel data in the ink detection area. Although the substance can be represented by a list of numbers or a mathematical expression, it is referred to as waveform information because it looks like a wave when graphed as illustrated in FIGS. 27 to 33.

Further, in the above, an example in which the comparison processing using the threshold corresponding to the predetermined ink color is performed to determine whether the ink has the predetermined ink color has been described. In this case, a threshold for black ink, a threshold for cyan ink, and the like are individually set, and each threshold includes a threshold for comparison with the R light amount, a threshold for comparison with the G light amount, and a threshold for comparison with the B light amount. In other words, the method of making a determination based on the ink color has been described.

However, the method of the present embodiment is not limited to this. The processing section 120 may perform comparison processing using the first light amount and the first light amount threshold including a plurality of thresholds having different values, and classify which of the three or more characteristics the first light amount characteristic corresponds to. Similarly, the processing section 120 performs the comparison processing using the second light amount and the second light amount threshold including a plurality of thresholds having different values, thereby classifying which of the three or more characteristics the second light amount characteristic corresponds to. Then, the processing section 120 performs the ink color determination based on the combination patterns of the first light amount characteristic and the second light amount characteristic. When the third light is used, the processing section 120 performs comparison processing using the third light amount and a third light amount threshold including a plurality of thresholds having different values, thereby classifying which of the three or more characteristics the third light amount characteristic corresponds to. Then, the ink color determination is performed based on the combination patterns of the first to third light amount characteristics.

For example, in consideration of FIGS. 28 to 33, four characteristics are set as the respective light amount characteristics. A first characteristic is a characteristic in which the difference between the pixel data in the ink detection area and the pixel data in the ink non-detection area is very large, like the R light amount of black ink. For example, the pixel data in the ink detection area is near 0, and the pixel data in the ink non-detection area is near 200. Such a light amount characteristic has a large variation range of the value in the vicinity of the liquid level, and can be said to be a characteristic suitable for the ink amount detection processing. For the B light amount of the black ink and the B light amount of the magenta ink, the pixel data in the ink detection area does not drop to 0, but the difference with the ink non-detection area is sufficiently large. Therefore, the light amount characteristics thereof are included in the first characteristic.

A second characteristic is a characteristic in which the difference between the pixel data in the ink detection area and the pixel data in the ink non-detection area is very small, like the R light amount of magenta ink. For example, the pixel data in the ink detection area and the pixel data in the ink non-detection area are both near 200. Such a light amount characteristic has a small variation range of the value in the vicinity of the liquid level, and is not suitable for the ink amount detection processing. For the G light amount of the yellow ink, the pixel data in the ink detection area has a value of about 150, but the value of the ink non-detection area also has a value of about 160 to 170. Therefore, the G light amount characteristic of the yellow ink is the second characteristic.

A third characteristic is a characteristic in which the difference between the pixel data in the ink detection area and the pixel data in the ink non-detection area has an intermediate value, like the B light amount of cyan ink. For example, the difference between the pixel data in the ink detection area and the pixel data in the ink non-detection area is about 100. As for the light amount characteristic, since the variation range of the value in the vicinity of the liquid level is moderate, the ink amount detection processing is possible. However, it is difficult to make a determination with high accuracy as compared with the first characteristic.

A fourth characteristic is a characteristic in which the pixel data in the ink detection area has a larger value than the pixel data in the ink non-detection area. The fourth characteristic corresponds to a case where the reflectance of the ink IK becomes very high. For example, the R light amount characteristic of the yellow ink or each light amount characteristic of the white ink is the fourth characteristic.

FIG. 36 is a diagram illustrating a relationship between the ink color, the light wavelength band, and the light amount characteristic. In FIG. 36, "o" represents the first characteristic, "x" represents the second characteristic, "Δ" represents the third characteristic, and "*" represents the fourth characteristic.

As illustrated in FIG. 36, for the black ink, the R light amount characteristic, the G light amount characteristic, and the B light amount characteristic are all "○". For the cyan ink, the R light amount characteristic and the G light amount characteristic are "○", and the B light amount characteristic is "Δ". For the magenta ink, the R light amount characteristic is "x", and the G light amount characteristic and the B light amount characteristic are "○". For the yellow ink, the R light amount characteristic is "*", the G light amount characteristic is "x", and the B light amount characteristic is "○". For the white ink, the R light amount characteristic, the G light amount characteristic, and the B light amount characteristic are all "*". For the clear ink, the R light amount characteristic, the G light amount characteristic, and the B light amount characteristic are all "Δ".

As can be seen from FIG. 36, in each of the black, cyan, magenta, yellow, white, and clear inks, the combination patterns of the three light amount characteristics of RGB do not overlap with each other. Therefore, the processing section 120 can determine the ink color by obtaining the combination pattern of the light amount characteristic for the ink IK to be determined based on which of the patterns in FIG. 36 the pattern matches.

For example, the processing section 120 obtains a difference absolute value between the pixel data in the ink non-detection area and the pixel data in the ink detection area as the light amount. Then, the processing section 120 determines the first characteristic when the light amount is greater than 150, and determines the third characteristic when the light amount is greater than 50 and 150 or smaller. When the light amount is 50 or smaller, the magnitude relationship between the pixel data of the ink detection area and the pixel data of the ink non-detection area is determined. The processing section 120 determines the second characteristic when the pixel data of the ink detection area is relatively small, and determines the fourth characteristic when the pixel data of the ink detection area is relatively large. In this case, the plurality of thresholds included in the first light amount threshold are two, that is 50 and 150. Similarly, the plurality of thresholds included in the second light amount threshold are two, that is, 50 and 150. However, the specific numerical value of the threshold can be modified in various ways. Further, the plurality of thresholds included in the first light amount threshold and the plurality of thresholds included in the second light amount threshold may not match. For example, the threshold for determining the R light amount characteristic may be different from the threshold for determining the G light amount characteristic.

Further, here, an example in which the pixel data in the ink detection area based on the pixel data in the ink non-detection area is used as the light amount has been described, but the pixel data in the ink detection area may be used as it is as the light amount. For example, the processing section 120 sets three thresholds of 50, 150, and 220 as the first light amount threshold. Then, the processing section 120 determines the first characteristic when the pixel data value in the ink detection area is 50 or smaller, determines the third characteristic when the pixel data value is greater than 50 and 150 or smaller, determines the second characteristic when the pixel data value is greater than 150 and 220 or smaller, and determines the fourth characteristic when the pixel data value is greater than 220. For the second light amount threshold and the third light amount threshold, the light amount characteristic may be determined based on three thresholds in the same manner.

As can be seen from FIG. 36, even when "Δ" is replaced with "x", the combination patterns of the light amount characteristics do not overlap each other. Therefore, the processing section 120 may classify the light amount characteristics into three without distinguishing the second characteristic and the third characteristic. Similarly, even when "*" is replaced with "x", the combination patterns of the light amount characteristics do not overlap. Therefore, the processing section 120 may classify the light amount characteristics into three without distinguishing the second characteristic and the fourth characteristic.

An example in which the ink type determination is performed after acquiring all the light amounts of RGB has been described above. However, this can also be modified. In order to simplify the description, processing of performing ink color determination will be described below for the four colors of black, cyan, magenta, and yellow.

Figure 37:
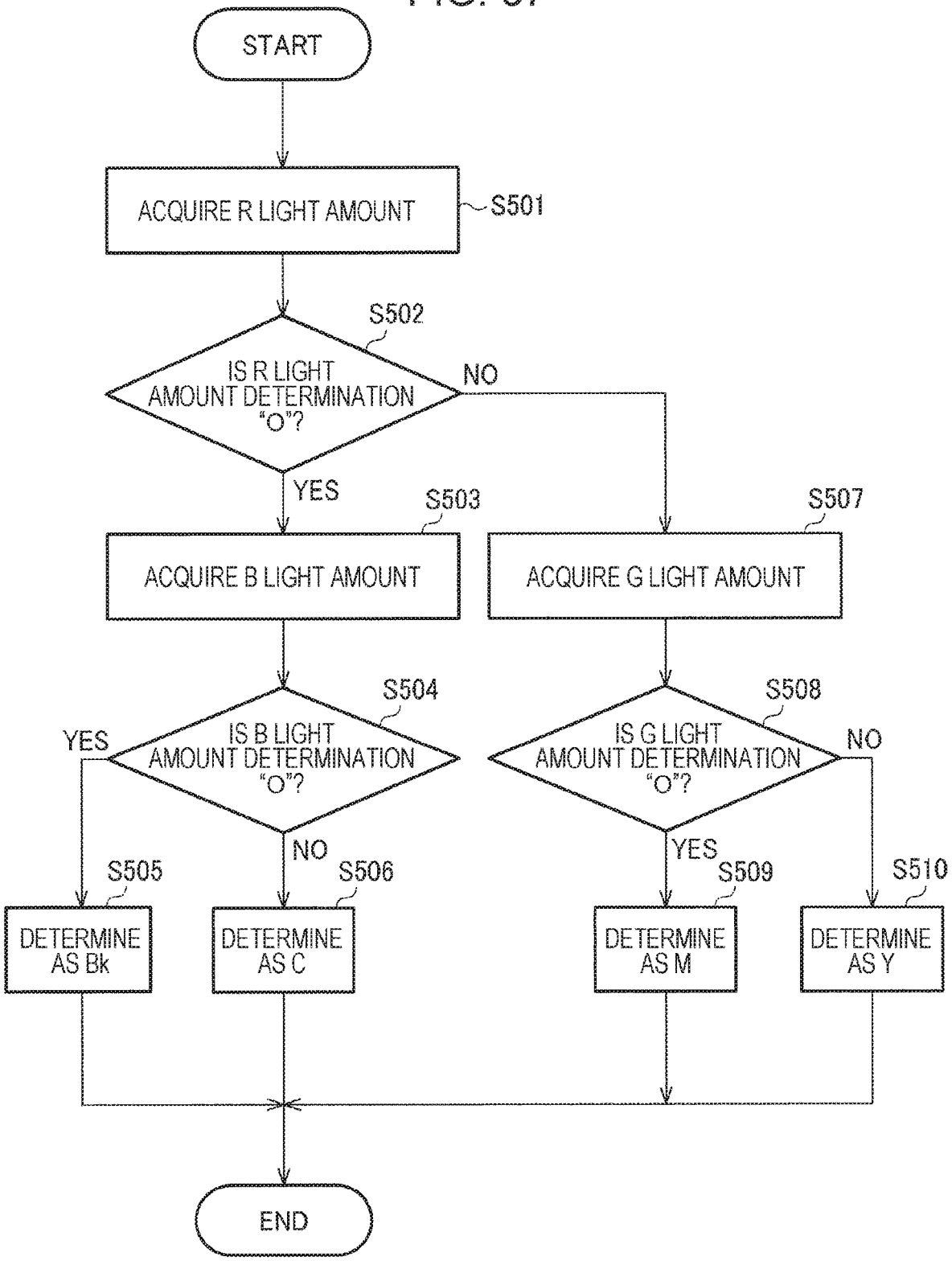
FIG. 37 is a flowchart for explaining ink type determination processing.

FIG. 37 is another flowchart illustrating the ink color determination processing. When the processing is started, the processing section 120 acquires the R light amount (S501). In S501, an emission control of the red LED 323R corresponding to R is performed, and emission controls of the green LED 323G and the blue LED 323B are unnecessary. The processing section 120 performs determination using the R light amount (S502). The processing of S502 is, for example, the light amount characteristic determination using FIG. 36, and in a narrow sense, the determination is whether it is the first characteristic.

When the R light amount characteristic is the first characteristic (Yes in S502), the ink IK to be determined is determined to be black or cyan. Therefore, the processing section 120 acquires the B light amount (S503). In S503, the emission control of the blue LED 323B is performed, and emission controls of the red LED 323R and the green LED 323G are unnecessary. The processing section 120 performs determination using the B light amount (S504). When the B light amount characteristic is the first characteristic (Yes in S504), the processing section 120 determines that the ink IK to be determined is black ink (S505). When the B light amount characteristic is not the first characteristic (No in S504), the processing section 120 determines that the ink IK to be determined is cyan ink (S506).

When the R light amount characteristic is not the first characteristic (No in S502), the ink IK to be determined is determined to be magenta or yellow. Therefore, the processing section 120 acquires the G light amount (S507). In S507, the emission control of the green LED 323G is performed, and the emission controls of the red LED 323R and the blue LED 323B are unnecessary. The processing section 120 performs determination using the G light amount (S508). When the G light amount characteristic is the first characteristic (Yes in S508), the processing section 120 determines that the ink IK to be determined is magenta ink (S509). When the G light amount characteristic is not the first characteristic (No in S508), the processing section 120 determines that the ink IK to be determined is cyan ink (S510).

In the processing illustrated in FIG. 37, two lights having different wavelength bands may be emitted until the ink color is determined. Compared to when acquiring the light amount of all the three colors of RGB, the time required for the light emission of the light source 323 and the output of the pixel data by the sensor 190 can be reduced, and therefore the speed of the ink color determination processing can be increased. Note that, in FIG. 37, an example in which the R light amount is first determined and then the G light amount or the B light amount is determined has been described, but it can be easily understood that various modifications can be made to the determination order. The determinations in S502, S504, and S508 may be any processing that can identify the difference between the ink colors, and are not limited to the light amount characteristic determination described above with reference to FIG. 36.

Further, in the present embodiment, the light source 323 used in the ink amount detection processing may be determined based on the ink type. Specifically, when the ink IK of any one of black ink, cyan ink, magenta ink, and yellow ink is targeted, the light source 323 having the first characteristic as the light amount characteristic is used for the ink amount detection processing. As described above, in the first characteristic, the difference in the pixel data between the ink detection area and the ink non-detection area is large. Therefore, by using the pixel data of the first characteristic, it is possible to improve the accuracy of the ink amount detection processing as compared with the case of using the pixel data of other characteristics.

An example in which the processing of FIG. 37 and the ink amount detection processing are combined will be described. When it is determined that the ink IK to be determined is black ink (S505), the processing section 120 performs the ink amount detection processing based on the R pixel data acquired in S501 or the B pixel data acquired in S503. Since the light amount characteristics of all of RGB of the black ink are the first characteristics, the processing section 120 can use the pixel data of an optional color for the ink amount detection processing. Here, considering the use of the acquired pixel data, R or B is used.

When it is determined that the ink IK to be determined is cyan ink (S506), the processing section 120 performs the ink amount detection processing based on the R pixel data acquired in S501. When it is determined that the ink IK to be determined is magenta ink (S509), the processing section 120 performs the ink amount detection processing based on the G pixel data acquired in S507.

When it is determined that the ink IK to be determined is yellow ink (S510), the processing section 120 performs the ink amount detection processing based on the B pixel data. However, since the B light amount has not been acquired at the stage of S510, the processing section 120 acquires the B light amount by performing the emission control of the blue LED 323B, and then performs the ink amount detection processing based on the acquired pixel data of B.

5. Notification Using Light Source of Sensor Unit

An example in which the light source 323 included in the sensor unit 320 is used in the ink amount detection processing or the ink type determination processing has been described above. That is, the light source 323 emits light toward the side surface of the ink tank 310. However, the light source 323 can also have these other functions.

For example, an electronic apparatus 10, which is a printer, may include a light guide 112 that guides light from the light source 323 to the outside of the housing, in addition to the ink tank 310, the print head 107, the light source 323, the sensor 190, and the processing section 120. The housing here is a member that accommodates each part of the printer. For example, the electronic apparatus 10 includes a housing that accommodates the ink tank 310, the print head 107, the light source 323, the sensor 190, and the processing section 120. The housing here corresponds to the case 102 of the printer unit 100, but the housing may include the case 201 of the scanner unit 200, the case 301 of the ink tank unit 300, and the like. The light guide 324 described above with reference to FIG. 6 guides the light from the light source 323 to the outside of the sensor unit 320, and is different from the light guide 112 that guides the light from the light source 323 to the outside of the housing. For example, the light from the light source 323 enters the light guide 112 through the light guide 324 and is guided to the outside of the housing by the light guide 112.

In this way, the light source 323 used for the ink amount detection processing and the ink type determination processing can be used for other purposes. Specifically, the light source 323 is used to visually notify the state of the printer. For example, based on the light emission of the light source 323, it is possible to urge the user to take appropriate measures by notifying about the ink amount and notifying the occurrence of errors. In this way, it is not necessary to provide a light source dedicated to the notification in addition to the light source 323, so that the cost of the printer can be reduced.

Figure 38:
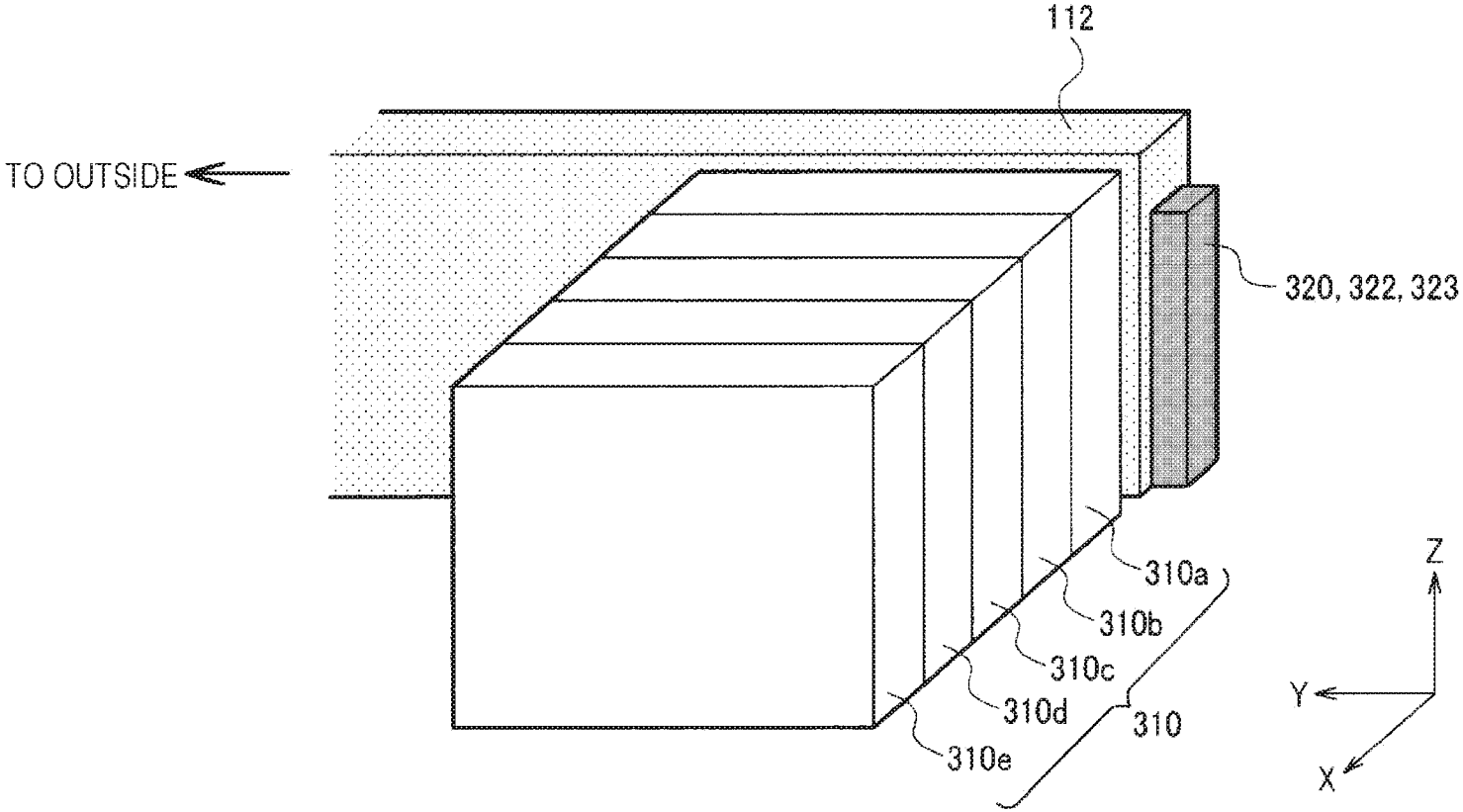
FIG. 38 is a diagram for explaining a positional relationship between a sensor unit and a light guide that guides light to an outside of a housing.
Figure 39:
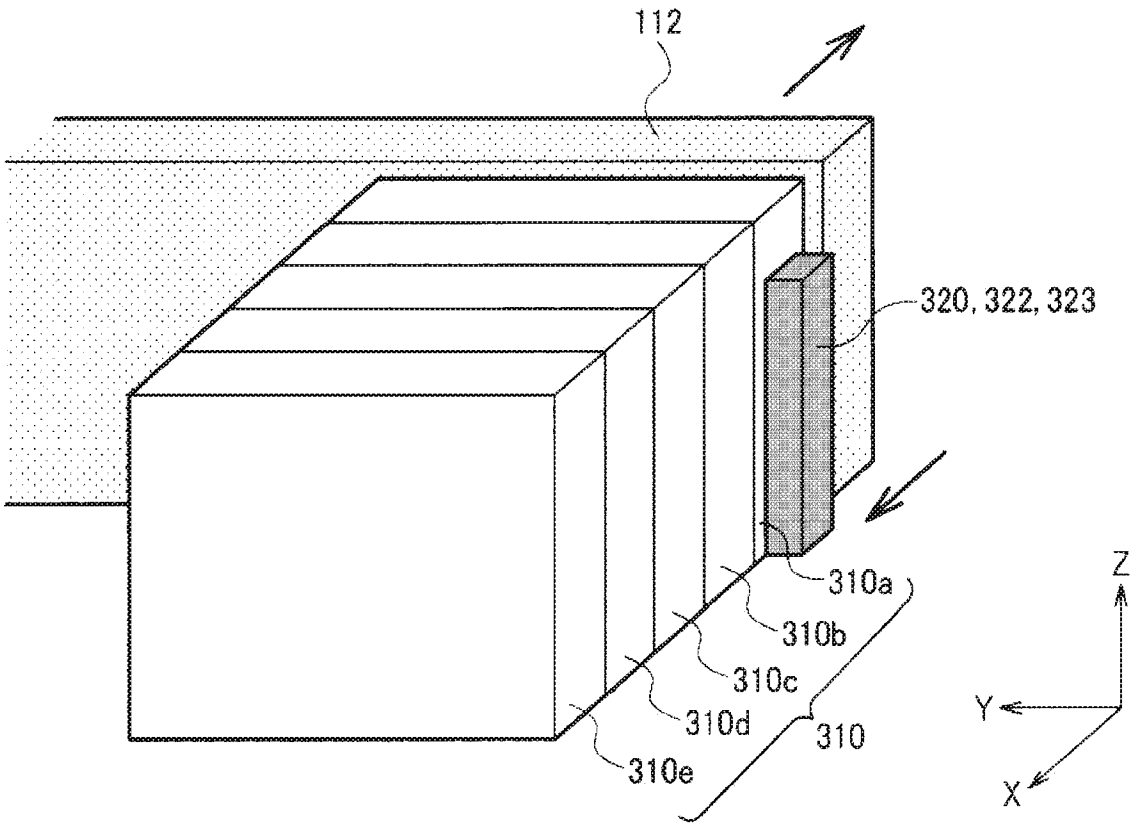
FIG. 39 is a diagram for explaining a positional relationship between a sensor unit and a light guide that guides light to an outside of a housing.

FIGS. 38 and 39 are perspective diagrams for explaining a positional relationship between the ink tank 310, the sensor unit 320 including the light source 323, and the light guide 112 of the printer according to the present embodiment. As illustrated in FIGS. 38 and 39, the light guide 112 and the ink tank 310 are disposed in the first direction. The first direction here is, for example, the ±X direction, and corresponds to the main scanning axis HD of the printer. Here, five ink tanks 310*a* to 310*e* are illustrated as the ink tank 310. For example, the light guide 112, the ink tank 310*a*, the ink tank 310*b*, the ink tank 310*c*, the ink tank 310*d*, and the ink tank 310*e* are disposed side by side in this order along the +X direction.

Further, the light source 323 is provided at a position in the −Y direction with respect to the ink tank 310 and the light guide 112, and irradiates the ink tank 310 or the side surface on the −Y direction side of the light guide 112 with light. Here, as illustrated in FIGS. 38 and 39, the light source 323 and the sensor 190 may move relatively to the ink tank 310 and the light guide 112 in the first direction.

As described above with reference to FIG. 9, the sensor unit 320 may be fixed to the side surface of the ink tank 310 in consideration of the ink amount detection processing. However, when that state is maintained, it is difficult to guide the light from the light source 323 to the outside of the housing using the light guide 112. On the other hand, when the ink tank 310, the light guide 112, and the sensor unit 320 are relatively movable along the X-axis direction, as illustrated in FIG. 38, it is possible to switch between a state where positions of the light guide 112 and the sensor unit 320 on the X-axis overlap as illustrated in FIG. 38, and a state where positions of any of the ink tank 310 and the sensor unit 320 on the X-axis overlap as illustrated in FIG. 39. In the state illustrated in FIG. 38, the light from the light source 323 is incident on the light guide 112. Therefore, the light from the light source 323 can be guided to the outside of the housing by extending the light guide 112 near the housing. In the state illustrated in FIG. 39, the light from the light source 323 is incident on the side surface of the ink tank 310. Therefore, the ink amount detection processing and the ink type determination processing described above can be performed.

Furthermore, it is also possible to perform control to switch between a state where the positions of the ink tank 310*a* and the sensor unit 320 on the X-axis overlap and a state where the positions of the ink tank 310*b* and the sensor unit 320 on the X-axis overlap. Therefore, it is possible to execute the ink amount detection processing and the ink type determination processing for a plurality of ink tanks 310 by using a small number of sensor units 320, or one sensor unit 320 in a narrow sense.

Figure 40:
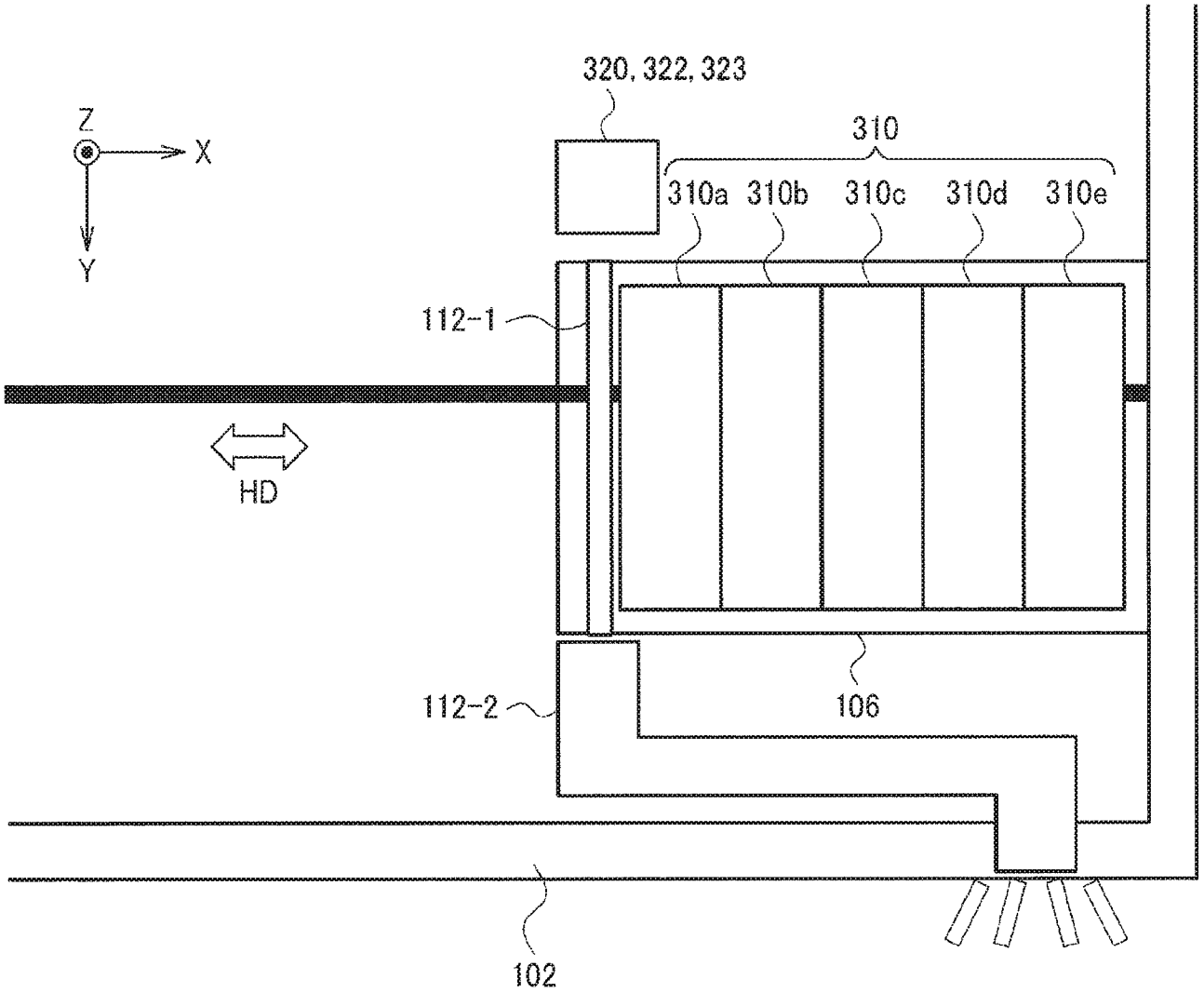
FIG. 40 is a diagram for explaining a positional relationship between a sensor unit and a light guide in an on-carriage type printer.

FIG. 40 is a diagram for explaining the positional relationship of each part when the ink tank 310, the light guide 112, and the sensor unit 320 are observed from the +Z direction. As illustrated in FIG. 40, the printer further includes a carriage 106 on which the ink tank 310 is mounted and which moves with respect to the housing. That is, the carriage 106 has the ink tank 310 and the print head 107, and is movable in the main scanning direction while mounting them. In this way, the positional relationship between the ink tank 310 and the light source 323 can be adjusted by performing drive control of the carriage 106. In this case, the position of the sensor unit 320 with respect to the housing can be fixed, but driving both the carriage 106 and the sensor unit 320 is not hindered. Further, it is not hindered that the light guide is composed of one member or a plurality of members.

More specifically, the light guide 112 includes a first light guide 112-1 mounted on the carriage 106 and a second light guide 112-2 provided outside the carriage 106 and fixed to the housing. Then, the light passing through the first light guide 112-1 is emitted to the outside of the housing via the second light guide 112-2. By mounting the first light guide 112-1 on the carriage 106, the positional relationship between the light guide 112 and the sensor unit 320 on the X-axis can be adjusted. That is, as illustrated in FIG. 38, a state in which the light from the light source 323 enters the light guide 112 can be realized. Further, by fixing the second light guide 112-2, it is possible to limit the portion of the light guide 112 to be moved. When the entire light guide 112 moves, it is necessary to widen a space serving as a movement path in order to suppress collision with other members. On the other hand, by fixing the second light guide 112-2 to the housing, it is possible to prevent the printer from increasing in size.

Note that, as illustrated in FIG. 40, in a state where the light from the light source 323 is guided to the outside of the housing, the light source 323, the first light guide 112-1, and the second light guide 112-2 are disposed in this order in the second direction intersecting the first direction. The second direction is a direction along the Y-axis and corresponds to the sub-scanning axis VD. The second direction is specifically the +Y direction. In this way, the light from the light source 323 is guided in the order of the first light guide 112-1 and the second light guide 112-2, so that the light can be appropriately guided to the outside of the housing.

The printer includes a light guide 112 and an indicator including a window portion. That is, by making a part of the housing a transparent window portion, the light from the light source 323 guided by the light guide 112 can be emitted to the outside of the housing. Hereinafter, an example will be described in which the window portion transmits the light without changing the wavelength band of the light emitted from the light source 323. For example, when the light source 323 causes the red LED 323R to emit light, the indicator emits red light. However, the method of the present embodiment is not limited to this, and some filtering may be performed on the light from the light source 323, and the filtered light may be emitted to the outside of the housing. Further, the light from the light source 323 may be used as a backlight of a liquid crystal display or the like. The window portion may be a translucent member or an opening provided in the housing.

The processing section 120 controls the light guided to the outside by the light guide 112 based on the state of the printer. In this way, it becomes possible to appropriately notify the user of the state of the printer. The state here is specifically an error state of the printer or a state of the ink IK in the ink tank. The state of the ink IK is specifically a state corresponding to the ink-low state or the ink-full state. The error represented by the error state is assumed to be various errors such as discharge failure of the print head 107, paper jam, ink leakage, motor failure, and pump failure. The error state is a state in which printing cannot be executed, or a state in which printing cannot be executed unless the user takes a countermeasure. Therefore, it is important to notify the error state. Further, ink-low state is a state in which there is a possibility that the print head 107 may be defective due to the ink being exhausted, and ink-full state is a state in which ink leakage may occur due to further replenishment. Also in these cases, by notifying the user, the printer can be operated appropriately.

The notification control according to the state may be control regarding a light source of any color included in the light source 323, for example. In this case, the processing section 120 performs control of indicating the state by turning on, turning off, or blinking of the light source. The processing section 120 may notify the state in a distinguishable manner by adjusting the blinking interval or the like.

Alternatively, the light source 323 may emit light of a plurality of colors. The processing section 120 controls light according to the state based on the light emission patterns of light of a plurality of colors. As described above, in the ink amount detection processing and the ink type determination processing, for example, lights of three colors of RGB are emitted. Therefore, the processing section 120 may control not only a light emission timing of turning on, turning off, blinking, or the like, but also the light emission color of the indicator. For example, the processing section 120 adjusts the amount of light of each wavelength band of RGB by pulse width modulation (PWM) control and mixes the colors to cause the indicator to emit light of the ink color to be notified.

Figure 41:
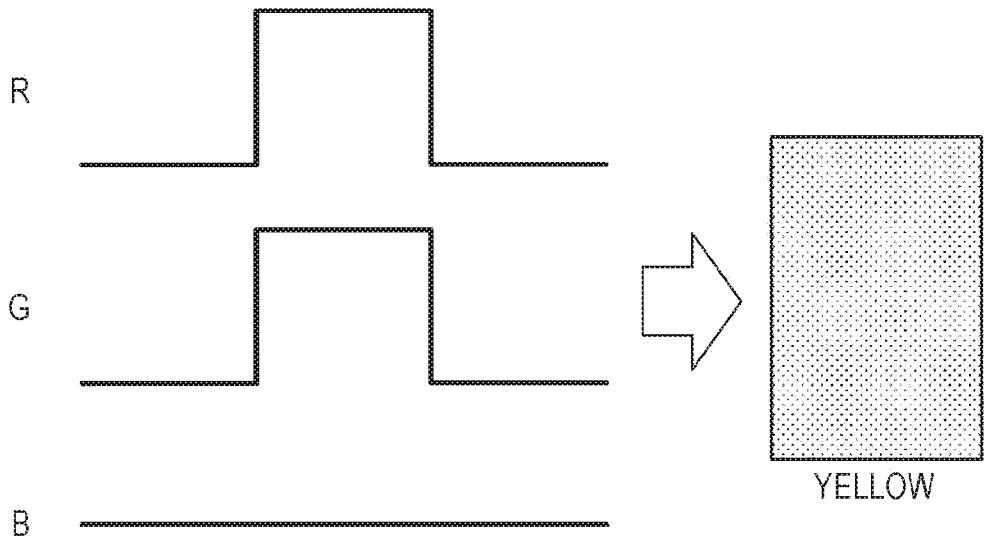
FIG. 41 is a diagram for explaining a method of controlling a plurality of light sources.

FIG. 41 is a diagram for explaining the color mixing of light. As illustrated in FIG. 41, the processing section 120 controls the pulse width of the control signal of the red LED 323R, the pulse width of the control signal of the green LED 323G, and the pulse width of the control signal of the blue LED 323B thereby adjusting the intensity of each color of RGB. In the example of FIG. 41, it is possible to make the light from the light source 323 yellow light by increasing the intensities of R light and G light and not emitting B light. For example, when it is determined that the yellow ink is the ink-low state or the ink-full state, the processing section 120 controls the indicator to emit yellow light. For example, the processing section 120 controls the indicator to turn on yellow when the yellow ink is determined to be ink-low state, and controls the indicator to blink yellow when the yellow ink is determined to be ink-full state. In this way, it becomes possible to notify the state of the ink IK in an easy-to-understand manner in the printer using the inks IK of a plurality of colors.

The method of the present embodiment includes the ink tank 310, the print head 107, the light source 323, the sensor 190, and the processing section 120, and the processing section 120 controls the light source 323 according to the state of the printer, so that the processing section 120 can be applied to the printer that performs processing for notifying the user of the state. That is, the printer according to the present embodiment may have a configuration capable of executing the notification using the light from the light source 323, and the configuration is not limited to the light guide 112. It is also applicable to a so-called off-carriage type printer in which the ink tank is provided outside the carriage. In this case, the light source 323 may be moved to a position facing the light guide fixed to the housing so as to line up with the ink tank, so that the notification using the light can be executed.

6. Multifunction Peripheral

Figure 42:
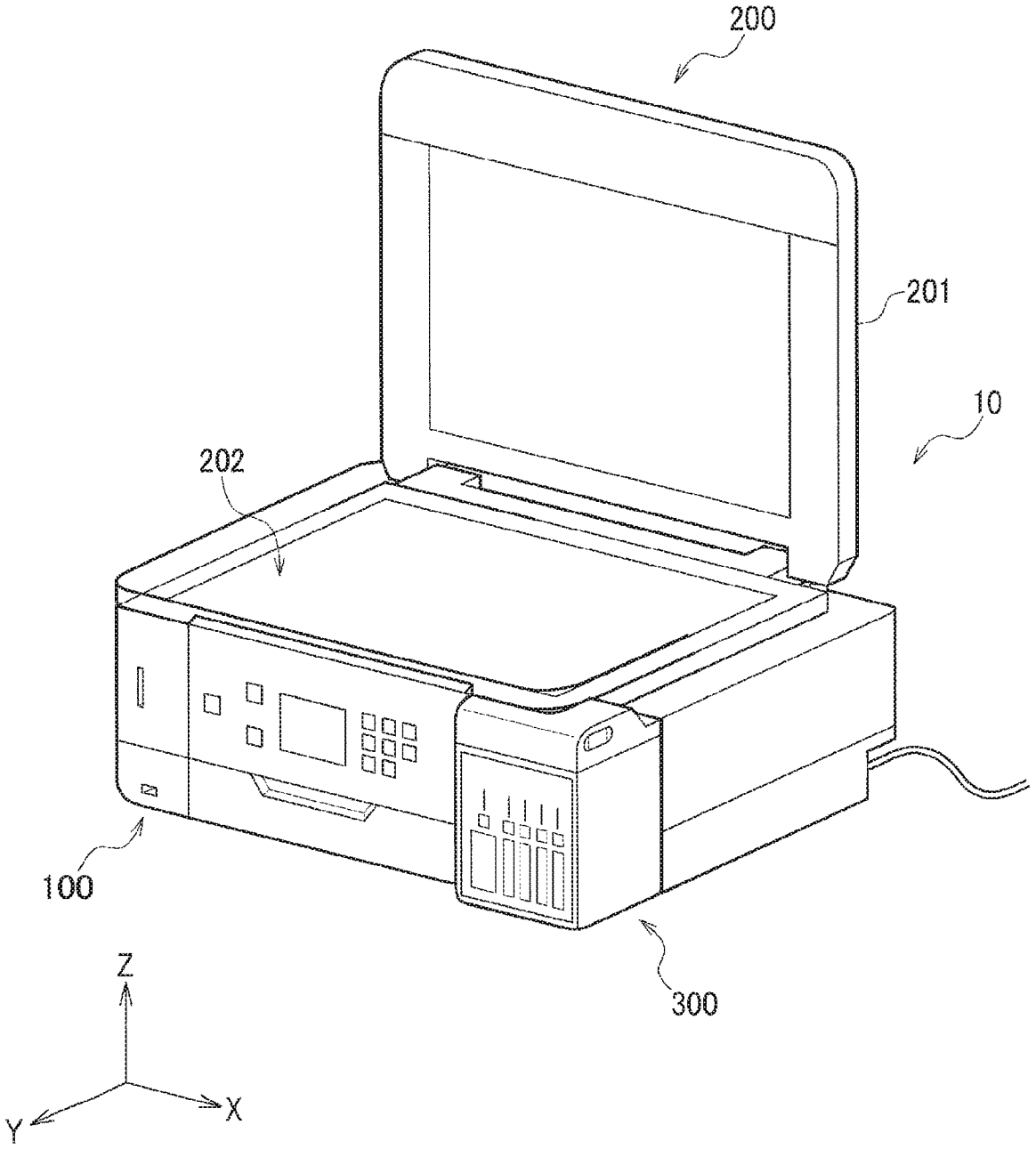
FIG. 42 is a perspective diagram of an electronic apparatus when a scanner unit is used.

The electronic apparatus 10 according to the present embodiment may be a multifunction peripheral having a printing function and a scanning function. FIG. 42 is perspective diagram illustrating a state in which the case 201 of the scanner unit 200 is rotated with respect to the printer unit 100 in the electronic apparatus 10 of FIG. 1. In the state illustrated in FIG. 42, a document table 202 is exposed. The user sets a document to be read on the document table 202, and then instructs the execution of scanning by using the operation section 160. The scanner unit 200 reads an image of the document by performing the reading processing while moving the image reading section (not illustrated) based on the instruction operation by the user. The scanner unit 200 is not limited to a flat bed type scanner. For example, the scanner unit 200 may be a scanner having an auto document feeder (ADF) (not illustrated). The electronic apparatus 10 may be an apparatus having both the flat bed type scanner and a scanner having the ADF.

The electronic apparatus 10 includes the image reading section including a first sensor module, the ink tank 310, the print head 107, the second sensor module, and the processing section 120. The image reading section reads the document by using the first sensor module including m linear image sensor chips, m being an integer of two or more. The second sensor module includes n linear image sensor chips, n being an integer of 1 or more and n<m, and detects light incident from the ink tank 310. The processing section 120 detects the amount of ink in the ink tank based on the output of the second sensor module. The first sensor module is a sensor module used for scanning an image in the scanner unit 200, and the second sensor module is a sensor module used for the ink amount detection processing in the ink tank unit 300.

Both the first sensor module and the second sensor module include a linear image sensor chip. The specific configuration of the linear image sensor chip is the same as that of the photoelectric conversion device 322 described above, and a plurality of photoelectric conversion elements are disposed side by side in a predetermined direction. Since the linear image sensor used for the image reading and the linear image sensor used for the ink amount detection processing can be used in common, it is possible to improve the manufacturing efficiency of the electronic apparatus 10.

However, the first sensor module needs to have a length corresponding to the document size to be read. Since the length of one linear image sensor chip is about 10 mm, for example, the first sensor module needs to include at least two linear image sensor chips. On the other hand, the second sensor module has a length corresponding to the target range of ink amount detection. The target range of ink amount detection can be variously modified but is generally shorter than that of the image reading. That is, as described above, m is an integer of 2 or more, n is an integer of 1 or more, and m>n. In this way, the number of linear image sensor chips can be appropriately set according to the application.

The difference between the first sensor module and the second sensor module is not limited to the number of linear image sensor chips. In the m linear image sensor chips of the first sensor module, the longitudinal direction is provided along the horizontal direction. In the n linear image sensor chips of the second sensor module, the longitudinal direction is provided along the vertical direction. Since the second sensor module needs to detect the liquid level of the ink IK as described above, the longitudinal direction thereof becomes vertical direction.

On the other hand, in consideration of reading the image of the document, the longitudinal direction of the first sensor module needs to be the horizontal direction. This is because when the longitudinal direction of the first sensor module is set to the vertical direction, it is difficult to stably set the document on the document table 202, or it is difficult to stabilize the document posture when the document is transported by the ADF. By setting the longitudinal direction of the linear image sensor chip in accordance with the application, the ink amount detection processing and the image reading can be performed appropriately.

The first sensor module operates at a first operating frequency, and the second sensor module operates at a second operating frequency lower than the first operating frequency. In image reading, it is necessary to continuously acquire signals corresponding to many pixels and to form image data by performing A/D conversion processing, correction processing, or the like of the signals. Therefore, it is desirable to perform reading by the first sensor module at high speed. On the other hand, the ink amount detection is less likely to be a problem even when the number of photoelectric conversion elements is small and it takes a certain amount of time to detect the ink amount. By setting the operating frequency for each sensor module, each sensor module can be operated at an appropriate speed.

As described above, the printer according to the present embodiment includes an ink tank, a print head, a light source, a sensor, and a processing section. The print head performs printing by using ink in the ink tank. The light source emits light into the ink tank. The sensor outputs pixel data by detecting the light incident from the ink tank side in a period during which the light source emits light. The processing section determines the ink amount based on the output of the sensor. Further, the processing section 120 determines the ink amount based on the low resolution pixel data output by the sensor in the first reading area and the high resolution pixel data output by the sensor in the second reading area other than the first reading area.

In this way, the data output from the sensor can be reduced as compared with a case where the high resolution pixel data is output in the entire area. Since the amount of data accumulated in the sensor and the amount of data transmitted from the sensor to the processing section can be reduced, the memory included in the sensor can be downsized and the communication time can be shortened.

Further, the sensor of the present embodiment may output the low resolution pixel data and the high resolution pixel data by one time of reading.

In this way, the ink amount detection processing for a wide range corresponding to the sum area of the first reading area and the second reading area can be executed by one time of reading. Therefore, it is possible to speed up the ink amount detection processing as compared with a case of a two-stage reading is performed.

The second reading area of the present embodiment may be an area including the position of the ink level corresponding to the ink-low state.

In this way, it becomes possible to detect a state where the ink amount is insufficient with high accuracy.

Further, the second reading area of the present embodiment may be an area including the position of the ink level corresponding to the ink-full state.

In this way, it is possible to detect a state in which the ink amount may become excessive with high accuracy.

Further, the processing section of the present embodiment may designate the first reading area and the second reading area for the sensor.

In this way, the sensor can perform an appropriate reading operation based on the instruction from the processing section.

Further, the processing section of the present embodiment may designate the first reading area and the second reading area for the sensor based on the predicted amount of ink.

In this way, it is possible to increase the accuracy of the ink amount detection processing for an area where the ink level is highly likely to exist.

Further, the sensor of the present embodiment may include a plurality of photoelectric conversion elements, and the processing section may acquire the pixel data obtained by thinning out the outputs from a part of photoelectric conversion elements out of the plurality of photoelectric conversion elements as the low resolution pixel data.

In this way, it is possible to reduce the data amount by thinning out the pixels.

Further, the sensor of the present embodiment may include a photoelectric conversion device and an analog front end (AFE) circuit coupled to the photoelectric conversion device.

In this way, it becomes possible to realize a sensor that outputs pixel data that is digital data.

Further, the photoelectric conversion device of the present embodiment may be a linear image sensor.

In this way, the ink amount can be accurately detected by using a plurality of photoelectric conversion elements disposed in a predetermined direction.

Further, the linear image sensor of the present embodiment may be provided such that a longitudinal direction thereof follows the vertical direction.

In this way, the ink amount can be accurately detected by using a plurality of photoelectric conversion elements disposed in the vertical direction.

Although the present embodiment has been described in detail as described above, a person skilled in the art can easily understand that many modifications that do not substantially depart from the novel matters and effects of the present embodiment are possible. Accordingly, all such modifications are intended to be included within the scope of the present disclosure. For example, a term described at least once together with a different term having a broader meaning or the same meaning in the specification or the drawings can be replaced with the different term anywhere in the specification or the drawings. All combinations of the present embodiment and the modifications are also included in the scope of the present disclosure. The configurations and operations of the electronic apparatus, printer unit, scanner unit, ink tank unit, and the like are not limited to those described in the present embodiment, and various modifications can be made.

For example, in the photoelectric conversion device, the linear image sensors may be disposed in the horizontal direction or obliquely from the horizontal direction. In this case, by disposing a plurality of linear image sensors in the vertical direction or moving them in the vertical direction relative to the ink tank, the same information as when the linear image sensors are disposed in the vertical direction can be obtained. The photoelectric conversion device may be one or more area image sensors. In this way, one image sensor may be straddled across a plurality of ink tanks.

What is claimed is:

1. A printer comprising:

an ink tank;

a printing mechanism that performs printing by using ink in the ink tank;

a light source that emits light into the ink tank;

a sensor that outputs pixel data by detecting light from an ink tank side in a period during which the light source emits light; and a processing section that determines an ink amount by an output of the sensor, wherein the processing section determines the ink amount based on low resolution pixel data output from the sensor in a first reading area and high resolution pixel data output from the sensor in a second reading area other than the first reading area.

2. The printer according to claim 1, wherein the sensor outputs the low resolution pixel data and the high resolution pixel data by one time of reading.

3. The printer according to claim 1, wherein the second reading area is an area including a position of a ink level corresponding to an ink-low state.

4. The printer according to claim 1, wherein the second reading area is an area including a position of a ink level corresponding to an ink-full state.

5. The printer according to claim 1, wherein the processing section designates the first reading area and the second reading area for the sensor.

6. The printer according to claim 5, wherein the processing section designates the first reading area and the second reading area for the sensor based on a predicted amount of the ink.

7. The printer according to claim 1, wherein the sensor includes a plurality of photoelectric conversion elements, and the processing section acquires the pixel data obtained by thinning out outputs from a part of the photoelectric conversion elements out of the plurality of photoelectric conversion elements, as the low resolution pixel data.

8. The printer according to claim 1, wherein the sensor includes a photoelectric conversion device and an analog front end (AFE) circuit coupled to the photoelectric conversion device.

9. The printer according to claim 8, wherein the photoelectric conversion device is a linear image sensor.

10. The printer according to claim 9, wherein the linear image sensor is provided such that a longitudinal direction follows a vertical direction.

* * * * *